US011733015B2

(12) United States Patent
Burrow et al.

(10) Patent No.: US 11,733,015 B2
(45) Date of Patent: Aug. 22, 2023

(54) MULTI-PIECE PRIMER INSERT FOR POLYMER AMMUNITION

(71) Applicant: TRUE VELOCITY IP HOLDINGS, LLC, Garland, TX (US)

(72) Inventors: Lonnie Burrow, Carrollton, TX (US); Christopher William Overton, Wylie, TX (US); Florian Herzog, Dallas, TX (US); Nimmy Mammoottil, Richardson, TX (US); Andrew Rosek, Rockwall, TX (US)

(73) Assignee: TRUE VELOCITY IP HOLDINGS, LLC, Garland, TX (US)

( * ) Notice: Subject to any disclaimer, the term of this patent is extended or adjusted under 35 U.S.C. 154(b) by 0 days.

(21) Appl. No.: 16/460,131

(22) Filed: Jul. 2, 2019

(65) Prior Publication Data

US 2020/0011645 A1 Jan. 9, 2020

Related U.S. Application Data

(60) Provisional application No. 62/694,868, filed on Jul. 6, 2018.

(51) Int. Cl.
*F42C 19/08* (2006.01)

(52) U.S. Cl.
CPC ..... *F42C 19/083* (2013.01)

(58) Field of Classification Search
CPC .... F42B 5/26; F42B 5/285; F42B 5/30; F42B 5/307; F42B 5/36; F42B 33/00; F42B 33/001; F42C 19/08; F42C 19/083; F42C 19/10
USPC ..... 102/204
See application file for complete search history.

(56) References Cited

U.S. PATENT DOCUMENTS

| | | | |
|---|---|---|---|
| 99,528 | A | 2/1870 | Boyd |
| 113,634 | A | 4/1871 | Crispin |
| 130,679 | A | 8/1872 | Whitmore |
| 159,665 | A | 2/1875 | Gauthey |
| 169,807 | A | 11/1875 | Hart |
| 207,248 | A | 8/1878 | Bush et al. |
| 462,611 | A | 11/1891 | Comte de Sparre |

(Continued)

FOREIGN PATENT DOCUMENTS

| | | | |
|---|---|---|---|
| CA | 2813634 | A1 | 4/2012 |
| CN | 102901403 | B | 6/2014 |

(Continued)

OTHER PUBLICATIONS

International Search Report and Written Opinion in PCT/US2019/040323 dated Sep. 24, 2019, pp. 1-16.

(Continued)

*Primary Examiner* — Joshua E Freeman
*Assistant Examiner* — Benjamin S Gomberg
(74) *Attorney, Agent, or Firm* — Burdick Patents, P.A.; Sean D. Burdick; Colin L. Honan

(57) ABSTRACT

The present invention provides a two piece and a three piece primer insert for ammunition piece. Each of the individual pieces may be formed by punching, pressing, stamping, molding, milling, coining, or by additive manufacturing. The individual pieces may be joined by clinching, pressing welding soldering, sintering, adhesive gluing, staking, and iterative addition by forming one piece into another piece.

20 Claims, 34 Drawing Sheets

(56) References Cited

U.S. PATENT DOCUMENTS 475,008 A 5/1892 Bush
498,856 A 6/1893 Overbaugh
498,857 A 6/1893 Overbaugh
640,856 A 1/1900 Bailey
662,137 A 11/1900 Tellerson
676,000 A 6/1901 Henneberg
743,242 A 11/1903 Bush
865,979 A 9/1907 Bailey
869,046 A 10/1907 Bailey
905,358 A 12/1908 Peters
957,171 A 5/1910 Loeb
963,911 A 7/1910 Loeble
1,060,817 A 5/1913 Clyne
1,060,818 A 5/1913 Clyne
1,064,907 A 6/1913 Hoagland
1,187,464 A 6/1916 Offutt
1,842,445 A 1/1932 Clyne
1,936,905 A 11/1933 Gaidos
1,940,657 A 12/1933 Woodford
2,294,822 A 9/1942 Norman
2,465,962 A 3/1949 Allen et al.
2,654,319 A 10/1953 Roske
2,823,611 A 2/1958 Thayer
2,862,446 A 12/1958 Lars
2,918,868 A 12/1959 Lars
2,936,709 A 5/1960 Seavey
2,953,990 A 9/1960 Miller
2,972,947 A 2/1961 Fitzsimmons et al.
3,034,433 A 5/1962 Karl
3,099,958 A 8/1963 Daubenspeck et al.
3,157,121 A 11/1964 Daubenspeck et al.
3,159,701 A 12/1964 Herter
3,170,401 A 2/1965 Johnson et al.
3,171,350 A 3/1965 Metcalf et al.
3,242,789 A 3/1966 Woodring
3,246,603 A 4/1966 Comerford
3,256,815 A 6/1966 Davidson et al.
3,288,066 A 11/1966 Hans et al.
3,292,538 A 12/1966 Hans et al.
3,332,352 A 7/1967 Olson et al.
3,444,777 A 5/1969 Lage
3,446,146 A 5/1969 Stadler et al.
3,485,170 A 12/1969 Scanlon
3,485,173 A 12/1969 Morgan
3,491,691 A 1/1970 Vawter
3,565,008 A 2/1971 Gulley et al.
3,590,740 A 7/1971 Herter
3,609,904 A 10/1971 Scanlon
3,614,929 A 10/1971 Herter et al.
3,659,528 A 5/1972 Santala
3,688,699 A 9/1972 Horn et al.
3,690,256 A 9/1972 Schnitzer
3,745,924 A 7/1973 Scanlon
3,749,021 A 7/1973 Burgess
3,756,156 A 9/1973 Schuster
3,765,297 A 10/1973 Skochko et al.
3,768,413 A 10/1973 Ramsay
3,786,755 A 1/1974 Eckstein et al.
3,797,396 A 3/1974 Reed
3,842,739 A 10/1974 Scanlon et al.
3,866,536 A 2/1975 Greenberg
3,874,294 A * 4/1975 Hale ..... F42B 33/001 102/467
3,955,506 A 5/1976 Luther et al.
3,977,326 A * 8/1976 Anderson ..... F42B 5/307 102/467
3,990,366 A * 11/1976 Scanlon ..... F42B 5/26 102/467
4,005,630 A 2/1977 Patrick
4,020,763 A 5/1977 Iruretagoyena
4,132,173 A 1/1979 Amuchastegui
4,147,107 A 4/1979 Ringdal
4,157,684 A 6/1979 Clausser
4,173,186 A 11/1979 Dunham
4,179,992 A 12/1979 Ramnarace et al.
4,187,271 A 2/1980 Rolston et al.
4,228,724 A 10/1980 Leich
4,276,830 A 7/1981 Alice
4,353,304 A 10/1982 Hubsch et al.
4,475,435 A 10/1984 Mantel
4,483,251 A 11/1984 Spalding
4,598,445 A 7/1986 O'Connor
4,614,157 A 9/1986 Grelle et al.
4,679,505 A 7/1987 Reed
4,718,348 A 1/1988 Ferrigno
4,719,859 A 1/1988 Ballreich et al.
4,726,296 A 2/1988 Leshner et al.
4,763,576 A 8/1988 Kass et al.
4,867,065 A 9/1989 Kaltmann et al.
4,970,959 A 11/1990 Bilsbury et al.
5,021,206 A 6/1991 Stoops
5,033,386 A 7/1991 Vatsvog
5,063,853 A 11/1991 Bilgeri
5,090,327 A 2/1992 Bilgeri
5,127,331 A 7/1992 Stoops
5,151,555 A 9/1992 Vatsvog
5,165,040 A 11/1992 Andersson et al.
5,237,930 A 8/1993 Belanger et al.
5,247,888 A 9/1993 Conil
5,259,288 A * 11/1993 Vatsvog ..... F42B 5/307 102/430
5,265,540 A 11/1993 Ducros et al.
D345,676 S 4/1994 Biffle
5,433,148 A 7/1995 Barratault et al.
5,535,495 A 7/1996 Gutowski
5,563,365 A 10/1996 Dineen et al.
5,616,642 A 4/1997 West et al.
D380,650 S 7/1997 Norris
5,679,920 A 10/1997 Hallis et al.
5,758,445 A 6/1998 Casull
5,770,815 A 6/1998 Watson
5,798,478 A 8/1998 Beal
5,950,063 A 9/1999 Hens et al.
5,961,200 A 10/1999 Friis
5,969,288 A 10/1999 Baud
5,979,331 A 11/1999 Casull
6,004,682 A 12/1999 Rackovan et al.
6,048,379 A 4/2000 Bray et al.
6,070,532 A 6/2000 Halverson
D435,626 S 12/2000 Benini
6,257,148 B1 7/2001 Toivonen et al.
6,257,149 B1 7/2001 Cesaroni
D447,209 S 8/2001 Benini
6,272,993 B1 8/2001 Cook et al.
6,283,035 B1 9/2001 Olson et al.
6,357,357 B1 3/2002 Glasser
D455,052 S 4/2002 Gullickson et al.
D455,320 S 4/2002 Edelstein
6,375,971 B1 4/2002 Hansen
6,408,764 B1 6/2002 Heitmann et al.
6,450,099 B1 9/2002 Desgland
6,460,464 B1 10/2002 Attarwala
6,523,476 B1 2/2003 Riess et al.
6,644,204 B2 11/2003 Pierrot et al.
6,649,095 B2 11/2003 Buja
6,672,219 B2 1/2004 Mackerell et al.
6,708,621 B1 3/2004 Forichon-Chaumet et al.
6,752,084 B1 6/2004 Husseini et al.
6,796,243 B2 9/2004 Schmees et al.
6,810,816 B2 11/2004 Rennard
6,840,149 B2 1/2005 Beal
6,845,716 B2 1/2005 Husseini et al.
7,000,547 B2 2/2006 Amick
7,014,284 B2 3/2006 Morton et al.
7,032,492 B2 4/2006 Meshirer
7,056,091 B2 6/2006 Powers
7,059,234 B2 * 6/2006 Husseini ..... F42B 5/02 86/55
7,165,496 B2 1/2007 Reynolds
D540,710 S 4/2007 Charrin
7,204,191 B2 4/2007 Wiley et al.
7,213,519 B2 * 5/2007 Wiley ..... B29C 65/02 102/464
7,231,519 B2 6/2007 Joseph et al.

(56) References Cited

U.S. PATENT DOCUMENTS 7,232,473 B2 6/2007 Elliott
7,299,750 B2 11/2007 Schikora et al.
7,353,756 B2 4/2008 Leasure
7,380,505 B1 6/2008 Shiery
7,383,776 B2 6/2008 Amick
7,392,746 B2 7/2008 Hansen
7,441,504 B2 10/2008 Husseini et al.
D583,927 S 12/2008 Benner
7,458,322 B2 12/2008 Reynolds et al.
7,461,597 B2 12/2008 Brunn
7,568,417 B1 8/2009 Lee
7,585,166 B2 9/2009 Buja
7,610,858 B2 * 11/2009 Chung ..... F42B 5/313 102/466
7,750,091 B2 7/2010 Maljkovic et al.
D626,619 S 11/2010 Gogol et al.
7,841,279 B2 11/2010 Reynolds et al.
D631,699 S 2/2011 Moreau
D633,166 S 2/2011 Richardson et al.
7,930,977 B2 4/2011 Klein
8,007,370 B2 8/2011 Hirsch et al.
8,056,232 B2 11/2011 Patel et al.
8,156,870 B2 4/2012 South
8,186,273 B2 5/2012 Trivette
8,201,867 B2 6/2012 Thomeczek
8,206,522 B2 6/2012 Sandstrom et al.
8,240,252 B2 8/2012 Maljkovic et al.
D675,882 S 2/2013 Crockett
8,393,273 B2 3/2013 Weeks et al.
8,408,137 B2 4/2013 Battaglia
D683,419 S 5/2013 Rebar
8,443,729 B2 5/2013 Mittelstaedt
8,443,730 B2 * 5/2013 Padgett ..... B29C 69/001 102/466
8,511,233 B2 8/2013 Nilsson
D689,975 S 9/2013 Carlson et al.
8,522,684 B2 9/2013 Davies et al.
8,540,828 B2 9/2013 Busky et al.
8,561,543 B2 10/2013 Burrow
8,573,126 B2 11/2013 Klein et al.
8,641,842 B2 2/2014 Hafner et al.
8,689,696 B1 4/2014 Seeman et al.
8,763,535 B2 7/2014 Padgett
8,790,455 B2 7/2014 Borissov et al.
8,807,008 B2 8/2014 Padgett et al.
8,813,650 B2 8/2014 Maljkovic et al.
D715,888 S 10/2014 Padgett
8,850,985 B2 10/2014 Maljkovic et al.
8,857,343 B2 10/2014 Marx
8,869,702 B2 10/2014 Padgett
D717,909 S 11/2014 Thrift et al.
8,875,633 B2 11/2014 Padgett
8,893,621 B1 11/2014 Escobar
8,978,559 B2 3/2015 Davies et al.
9,003,973 B1 4/2015 Padgett
9,032,855 B1 5/2015 Foren et al.
9,091,516 B2 7/2015 Davies et al.
9,103,641 B2 8/2015 Nielson et al.
9,157,709 B2 10/2015 Nuetzman et al.
9,170,080 B2 10/2015 Poore et al.
9,182,204 B2 11/2015 Maljkovic et al.
9,188,412 B2 11/2015 Maljkovic et al.
9,200,157 B2 12/2015 El-Hibri et al.
9,200,880 B1 12/2015 Foren et al.
9,212,876 B1 12/2015 Kostka et al.
9,212,879 B2 12/2015 Whitworth
9,213,175 B2 12/2015 Arnold
9,254,503 B2 2/2016 Ward
9,255,775 B1 2/2016 Rubin
D752,397 S 3/2016 Seiders et al.
D754,223 S 4/2016 Pederson et al.
9,329,004 B2 5/2016 Pace
9,335,137 B2 5/2016 Maljkovic et al.
9,337,278 B1 5/2016 Gu et al.
9,347,457 B2 5/2016 Ahrens et al.
9,366,512 B2 6/2016 Burczynski et al.
9,377,278 B2 6/2016 Rubin
9,389,052 B2 7/2016 Conroy et al.
9,395,165 B2 7/2016 Maljkovic et al.
D764,624 S 8/2016 Masinelli
D765,214 S 8/2016 Padgett
9,429,407 B2 8/2016 Burrow
9,441,930 B2 9/2016 Burrow
9,453,714 B2 9/2016 Bosarge et al.
D773,009 S 11/2016 Bowers
9,500,453 B2 11/2016 Schluckebier et al.
9,506,735 B1 * 11/2016 Burrow ..... F42C 19/083
D774,824 S 12/2016 Gallagher
9,513,096 B2 12/2016 Burrow
9,518,810 B1 * 12/2016 Burrow ..... F42C 19/083
9,523,563 B1 * 12/2016 Burrow ..... F42C 19/083
9,528,799 B2 12/2016 Maljkovic
9,546,849 B2 1/2017 Burrow
9,551,557 B1 * 1/2017 Burrow ..... F42B 5/307
D778,391 S 2/2017 Burrow
D778,393 S 2/2017 Burrow
D778,394 S 2/2017 Burrow
D778,395 S 2/2017 Burrow
D779,021 S 2/2017 Burrow
D779,024 S 2/2017 Burrow
D780,283 S 2/2017 Burrow
9,587,918 B1 3/2017 Burrow
9,599,443 B2 3/2017 Padgett et al.
9,625,241 B2 * 4/2017 Neugebauer ..... F42B 5/285
9,631,907 B2 4/2017 Burrow
9,644,930 B1 5/2017 Burrow
9,658,042 B2 5/2017 Emary
9,683,818 B2 6/2017 Lemke et al.
D792,200 S 7/2017 Baiz et al.
9,709,368 B2 7/2017 Mahnke
D797,880 S 9/2017 Seecamp
9,759,554 B2 9/2017 Ng et al.
D800,244 S 10/2017 Burczynski et al.
D800,245 S 10/2017 Burczynski et al.
D800,246 S 10/2017 Burczynski et al.
9,784,667 B2 10/2017 Lukay et al.
9,835,423 B2 12/2017 Burrow
9,835,427 B2 12/2017 Burrow
9,857,151 B2 1/2018 Dionne et al.
9,869,536 B2 1/2018 Burrow
9,879,954 B2 1/2018 Hajjar
9,885,551 B2 2/2018 Burrow
D813,975 S 3/2018 White
9,921,040 B2 3/2018 Rubin
9,927,219 B2 3/2018 Burrow
9,933,241 B2 4/2018 Burrow
9,939,236 B2 4/2018 Drobockyi et al.
9,964,388 B1 5/2018 Burrow
D821,536 S 6/2018 Christiansen et al.
9,989,339 B2 6/2018 Riess
10,041,770 B2 8/2018 Burrow
10,041,771 B1 8/2018 Burrow
10,041,776 B1 8/2018 Burrow
10,041,777 B1 8/2018 Burrow
10,048,049 B2 8/2018 Burrow
10,048,050 B1 8/2018 Burrow
10,048,052 B2 8/2018 Burrow
10,054,413 B1 8/2018 Burrow
D828,483 S 9/2018 Burrow
10,081,057 B2 9/2018 Burrow
D832,037 S 10/2018 Gallagher
10,101,140 B2 10/2018 Burrow
10,124,343 B2 11/2018 Tsai
10,145,662 B2 12/2018 Burrow
10,190,857 B2 1/2019 Burrow
10,234,249 B2 3/2019 Burrow
10,234,253 B2 3/2019 Burrow
10,240,905 B2 3/2019 Burrow
10,254,096 B2 4/2019 Burrow
10,260,847 B2 4/2019 Viggiano et al.
D849,181 S 5/2019 Burrow
10,302,403 B2 5/2019 Burrow
10,302,404 B2 5/2019 Burrow
10,323,918 B2 6/2019 Menefee, III

(56) References Cited

U.S. PATENT DOCUMENTS

| | | | |
|---|---|---|---|
| 10,330,451 | B2 | 6/2019 | Burrow |
| 10,345,088 | B2 | 7/2019 | Burrow |
| 10,352,664 | B2 | 7/2019 | Burrow |
| 10,352,670 | B2 | 7/2019 | Burrow |
| 10,359,262 | B2 | 7/2019 | Burrow |
| 10,365,074 | B2 | 7/2019 | Burrow |
| D861,118 | S | 9/2019 | Burrow |
| D861,119 | S | 9/2019 | Burrow |
| 10,408,582 | B2 | 9/2019 | Burrow |
| 10,408,592 | B2 | 9/2019 | Boss et al. |
| 10,415,943 | B2 | 9/2019 | Burrow |
| 10,429,156 | B2 | 10/2019 | Burrow |
| 10,458,762 | B2 | 10/2019 | Burrow |
| 10,466,020 | B2 | 11/2019 | Burrow |
| 10,466,021 | B2 | 11/2019 | Burrow |
| 10,480,911 | B2 | 11/2019 | Burrow |
| 10,480,912 | B2 | 11/2019 | Burrow |
| 10,480,915 | B2 | 11/2019 | Burrow et al. |
| 10,488,165 | B2 | 11/2019 | Burrow |
| 10,533,830 | B2 | 1/2020 | Burrow et al. |
| 10,571,162 | B2 | 2/2020 | Makansi et al. |
| 10,571,228 | B2 | 2/2020 | Burrow |
| 10,571,229 | B2 | 2/2020 | Burrow |
| 10,571,230 | B2 | 2/2020 | Burrow |
| 10,571,231 | B2 | 2/2020 | Burrow |
| 10,578,409 | B2 | 3/2020 | Burrow |
| 10,591,260 | B2 | 3/2020 | Burrow et al. |
| D882,019 | S | 4/2020 | Burrow et al. |
| D882,020 | S | 4/2020 | Burrow et al. |
| D882,021 | S | 4/2020 | Burrow et al. |
| D882,022 | S | 4/2020 | Burrow et al. |
| D882,023 | S | 4/2020 | Burrow et al. |
| D882,024 | S | 4/2020 | Burrow et al. |
| D882,025 | S | 4/2020 | Burrow et al. |
| D882,026 | S | 4/2020 | Burrow et al. |
| D882,027 | S | 4/2020 | Burrow et al. |
| D882,028 | S | 4/2020 | Burrow et al. |
| D882,029 | S | 4/2020 | Burrow et al. |
| D882,030 | S | 4/2020 | Burrow et al. |
| D882,031 | S | 4/2020 | Burrow et al. |
| D882,032 | S | 4/2020 | Burrow et al. |
| D882,033 | S | 4/2020 | Burrow et al. |
| D882,720 | S | 4/2020 | Burrow et al. |
| D882,721 | S | 4/2020 | Burrow et al. |
| D882,722 | S | 4/2020 | Burrow et al. |
| D882,723 | S | 4/2020 | Burrow et al. |
| D882,724 | S | 4/2020 | Burrow et al. |
| 10,612,896 | B2 | 4/2020 | Burrow |
| 10,612,897 | B2 | 4/2020 | Burrow et al. |
| D884,115 | S | 5/2020 | Burrow et al. |
| D886,231 | S | 6/2020 | Burrow et al. |
| D886,937 | S | 6/2020 | Burrow et al. |
| 10,677,573 | B2 | 6/2020 | Burrow et al. |
| D891,567 | S | 7/2020 | Burrow et al. |
| D891,568 | S | 7/2020 | Burrow et al. |
| D891,569 | S | 7/2020 | Burrow et al. |
| D891,570 | S | 7/2020 | Burrow et al. |
| 10,704,869 | B2 | 7/2020 | Burrow et al. |
| 10,704,870 | B2 | 7/2020 | Burrow et al. |
| 10,704,871 | B2 | 7/2020 | Burrow et al. |
| 10,704,872 | B1 | 7/2020 | Burrow et al. |
| 10,704,876 | B2 | 7/2020 | Boss et al. |
| 10,704,877 | B2 | 7/2020 | Boss et al. |
| 10,704,878 | B2 | 7/2020 | Boss et al. |
| 10,704,879 | B1 | 7/2020 | Burrow et al. |
| 10,704,880 | B1 | 7/2020 | Burrow et al. |
| D892,258 | S | 8/2020 | Burrow et al. |
| D893,665 | S | 8/2020 | Burrow et al. |
| D893,666 | S | 8/2020 | Burrow et al. |
| D893,667 | S | 8/2020 | Burrow et al. |
| D893,668 | S | 8/2020 | Burrow et al. |
| D894,320 | S | 8/2020 | Burrow et al. |
| 10,731,956 | B2 | 8/2020 | Burrow et al. |
| 10,731,957 | B1 | 8/2020 | Burrow et al. |
| 10,753,713 | B2 | 8/2020 | Burrow |
| 10,760,882 | B1 | 9/2020 | Burrow |
| 10,782,107 | B1 | 9/2020 | Dindl |
| 10,794,671 | B2 | 10/2020 | Padgett et al. |
| 10,809,043 | B2 | 10/2020 | Padgett et al. |
| D903,038 | S | 11/2020 | Burrow et al. |
| D903,039 | S | 11/2020 | Burrow et al. |
| 10,845,169 | B2 | 11/2020 | Burrow |
| 10,852,108 | B2 | 12/2020 | Burrow et al. |
| 10,859,352 | B2 | 12/2020 | Burrow |
| 10,871,361 | B2 | 12/2020 | Skowron et al. |
| 10,876,822 | B2 | 12/2020 | Burrow et al. |
| 10,900,760 | B2 | 1/2021 | Burrow |
| 10,907,944 | B2 | 2/2021 | Burrow |
| 10,914,558 | B2 | 2/2021 | Burrow |
| 10,921,100 | B2 | 2/2021 | Burrow et al. |
| 10,921,101 | B2 | 2/2021 | Burrow et al. |
| 10,921,106 | B2 | 2/2021 | Burrow et al. |
| D913,403 | S | 3/2021 | Burrow et al. |
| 10,948,272 | B1 | 3/2021 | Drobockyi et al. |
| 10,948,273 | B2 | 3/2021 | Burrow et al. |
| 10,948,275 | B2 | 3/2021 | Burrow |
| 10,962,338 | B2 | 3/2021 | Burrow |
| 10,976,144 | B1 | 4/2021 | Peterson et al. |
| 10,996,029 | B2 | 5/2021 | Burrow |
| 10,996,030 | B2 | 5/2021 | Burrow |
| 11,047,654 | B1 | 6/2021 | Burrow |
| 11,047,655 | B2 | 6/2021 | Burrow et al. |
| 11,047,661 | B2 | 6/2021 | Burrow |
| 11,047,662 | B2 | 6/2021 | Burrow |
| 11,047,663 | B1 | 6/2021 | Burrow |
| 11,047,664 | B2 | 6/2021 | Burrow |
| 11,079,205 | B2 | 8/2021 | Burrow et al. |
| 11,079,209 | B2 | 8/2021 | Burrow |
| 11,085,739 | B2 | 8/2021 | Burrow |
| 11,085,740 | B2 | 8/2021 | Burrow |
| 11,085,741 | B2 | 8/2021 | Burrow |
| 11,085,742 | B2 | 8/2021 | Burrow |
| 11,092,413 | B2 | 8/2021 | Burrow |
| 11,098,990 | B2 | 8/2021 | Burrow |
| 11,098,991 | B2 | 8/2021 | Burrow |
| 11,098,992 | B2 | 8/2021 | Burrow |
| 11,098,993 | B2 | 8/2021 | Burrow |
| 11,125,540 | B2 | 9/2021 | Pennell et al. |
| 11,199,384 | B2 | 12/2021 | Koh et al. |
| 11,209,251 | B2 | 12/2021 | Burrow et al. |
| 11,209,252 | B2 | 12/2021 | Burow |
| 11,209,256 | B2 | 12/2021 | Burrow et al. |
| 11,215,430 | B2 | 1/2022 | Boss et al. |
| 11,226,179 | B2 | 1/2022 | Burrow |
| 11,231,257 | B2 | 1/2022 | Burrow |
| 11,231,258 | B2 | 1/2022 | Burrow |
| 11,243,059 | B2 | 2/2022 | Burrow |
| 11,243,060 | B2 | 2/2022 | Burrow |
| 11,248,885 | B2 | 2/2022 | Burrow |
| 11,248,886 | B2 | 2/2022 | Burrow et al. |
| 11,255,647 | B2 | 2/2022 | Burrow |
| 11,255,649 | B2 | 2/2022 | Burrow |
| 2003/0127011 | A1 | 7/2003 | Mackerell et al. |
| 2004/0074412 | A1 | 4/2004 | Kightlinger |
| 2004/0200340 | A1 | 10/2004 | Robinson et al. |
| 2005/0056183 | A1 | 3/2005 | Meshirer |
| 2005/0081704 | A1 | 4/2005 | Husseini |
| 2005/0257712 | A1 | 11/2005 | Husseini et al. |
| 2006/0027125 | A1 | 2/2006 | Brunn |
| 2006/0278116 | A1 | 12/2006 | Hunt |
| 2006/0283345 | A1 | 12/2006 | Feldman et al. |
| 2007/0056343 | A1 | 3/2007 | Cremonesi |
| 2007/0181029 | A1 | 8/2007 | Mcaninch |
| 2007/0214992 | A1 | 9/2007 | Dittrich |
| 2007/0214993 | A1 | 9/2007 | Cerovic et al. |
| 2007/0267587 | A1 | 11/2007 | Dalluge |
| 2010/0101444 | A1 | 4/2010 | Schluckebier et al. |
| 2010/0212533 | A1 | 8/2010 | Brunn |
| 2010/0234132 | A1 | 9/2010 | Hirsch et al. |
| 2010/0258023 | A1 | 10/2010 | Reynolds et al. |
| 2010/0282112 | A1 | 11/2010 | Battaglia |
| 2011/0179965 | A1 | 7/2011 | Mason |
| 2012/0024183 | A1 | 2/2012 | Klein |
| 2012/0060716 | A1 | 3/2012 | Davies et al. |

(56) References Cited

U.S. PATENT DOCUMENTS

2012/0111219 A1 5/2012 Burrow
2012/0180685 A1 7/2012 Se-Hong
2012/0180687 A1 7/2012 Padgett et al.
2012/0291655 A1 11/2012 Jones
2013/0008335 A1 1/2013 Menefee, I
2013/0014664 A1 1/2013 Padgett
2013/0076865 A1 3/2013 Tateno et al.
2013/0186294 A1 7/2013 Davies et al.
2013/0291711 A1 11/2013 Mason
2014/0075805 A1 3/2014 LaRue
2014/0224144 A1 8/2014 Neugebauer
2014/0260925 A1 9/2014 Beach et al.
2014/0261044 A1 9/2014 Seecamp
2014/0311332 A1 10/2014 Carlson et al.
2015/0075400 A1 3/2015 Lemke et al.
2015/0226220 A1 8/2015 Bevington
2015/0268020 A1 9/2015 Emary
2016/0003585 A1 1/2016 Carpenter et al.
2016/0003589 A1 1/2016 Burrow
2016/0003590 A1 1/2016 Burrow
2016/0003593 A1 1/2016 Burrow
2016/0003594 A1 1/2016 Burrow
2016/0003595 A1 1/2016 Burrow
2016/0003596 A1 1/2016 Burrow
2016/0003597 A1 1/2016 Burrow
2016/0003601 A1 1/2016 Burrow
2016/0033241 A1 2/2016 Burrow
2016/0102030 A1 4/2016 Coffey et al.
2016/0146585 A1 5/2016 Padgett
2016/0245626 A1* 8/2016 Drieling ..... F42B 7/02
2016/0265886 A1 9/2016 Aldrich et al.
2016/0349022 A1 12/2016 Burrow
2016/0349023 A1 12/2016 Burrow
2016/0349028 A1 12/2016 Burrow
2016/0356588 A1 12/2016 Burrow
2016/0377399 A1 12/2016 Burrow
2017/0030690 A1 2/2017 Viggiano et al.
2017/0030692 A1 2/2017 Drobockyi et al.
2017/0080498 A1 3/2017 Burrow
2017/0082409 A1 3/2017 Burrow
2017/0082411 A1 3/2017 Burrow
2017/0089673 A1 3/2017 Burrow
2017/0089674 A1 3/2017 Burrow
2017/0089675 A1 3/2017 Burrow
2017/0089679 A1 3/2017 Burrow
2017/0115105 A1 4/2017 Burrow
2017/0153093 A9 6/2017 Burrow
2017/0153099 A9 6/2017 Burrow
2017/0191812 A1 7/2017 Padgett et al.
2017/0199018 A9 7/2017 Burrow
2017/0205217 A9 7/2017 Burrow
2017/0261296 A1 9/2017 Burrow
2017/0299352 A9 10/2017 Burrow
2017/0328689 A1 11/2017 Dindl
2018/0066925 A1 3/2018 Skowron et al.
2018/0106581 A1 4/2018 Rogers
2018/0224252 A1 8/2018 O'Rourke
2018/0224253 A1 8/2018 Burrow
2018/0224256 A1 8/2018 Burrow
2018/0259310 A1 9/2018 Burrow
2018/0292186 A1 10/2018 Padgett et al.
2018/0306558 A1 10/2018 Padgett et al.
2019/0011233 A1 1/2019 Boss et al.
2019/0011234 A1 1/2019 Boss et al.
2019/0011235 A1 1/2019 Boss et al.
2019/0011236 A1 1/2019 Burrow
2019/0011237 A1 1/2019 Burrow
2019/0011238 A1 1/2019 Burrow
2019/0011239 A1 1/2019 Burrow
2019/0011240 A1 1/2019 Burrow
2019/0011241 A1 1/2019 Burrow
2019/0025019 A1 1/2019 Burrow
2019/0025020 A1 1/2019 Burrow
2019/0025021 A1 1/2019 Burrow
2019/0025022 A1 1/2019 Burrow
2019/0025023 A1 1/2019 Burrow
2019/0025024 A1 1/2019 Burrow
2019/0025025 A1 1/2019 Burrow
2019/0025026 A1 1/2019 Burrow
2019/0025035 A1 1/2019 Burrow
2019/0025036 A1 1/2019 Burrow
2019/0078862 A1 3/2019 Burrow
2019/0106364 A1 4/2019 James
2019/0107375 A1 4/2019 Burrow
2019/0137228 A1 5/2019 Burrow et al.
2019/0137229 A1 5/2019 Burrow et al.
2019/0137230 A1 5/2019 Burrow et al.
2019/0137231 A1 5/2019 Burrow et al.
2019/0137232 A1 5/2019 Burrow et al.
2019/0137233 A1 5/2019 Burrow et al.
2019/0137234 A1 5/2019 Burrow et al.
2019/0137235 A1 5/2019 Burrow et al.
2019/0137236 A1 5/2019 Burrow et al.
2019/0137237 A1 5/2019 Burrow et al.
2019/0137238 A1 5/2019 Burrow et al.
2019/0137239 A1 5/2019 Burrow et al.
2019/0137240 A1 5/2019 Burrow et al.
2019/0137241 A1 5/2019 Burrow et al.
2019/0137242 A1 5/2019 Burrow et al.
2019/0137243 A1 5/2019 Burrow et al.
2019/0137244 A1 5/2019 Burrow et al.
2019/0170488 A1 6/2019 Burrow
2019/0204050 A1 7/2019 Burrow
2019/0204056 A1 7/2019 Burrow
2019/0212117 A1 7/2019 Burrow
2019/0242679 A1 8/2019 Viggiano et al.
2019/0242682 A1 8/2019 Burrow
2019/0242683 A1 8/2019 Burrow
2019/0249967 A1 8/2019 Burrow et al.
2019/0257625 A1 8/2019 Burrow
2019/0285391 A1 9/2019 Menefee, III
2019/0310058 A1 10/2019 Burrow
2019/0310059 A1 10/2019 Burrow
2019/0316886 A1 10/2019 Burrow
2019/0360788 A1 11/2019 Burrow
2019/0376773 A1 12/2019 Burrow
2019/0376774 A1 12/2019 Boss et al.
2019/0383590 A1 12/2019 Burrow
2019/0390929 A1 12/2019 Libotte
2020/0011645 A1 1/2020 Burrow et al.
2020/0011646 A1 1/2020 Burrow et al.
2020/0025536 A1 1/2020 Burrow et al.
2020/0025537 A1 1/2020 Burrow et al.
2020/0033102 A1 1/2020 Burrow
2020/0033103 A1 1/2020 Burrow et al.
2020/0041239 A1 2/2020 Burrow
2020/0049469 A1 2/2020 Burrow
2020/0049470 A1 2/2020 Burrow
2020/0049471 A1 2/2020 Burrow
2020/0049472 A1 2/2020 Burrow
2020/0049473 A1 2/2020 Burrow
2020/0056872 A1 2/2020 Burrow
2020/0109932 A1 4/2020 Burrow
2020/0149853 A1 5/2020 Burrow
2020/0158483 A1 5/2020 Burrow
2020/0200512 A1 6/2020 Burrow
2020/0200513 A1 6/2020 Burrow
2020/0208948 A1 7/2020 Burrow
2020/0208949 A1 7/2020 Burrow
2020/0208950 A1 7/2020 Burrow
2020/0225009 A1 7/2020 Burrow
2020/0248998 A1 8/2020 Burrow
2020/0248999 A1 8/2020 Burrow
2020/0249000 A1 8/2020 Burrow
2020/0256654 A1 8/2020 Burrow
2020/0263962 A1 8/2020 Burrow et al.
2020/0263967 A1 8/2020 Burrow et al.
2020/0278183 A1 9/2020 Burrow et al.
2020/0292283 A1 9/2020 Burrow
2020/0300587 A1 9/2020 Burrow et al.
2020/0300592 A1 9/2020 Overton
2020/0309490 A1 10/2020 Burrow et al.
2020/0309496 A1 10/2020 Burrow et al.
2020/0318937 A1 10/2020 Skowron et al.

(56) References Cited

U.S. PATENT DOCUMENTS

| | | | |
|---|---|---|---|
| 2020/0326168 | A1 | 10/2020 | Boss et al. |
| 2020/0363172 | A1 | 11/2020 | Koh et al. |
| 2020/0363173 | A1 | 11/2020 | Burrow |
| 2020/0363179 | A1 | 11/2020 | Overton et al. |
| 2020/0378734 | A1 | 12/2020 | Burrow |
| 2020/0393220 | A1 | 12/2020 | Burrow |
| 2020/0400411 | A9 | 12/2020 | Burrow |
| 2021/0003373 | A1 | 1/2021 | Burrow |
| 2021/0041211 | A1 | 2/2021 | Pennell et al. |
| 2021/0041212 | A1 | 2/2021 | Burrow et al. |
| 2021/0041213 | A1 | 2/2021 | Padgett |
| 2021/0072006 | A1 | 3/2021 | Padgett et al. |
| 2021/0080236 | A1 | 3/2021 | Burrow |
| 2021/0080237 | A1 | 3/2021 | Burrow et al. |
| 2021/0108898 | A1 | 4/2021 | Overton et al. |
| 2021/0108899 | A1 | 4/2021 | Burrow et al. |
| 2021/0123709 | A1 | 4/2021 | Burrow et al. |
| 2021/0131772 | A1 | 5/2021 | Burrow |
| 2021/0131773 | A1 | 5/2021 | Burrow |
| 2021/0131774 | A1 | 5/2021 | Burrow |
| 2021/0140749 | A1 | 5/2021 | Burrow |
| 2021/0148681 | A1 | 5/2021 | Burrow |
| 2021/0148682 | A1 | 5/2021 | Burrow |
| 2021/0148683 | A1 | 5/2021 | Burrow et al. |
| 2021/0156653 | A1 | 5/2021 | Burrow et al. |
| 2021/0164762 | A1 | 6/2021 | Burrow et al. |
| 2021/0223017 | A1 | 7/2021 | Peterson et al. |
| 2021/0254939 | A1 | 8/2021 | Burrow |
| 2021/0254940 | A1 | 8/2021 | Burrow |
| 2021/0254941 | A1 | 8/2021 | Burrow |
| 2021/0254942 | A1 | 8/2021 | Burrow |
| 2021/0254943 | A1 | 8/2021 | Burrow |
| 2021/0254944 | A1 | 8/2021 | Burrow |
| 2021/0254945 | A1 | 8/2021 | Burrow |
| 2021/0254946 | A1 | 8/2021 | Burrow |
| 2021/0254947 | A1 | 8/2021 | Burrow |
| 2021/0254948 | A1 | 8/2021 | Burrow |
| 2021/0254949 | A1 | 8/2021 | Burrow |
| 2021/0301134 | A1 | 9/2021 | Yu et al. |
| 2021/0302136 | A1 | 9/2021 | Burrow |
| 2021/0302137 | A1 | 9/2021 | Burrow |
| 2021/0325156 | A1 | 10/2021 | Burrow |
| 2021/0325157 | A1 | 10/2021 | Burrow |
| 2021/0333073 | A1 | 10/2021 | Burrow et al. |
| 2021/0333075 | A1 | 10/2021 | Burrow |
| 2021/0341266 | A1 | 11/2021 | Burrow |
| 2021/0341267 | A1 | 11/2021 | Burrow |
| 2021/0341268 | A1 | 11/2021 | Burrow |
| 2021/0341269 | A1 | 11/2021 | Burrow |
| 2021/0341270 | A1 | 11/2021 | Burrow |
| 2021/0341271 | A1 | 11/2021 | Burrow |
| 2021/0341272 | A1 | 11/2021 | Burrow |
| 2021/0341273 | A1 | 11/2021 | Burrow |
| 2021/0348892 | A1 | 11/2021 | Burrow |
| 2021/0348893 | A1 | 11/2021 | Burrow |
| 2021/0348894 | A1 | 11/2021 | Burrow |
| 2021/0348895 | A1 | 11/2021 | Burrow |
| 2021/0348902 | A1 | 11/2021 | Burrow |
| 2021/0348903 | A1 | 11/2021 | Burrow |
| 2021/0348904 | A1 | 11/2021 | Burrow |
| 2021/0364257 | A1 | 11/2021 | Burrow et al. |
| 2021/0364258 | A1 | 11/2021 | Burrow et al. |
| 2021/0372747 | A1 | 12/2021 | Burrow |
| 2021/0372748 | A1 | 12/2021 | Burrow et al. |
| 2021/0372749 | A1 | 12/2021 | Burrow et al. |
| 2021/0372750 | A1 | 12/2021 | Burrow et al. |
| 2021/0372751 | A1 | 12/2021 | Burrow et al. |
| 2021/0372754 | A1 | 12/2021 | Burrow |
| 2021/0381813 | A1 | 12/2021 | Burrow |
| 2021/0389106 | A1 | 12/2021 | Burrow |
| 2022/0011083 | A1 | 1/2022 | Burrow |
| 2022/0018639 | A1 | 1/2022 | Burrow |
| 2022/0018640 | A1 | 1/2022 | Burrow et al. |
| 2022/0018641 | A1 | 1/2022 | Burrow |
| 2022/0034639 | A1 | 2/2022 | Burrow |
| 2022/0049938 | A1 | 2/2022 | Burrow et al. |
| 2022/0065594 | A1 | 3/2022 | Burrow |
| 2022/0074721 | A1 | 3/2022 | Burrow |
| 2022/0074724 | A1 | 3/2022 | Burrow et al. |
| 2022/0082359 | A1 | 3/2022 | Boss et al. |
| 2022/0082360 | A1 | 3/2022 | Burrow |

FOREIGN PATENT DOCUMENTS

| | | | |
|---|---|---|---|
| DE | 16742 | C | 1/1882 |
| FR | 1412414 | A | 10/1965 |
| GB | 574877 | A | 1/1946 |
| GB | 783023 | A | 9/1957 |
| RU | 2172467 | C1 | 8/2001 |
| WO | 0034732 | | 6/2000 |
| WO | 2007014024 | A2 | 2/2007 |
| WO | 2012047615 | A1 | 4/2012 |
| WO | 2012097320 | A1 | 7/2012 |
| WO | 2012097317 | A3 | 11/2012 |
| WO | 2013070250 | A1 | 5/2013 |
| WO | 2013096848 | A1 | 6/2013 |
| WO | 2014062256 | A2 | 4/2014 |
| WO | 2016003817 | A1 | 1/2016 |
| WO | 2019094544 | A1 | 5/2019 |
| WO | 2021040903 | A2 | 3/2021 |
| WO | 2022015565 | A1 | 1/2022 |

OTHER PUBLICATIONS

International Search Report and Written Opinion in PCT/US2019/040329 dated Sep. 27, 2019, pp. 1-24.

AccurateShooter.com Daily Bulletin "New PolyCase Ammunition and Injection-Molded Bullets" Jan. 11, 2015.

International Search Report and Written Opinion for PCTUS201859748 dated Mar. 1, 2019, pp. 1-9.

International Search Report and Written Opinion for PCTUS2019017085 dated Apr. 19, 2019, pp. 1-9.

Korean Intellectual Property Office (ISA), International Search Report and Written Opinion for PCT/US2011/062781 dated Nov. 30, 2012, 16 pp.

Korean Intellectual Property Office (ISA), International Search Report and Written Opinion for PCT/US2015/038061 dated Sep. 21, 2015, 28 pages.

International Preliminary Report on Patentability and Written Opinion in PCT/US2018/059748 dated May 12, 2020; pp. 1-8.

IPRP in PCT2019017085 dated Aug. 27, 2020, pp. 1-8.

EESR dated Jul. 29, 2021, pp. 1-9.

EESR dated Jul. 8, 2021, pp. 1-9.

ISRWO in PCT/US2020/042258 dated Feb. 19, 2021, pp. 1-12.

International Search Report and Written Opinion in PCT/US2020/023273 dated Oct. 7, 2020; pp. 1-11.

EESR dated Feb. 4, 2022, pp. 1-7.

International Preliminary Report on Patentability and Written Opinion dated Jan. 27, 2022, pp. 1-9.

* cited by examiner

MULTI-PIECE PRIMER INSERT FOR POLYMER AMMUNITION

CROSS-REFERENCE TO RELATED APPLICATIONS

This application claims the benefit of U.S. Patent Application No. 62/694,868, filed Jul. 6, 2018 the contents of which is incorporated by reference.

TECHNICAL FIELD OF THE INVENTION

The present invention relates in general to the field of ammunition, specifically to compositions and methods of making primer inserts made by joining two or more primer insert portions to form a primer insert for polymer ammunition.

STATEMENT OF FEDERALLY FUNDED RESEARCH

Not Applicable.

INCORPORATION-BY-REFERENCE OF MATERIALS FILED ON COMPACT DISC

Not Applicable.

BACKGROUND OF THE INVENTION

Without limiting the scope of the invention, its background is described in connection with lightweight polymer cartridge casing ammunition. Conventional ammunition cartridge casings for rifles and machine guns, as well as larger caliber weapons, are made from brass, which is heavy, expensive, and potentially hazardous. There exists a need for lighter weight ammunition and cartridge replacement for brass ammunition to increase mission performance and operational capabilities. Lightweight polymer cartridge casing ammunition must meet the reliability and performance standards of existing fielded ammunition and be interchangeable with brass cartridge casing ammunition in existing weaponry. Although, ammunition cartridges made partially of polymer has been known for many years, their safety, ballistic, handling characteristics, and survive physical and natural conditions to which they will be exposed during the ammunition's intended life cycle have all failed to meet the standards necessary.

For example, U.S. patent application Ser. No. 11/160,682 discloses a base for a cartridge casing body for an ammunition article, the base having an ignition device; an attachment device at one end thereof, the attachment device being adapted to the base to a cartridge casing body; wherein the base is made from plastic, ceramic, or a composite material.

U.S. Pat. No. 7,610,858 discloses an ammunition cartridge assembled from a substantially cylindrical polymeric cartridge casing body defining a casing headspace with an open projectile-end and an end opposing the projectile-end, wherein the casing body has a substantially cylindrical injection molded polymeric bullet-end component with opposing first and second ends, the first end of which is the projectile-end of the casing body and the second end has a male or female coupling element; and a cylindrical polymeric middle body component with opposing first and second ends, wherein the first end has a coupling element that is a mate for the projectile-end coupling element and joins the first end of the middle body component to the second end of the bullet-end component, and the second end is the end of the casing body opposite the projectile end and has a male or female coupling element; and a cylindrical cartridge casing head-end component with an essentially closed base end with a primer hole opposite an open end with a coupling element that is a mate for the coupling element on the second end of the middle body and joins the second end of the middle body component to the open end of the head-end component; wherein the middle body component is formed from a material more ductile than the material head-end component is formed from but equal or less ductile than the material the bullet-end component is formed from. Methods for assembling ammunition cartridges and ammunition cartridges having the headspace length larger than the corresponding headspace length of the chamber of the intended weapon measured at the same basic diameter for the cartridge casing without being so large as to jam the weapon or otherwise interfere with its action are also disclosed.

Shortcomings of the known methods of producing plastic or substantially plastic ammunition include the possibility of the projectile being pushed into the cartridge casing, the bullet pull being too light such that the bullet can fall out, the bullet pull being too insufficient to create sufficient chamber pressure, the bullet pull not being uniform from round to round, and portions of the cartridge casing breaking off upon firing causing the weapon to jam or damage or danger when subsequent rounds are fired or when the casing portions themselves become projectiles. To overcome the above shortcomings, improvements in cartridge case design and performance polymer materials are needed.

BRIEF SUMMARY OF THE INVENTION

The present invention provided a two piece primer insert for ammunition comprising: a first primer insert portion 12 comprising: an cylindrical insert coupling element 18 having an insert tip 20 at one end opposite a cylindrical first primer insert portion joining region 24, and an insert transition 22 located between the insert tip 20 and the cylindrical first primer insert portion joining region 24; a second primer insert portion 14 comprising: an inner surface 28 connected to an extraction flange 44 by a cylindrical second primer insert portion joining region 40, a primer recess 32 located within the cylindrical second primer insert portion joining region 40, a primer flash aperture 30 through the inner surface 28 into the primer recess 32, and a flash aperture groove 38 around the primer flash aperture 30 in the primer recess 32; and an insert joint 16 located between the first primer insert portion 12 and the second primer insert portion 14, wherein the cylindrical first primer insert portion joining region 24 is adjacent to the cylindrical second primer insert portion joining region 40 to form a two piece primer insert.

The two piece primer insert, wherein the insert joint is threaded, riveted, locked, friction fitted, pressed, coined, snap fitted, chemical bonded, chemical welded, soldered, smelted, sintered, adhesive bonded, laser welded, ultrasonic welded, friction spot welded, friction stir welded or a combination thereof. The two piece primer insert, wherein the first primer insert portion 12, the second primer insert portion 14 or both are formed independently by metal injection molding, polymer injection molding, stamping, pressing, milling, molding, machining, punching, fine blanking, smelting, or any other method that will form insert portions that may be joined together to form a primer insert. The two piece primer, wherein the first primer insert portion 12, the second primer insert portion 14 or both independently comprises a polymer, a metal, an alloy, or a ceramic alloy. The two piece primer, wherein the first primer insert portion 12 and the second primer insert portion 14 comprise of the same material or different materials. The two piece primer, further comprising a support structure 90 positioned about the cylindrical insert coupling element 18. The two piece primer insert, wherein the support structure 90 is positioned about the insert transition 22. The two piece primer insert, wherein the support structure 90 extends at least partially into the insert joint 16. The two piece primer insert, wherein the support structure 90 is a mesh, a sheet or a weave. The two piece primer insert, further comprising one or more surface protrusions 100 positioned about the cylindrical insert coupling element 18.

The present invention provided a method of making a two piece primer insert for ammunition comprising the steps of: providing a first primer insert portion 12 comprising: an cylindrical insert coupling element 18 having an insert tip 20 at one end opposite a cylindrical first primer insert portion joining region 24, and an insert transition 22 located between the insert tip 20 and the cylindrical first primer insert portion joining region 24; providing a second primer insert portion 14 comprising: a inner surface 28 connected to an extraction flange 44 by a cylindrical second primer insert portion joining region 40, a primer recess 32 located within the cylindrical second primer insert portion joining region 40, a primer flash aperture 30 through the inner surface 28 into the primer recess 32, and a flash aperture groove 38 around the primer flash aperture 30 in the primer recess 32; inserting the cylindrical second primer insert portion joining region 40 into the cylindrical first primer insert portion joining region 24 to form an insert joint 16 located between the first primer insert portion 12 and the second primer insert portion 14 to form a two piece primer insert.

The method, wherein the insert joint is threaded, riveted, locked, friction fitted, pressed, coined, snap fitted, chemical bonded, chemical welded, soldered, smelted, sintered, adhesive bonded, laser welded, ultrasonic welded, friction spot welded, friction stir welded or a combination thereof. The method, wherein the first primer insert portion 12, the second primer insert portion 14 or both are formed independently by metal injection molding, polymer injection molding, stamping, pressing, milling, molding, machining, punching, fine blanking, smelting, or any other method that will form insert portions that may be joined together to form a primer insert. The method, wherein the first primer insert portion 12, the second primer insert portion 14 or both independently comprises a polymer, a metal, an alloy, or a ceramic alloy. The method, wherein the first primer insert portion 12 and the second primer insert portion 14 comprise of the same material or different materials. The method, further comprising the step of positioning a support structure 90 between the cylindrical second primer insert portion joining region 40 and the cylindrical first primer insert portion joining region 24 wherein the support structure 90 extends about the cylindrical insert coupling element 18. The method, wherein the support structure 90 is positioned about the insert transition 22. The method, wherein the support structure 90 extends at least partially into the insert joint 16. The method, wherein the support structure 90 is a mesh, a sheet or a weave. The method, further comprising the step of adding one or more surface protrusions 100 positioned about the cylindrical insert coupling element 18.

The present invention provided a polymer ammunition cartridge comprising: a two piece primer insert for ammunition comprising: a first primer insert portion 12 comprising: an cylindrical insert coupling element 18 having an insert tip 20 at one end opposite a cylindrical first primer insert portion joining region 24, and an insert transition 22 located between the insert tip 20 and the cylindrical first primer insert portion joining region 24; a second primer insert portion 14 comprising: a inner surface 28 connected to an extraction flange 44 by a cylindrical second primer insert portion joining region 40, a primer recess 32 located within the cylindrical second primer insert portion joining region 40, a primer flash aperture 30 through the inner surface 28 into the primer recess 32, and a flash aperture groove 38 around the primer flash aperture 30 in the primer recess 32; and an insert joint 16 located between the first primer insert portion 12 and the second primer insert portion 14, wherein the cylindrical first primer insert portion joining region 24 is adjacent to the cylindrical second primer insert portion joining region 40 to form a two piece primer insert; a substantially cylindrical polymeric middle body extending about the two piece primer insert, wherein the substantially cylindrical polymeric middle body comprises: a substantially cylindrical polymeric bullet-end coupling element at a first end of the substantially cylindrical polymeric middle body opposite a substantially cylindrical polymeric coupling end connected by a powder chamber, wherein the substantially cylindrical polymeric coupling end extends over the substantially cylindrical coupling element and covers an circumferential surface of the primer flash hole aperture; and a substantially cylindrical polymeric bullet-end upper portion comprising a bullet-end coupling element connected to the substantially cylindrical polymeric bullet-end coupling element opposite a projectile aperture adapted to engage a bullet.

The polymeric ammunition cartridge wherein the polymeric ammunition cartridge has a caliber selected from .223, .243, .25-06, .270, .300, .308, .338, .30-30, .30-06, .45-70 or .50-90, 50 caliber, 45 caliber, 380 caliber or 38 caliber, 5.56 mm, 6 mm, 7 mm, 7.62 mm, 8 mm, 9 mm, 10 mm, or 12.7 mm. The polymeric ammunition cartridge wherein the polymeric ammunition cartridge has a caliber selected from .308, .338, 50 caliber, 5.56 mm, 7.62 mm, or 12.7 mm. The polymeric ammunition cartridge wherein the substantially cylindrical polymeric middle body is formed from a ductile polymer, a nylon polymer or a fiber-reinforced polymeric composite. The polymeric ammunition cartridge wherein the substantially cylindrical polymeric bullet-end upper portion comprises a ductile polymer, a nylon polymer or a fiber-reinforced polymeric composite. The polymeric ammunition cartridge wherein the substantially cylindrical polymeric middle body comprise a polymers selected from the group consisting of polyurethane prepolymer, cellulose, fluoropolymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadinen-styrene, thermoplastic fluoro polymers, inomers, polyamides, polyamide-imides, polyacrylates, polyatherketones, polyaryl-sulfones, polybenzimidazoles, polycarbonates, polybutylene, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, urethane hybrids, polyphenylsulfones, copolymers of polyphenylsulfones with polyethersulfones or polysulfones, copolymers of poly-phenylsulfones with siloxanes, blends of polyphenylsulfones with polysiloxanes, poly(etherimide-siloxane) copolymers, blends of polyetherimides and polysiloxanes, and blends of polyetherimides and poly(etherimide-siloxane) copolymers. The polymeric ammunition cartridge wherein the substantially cylindrical polymeric bullet-end upper portion comprise a polymers selected from the group consisting of polyurethane prepolymer, cellulose, fluoro-polymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadinen-styrene, thermoplastic fluoro polymers, inomers, polyamides, polyamide-imides, polyacrylates, polyatherketones, polyaryl-sulfones, polybenzimidazoles, polycarbonates, polybutylene, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, urethane hybrids, polyphenylsulfones, copolymers of polyphenylsulfones with polyethersulfones or polysulfones, copolymers of poly-phenylsulfones with siloxanes, blends of polyphenylsulfones with polysiloxanes, poly(etherimide-siloxane) copolymers, blends of polyetherimides and polysiloxanes, and blends of polyetherimides and poly(etherimide-siloxane) copolymers. The polymeric ammunition cartridge wherein the substantially cylindrical polymeric bullet-end and the substantially cylindrical polymeric bullet-end upper portion are welded or bonded together. The polymeric ammunition cartridge wherein the substantially cylindrical polymeric bullet-end coupling element is welded or bonded to the substantially cylindrical polymeric bullet-end upper portion. The polymeric ammunition cartridge wherein the insert joint is threaded, riveted, locked, friction fitted, pressed, coined, snap fitted, chemical bonded, chemical welded, soldered, smelted, sintered, adhesive bonded, laser welded, ultrasonic welded, friction spot welded, friction stir welded or a combination thereof. The polymeric ammunition cartridge wherein the first primer insert portion 12, the second primer insert portion 14 or both are formed independently by metal injection molding, polymer injection molding, stamping, pressing, milling, molding, machining, punching, fine blanking, smelting, or any other method that will form insert portions that may be joined together to form a primer insert. The polymeric ammunition cartridge wherein the first primer insert portion 12, the second primer insert portion 14 or both independently comprises a polymer, a metal, an alloy, or a ceramic alloy. The polymeric ammunition cartridge wherein the first primer insert portion 12 and the second primer insert portion 14 comprise of the same material or different materials. The polymeric ammunition cartridge further comprising a support structure 90 positioned about the cylindrical insert coupling element 18. The polymeric ammunition cartridge wherein the support structure 90 is positioned about the insert transition 22. The polymeric ammunition cartridge wherein the support structure 90 extends at least partially into the insert joint 16. The polymeric ammunition cartridge wherein the support structure 90 is a mesh, a sheet or a weave. The polymeric ammunition cartridge further comprising one or more surface protrusions 100 positioned about the cylindrical insert coupling element 18.

The present invention provided a method of making a polymer ammunition cartridge comprising the steps of: providing a two piece primer insert for ammunition comprising: a first primer insert portion 12 comprising: an cylindrical insert coupling element 18 having an insert tip 20 at one end opposite a cylindrical first primer insert portion joining region 24, and an insert transition 22 located between the insert tip 20 and the cylindrical first primer insert portion joining region 24; a second primer insert portion 14 comprising: a inner surface 28 connected to an extraction flange 44 by a cylindrical second primer insert portion joining region 40, a primer recess 32 located within the cylindrical second primer insert portion joining region 40, a primer flash aperture 30 through the inner surface 28 into the primer recess 32, and a flash aperture groove 38 around the primer flash aperture 30 in the primer recess 32; and an insert joint 16 located between the first primer insert portion 12 and the second primer insert portion 14, wherein the cylindrical first primer insert portion joining region 24 is adjacent to the cylindrical second primer insert portion joining region 40 to form a two piece primer insert; overmolding a substantially cylindrical polymeric middle body by molding a polymer over the two piece primer insert, wherein the substantially cylindrical polymeric middle body comprises: a substantially cylindrical polymeric bullet-end coupling element at a first end of the substantially cylindrical polymeric middle body opposite a substantially cylindrical polymeric coupling end connected by a powder chamber, wherein the substantially cylindrical polymeric coupling end extends over the substantially cylindrical coupling element and covers an circumferential surface of the primer flash hole aperture; molding a substantially cylindrical polymeric bullet-end upper portion comprising a bullet-end coupling element connected to the substantially cylindrical polymeric bullet-end coupling element opposite a projectile aperture adapted to engage a bullet; and connecting the substantially cylindrical polymeric middle body and the substantially cylindrical polymeric bullet-end upper portion to form a polymer ammunition cartridge.

The method wherein the polymeric ammunition cartridge has a caliber selected from .223, .243, .25-06, .270, .300, .308, .338, .30-30, .30-06, 0.45-70 or .50-90, 50 caliber, 45 caliber, 380 caliber or 38 caliber, 5.56 mm, 6 mm, 7 mm, 7.62 mm, 8 mm, 9 mm, 10 mm, or 12.7 mm. The method wherein the polymeric ammunition cartridge has a caliber selected from .308, .338, 50 caliber, 5.56 mm, 7.62 mm, or 12.7 mm. The method wherein the substantially cylindrical polymeric middle body is formed from a ductile polymer, a nylon polymer or a fiber-reinforced polymeric composite. The method wherein the substantially cylindrical polymeric bullet-end upper portion comprises a ductile polymer, a nylon polymer or a fiber-reinforced polymeric composite. The method wherein the substantially cylindrical polymeric middle body comprise a polymers selected from the group consisting of polyurethane prepolymer, cellulose, fluoro-polymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadinen-styrene, thermoplastic fluoro polymers, inomers, polyamides, polyamide-imides, polyacrylates, polyatherketones, polyaryl-sulfones, polybenzimidazoles, polycarbonates, polybutylene, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, urethane hybrids, polyphenylsulfones, copolymers of polyphenylsulfones with polyethersulfones or polysulfones, copolymers of poly-phenylsulfones with siloxanes, blends of polyphenylsulfones with polysiloxanes, poly(etherimide-siloxane) copolymers, blends of polyetherimides and polysiloxanes, and blends of polyetherimides and poly(etherimide-siloxane) copolymers. The method wherein the substantially cylindrical polymeric bullet-end upper portion comprise a polymers selected from the group consisting of polyurethane prepolymer, cellulose, fluoro-polymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadinen-styrene, thermoplastic fluoro polymers, inomers, polyamides, polyamide-imides, polyacrylates, polyatherketones, polyaryl-sulfones, polybenzimidazoles, polycarbonates, polybutylene, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, urethane hybrids, polyphenylsulfones, copolymers of polyphenylsulfones with polyethersulfones or polysulfones, copolymers of poly-phenylsulfones with siloxanes, blends of polyphenylsulfones with polysiloxanes, poly(etherimide-siloxane) copolymers, blends of polyetherimides and polysiloxanes, and blends of polyetherimides and poly(etherimide-siloxane) copolymers. The method wherein the substantially cylindrical polymeric bullet-end and the substantially cylindrical polymeric bullet-end upper portion are welded or bonded together. The method wherein the substantially cylindrical polymeric bullet-end coupling element is welded or bonded to the substantially cylindrical polymeric bullet-end upper portion. The method wherein the insert joint is threaded, riveted, locked, friction fitted, pressed, coined, snap fitted, chemical bonded, chemical welded, soldered, smelted, sintered, adhesive bonded, laser welded, ultrasonic welded, friction spot welded, friction stir welded or a combination thereof. The method wherein the first primer insert portion 12, the second primer insert portion 14 or both are formed independently by metal injection molding, polymer injection molding, stamping, pressing, milling, molding, machining, punching, fine blanking, smelting, or any other method that will form insert portions that may be joined together to form a primer insert. The method wherein the first primer insert portion 12, the second primer insert portion 14 or both independently comprises a polymer, a metal, an alloy, or a ceramic alloy. The method wherein the first primer insert portion 12 and the second primer insert portion 14 comprise of the same material or different materials. The method further comprising a support structure 90 positioned about the cylindrical insert coupling element 18. The method wherein the support structure 90 is positioned about the insert transition 22. The method wherein the support structure 90 extends at least partially into the insert joint 16. The method wherein the support structure 90 is a mesh, a sheet or a weave. The method further comprising the step of adding one or more surface protrusions 100 positioned about the cylindrical insert coupling element 18.

The present invention provided a polymeric ammunition comprising: a two piece primer insert for ammunition comprising: a first primer insert portion 12 comprising: an cylindrical insert coupling element 18 having an insert tip 20 at one end opposite a cylindrical first primer insert portion joining region 24, and an insert transition 22 located between the insert tip 20 and the cylindrical first primer insert portion joining region 24; a second primer insert portion 14 comprising: a inner surface 28 connected to an extraction flange 44 by a cylindrical second primer insert portion joining region 40, a primer recess 32 located within the cylindrical second primer insert portion joining region 40, a primer flash aperture 30 through the inner surface 28 into the primer recess 32, and a flash aperture groove 38 around the primer flash aperture 30 in the primer recess 32; and an insert joint 16 located between the first primer insert portion 12 and the second primer insert portion 14, wherein the cylindrical first primer insert portion joining region 24 is adjacent to the cylindrical second primer insert portion joining region 40 to form a two piece primer insert; a substantially cylindrical polymeric middle body extending about the three piece primer insert, wherein the substantially cylindrical polymeric middle body comprises: a substantially cylindrical polymeric bullet-end coupling element at a first end of the substantially cylindrical polymeric middle body opposite a substantially cylindrical polymeric coupling end connected by a powder chamber, wherein the substantially cylindrical polymeric coupling end extends over the substantially cylindrical coupling element and covers an circumferential surface of the primer flash hole aperture; a substantially cylindrical polymeric bullet-end upper portion comprising a bullet-end coupling element connected to the substantially cylindrical polymeric bullet-end coupling element opposite a projectile aperture adapted to engage a bullet; a propellant at least partially filling the powder chamber; a primer inserted into the primer recess; and a bullet frictionally fitted in the bullet-end aperture.

The polymeric ammunition wherein the polymeric ammunition cartridge has a caliber selected from .223, .243, .25-06, .270, .300, .308, .338, .30-30, .30-06, .45-70 or .50-90, 50 caliber, 45 caliber, 380 caliber or 38 caliber, 5.56 mm, 6 mm, 7 mm, 7.62 mm, 8 mm, 9 mm, 10 mm, or 12.7 mm. The polymeric ammunition wherein the polymeric ammunition cartridge has a caliber selected from .308, .338, 50 caliber, 5.56 mm, 7.62 mm, or 12.7 mm. The polymeric ammunition wherein the substantially cylindrical polymeric middle body is formed from a ductile polymer, a nylon polymer or a fiber-reinforced polymeric composite. The polymeric ammunition wherein the substantially cylindrical polymeric bullet-end upper portion comprises a ductile polymer, a nylon polymer or a fiber-reinforced polymeric composite. The polymeric ammunition wherein the substantially cylindrical polymeric middle body comprise a polymers selected from the group consisting of polyurethane prepolymer, cellulose, fluoro-polymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadinen-styrene, thermoplastic fluoro polymers, inomers, polyamides, polyamide-imides, polyacrylates, polyatherketones, polyaryl-sulfones, polybenzimidazoles, polycarbonates, polybutylene, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, urethane hybrids, polyphenylsulfones, copolymers of polyphenylsulfones with polyethersulfones or polysulfones, copolymers of poly-phenylsulfones with siloxanes, blends of polyphenylsulfones with polysiloxanes, poly(etherimide-siloxane) copolymers, blends of polyetherimides and polysiloxanes, and blends of polyetherimides and poly(etherimide-siloxane) copolymers. The polymeric ammunition wherein the substantially cylindrical polymeric bullet-end upper portion comprise a polymers selected from the group consisting of polyurethane prepolymer, cellulose, fluoro-polymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadinen-styrene, thermoplastic fluoro polymers, inomers, polyamides, polyamide-imides, polyacrylates, polyatherketones, polyaryl-sulfones, polybenzimidazoles, polycarbonates, polybutylene, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, urethane hybrids, polyphenylsulfones, copolymers of polyphenylsulfones with polyethersulfones or polysulfones, copolymers of poly-phenylsulfones with siloxanes, blends of polyphenylsulfones with polysiloxanes, poly(etherimide-siloxane) copolymers, blends of polyetherimides and polysiloxanes, and blends of polyetherimides and poly(etherimide-siloxane) copolymers. The polymeric ammunition wherein the substantially cylindrical polymeric bullet-end and the substantially cylindrical polymeric bullet-end upper portion are welded or bonded together. The polymeric ammunition wherein the substantially cylindrical polymeric bullet-end coupling element is welded or bonded to the substantially cylindrical polymeric bullet-end upper portion. The polymeric ammunition wherein the insert joint is threaded, riveted, locked, friction fitted, pressed, coined, snap fitted, chemical bonded, chemical welded, soldered, smelted, sintered, adhesive bonded, laser welded, ultrasonic welded, friction spot welded, friction stir welded or a combination thereof. The polymeric ammunition wherein the first primer insert portion 12, the second primer insert portion 14 or both are formed independently by metal injection molding, polymer injection molding, stamping, pressing, milling, molding, machining, punching, fine blanking, smelting, or any other method that will form insert portions that may be joined together to form a primer insert. The polymeric ammunition wherein the first primer insert portion 12, the second primer insert portion 14 or both independently comprises a polymer, a metal, an alloy, or a ceramic alloy. The polymeric ammunition wherein the first primer insert portion 12 and the second primer insert portion 14 comprise of the same material or different materials. The polymeric ammunition further comprising a support structure 90 positioned about the cylindrical insert coupling element 18. The polymeric ammunition wherein the support structure 90 is positioned about the insert transition 22. The polymeric ammunition wherein the support structure 90 extends at least partially into the insert joint 16. The polymeric ammunition wherein the support structure 90 is a mesh, a sheet or a weave. The polymeric ammunition further comprising one or more surface protrusions 100 positioned about the cylindrical insert coupling element 18.

The present invention provided a method of making polymeric ammunition comprising the steps of: providing a two piece primer insert for ammunition comprising: a first primer insert portion 12 comprising: an cylindrical insert coupling element 18 having an insert tip 20 at one end opposite a cylindrical first primer insert portion joining region 24, and an insert transition 22 located between the insert tip 20 and the cylindrical first primer insert portion joining region 24; a second primer insert portion 14 comprising: a inner surface 28 connected to an extraction flange 44 by a cylindrical second primer insert portion joining region 40, a primer recess 32 located within the cylindrical second primer insert portion joining region 40, a primer flash aperture 30 through the inner surface 28 into the primer recess 32, and a flash aperture groove 38 around the primer flash aperture 30 in the primer recess 32; and an insert joint 16 located between the first primer insert portion 12 and the second primer insert portion 14, wherein the cylindrical first primer insert portion joining region 24 is adjacent to the cylindrical second primer insert portion joining region 40 to form a two piece primer insert; overmolding a substantially cylindrical polymeric middle body by molding a polymer over the two piece primer insert, wherein the substantially cylindrical polymeric middle body comprises: a substantially cylindrical polymeric bullet-end coupling element at a first end of the substantially cylindrical polymeric middle body opposite a substantially cylindrical polymeric coupling end connected by a powder chamber, wherein the substantially cylindrical polymeric coupling end extends over the substantially cylindrical coupling element and covers an circumferential surface of the primer flash hole aperture; molding a substantially cylindrical polymeric bullet-end upper portion comprising a bullet-end coupling element connected to the substantially cylindrical polymeric bullet-end coupling element opposite a projectile aperture adapted to engage a bullet; and connecting the substantially cylindrical polymeric middle body and the substantially cylindrical polymeric bullet-end upper portion to form a polymer ammunition cartridge; forming a propellant chamber that extends from the projectile aperture to the flash hole; inserting a primer into the primer recess; disposing a propellant at least partially filling the powder chamber; and fitting a bullet in the bullet-end aperture.

The method wherein the polymeric ammunition cartridge has a caliber selected from .223, .243, .25-06, .270, .300, .308, .338, .30-30, .30-06, .45-70 or .50-90, 50 caliber, 45 caliber, 380 caliber or 38 caliber, 5.56 mm, 6 mm, 7 mm, 7.62 mm, 8 mm, 9 mm, 10 mm, or 12.7 mm. The method wherein the polymeric ammunition cartridge has a caliber selected from .308, .338, 50 caliber, 5.56 mm, 7.62 mm, or 12.7 mm. The method wherein the substantially cylindrical polymeric middle body is formed from a ductile polymer, a nylon polymer or a fiber-reinforced polymeric composite. The method wherein the substantially cylindrical polymeric bullet-end upper portion comprises a ductile polymer, a nylon polymer or a fiber-reinforced polymeric composite. The method wherein the substantially cylindrical polymeric middle body comprise a polymers selected from the group consisting of polyurethane prepolymer, cellulose, fluoro-polymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadinen-styrene, thermoplastic fluoro polymers, inomers, polyamides, polyamide-imides, polyacrylates, polyatherketones, polyaryl-sulfones, polybenzimidazoles, polycarbonates, polybutylene, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, urethane hybrids, polyphenylsulfones, copolymers of polyphenylsulfones with polyethersulfones or polysulfones, copolymers of poly-phenylsulfones with siloxanes, blends of polyphenylsulfones with polysiloxanes, poly(etherimide-siloxane) copolymers, blends of polyetherimides and polysiloxanes, and blends of polyetherimides and poly(etherimide-siloxane) copolymers. The method wherein the substantially cylindrical polymeric bullet-end upper portion comprise a polymers selected from the group consisting of polyurethane prepolymer, cellulose, fluoro-polymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadinen-styrene, thermoplastic fluoro polymers, inomers, polyamides, polyamide-imides, polyacrylates, polyatherketones, polyaryl-sulfones, polybenzimidazoles, polycarbonates, polybutylene, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, urethane hybrids, polyphenylsulfones, copolymers of polyphenylsulfones with polyethersulfones or polysulfones, copolymers of poly-phenylsulfones with siloxanes, blends of polyphenylsulfones with polysiloxanes, poly(etherimide-siloxane) copolymers, blends of polyetherimides and polysiloxanes, and blends of polyetherimides and poly(etherimide-siloxane) copolymers. The method wherein the substantially cylindrical polymeric bullet-end and the substantially cylindrical polymeric bullet-end upper portion are welded or bonded together. The method wherein the substantially cylindrical polymeric bullet-end coupling element is welded or bonded to the substantially cylindrical polymeric bullet-end upper portion. The method wherein the insert joint is threaded, riveted, locked, friction fitted, pressed, coined, snap fitted, chemical bonded, chemical welded, soldered, smelted, sintered, adhesive bonded, laser welded, ultrasonic welded, friction spot welded, friction stir welded or a combination thereof. The method wherein the first primer insert portion 12, the second primer insert portion 14 or both are formed independently by metal injection molding, polymer injection molding, stamping, pressing, milling, molding, machining, punching, fine blanking, smelting, or any other method that will form insert portions that may be joined together to form a primer insert. The method wherein the first primer insert portion 12, the second primer insert portion 14 or both independently comprises a polymer, a metal, an alloy, or a ceramic alloy. The method wherein the first primer insert portion 12 and the second primer insert portion 14 comprise of the same material or different materials. The method further comprising a support structure 90 positioned about the cylindrical insert coupling element 18. The method wherein the support structure 90 is positioned about the insert transition 22. The method wherein the support structure 90 extends at least partially into the insert joint 16. The method wherein the support structure 90 is a mesh, a sheet or a weave. The method further comprising one or more surface protrusions 100 positioned about the cylindrical insert coupling element 18.

BRIEF DESCRIPTION OF THE SEVERAL VIEWS OF THE DRAWINGS

For a more complete understanding of the features and advantages of the present invention, reference is now made to the detailed description of the invention along with the accompanying figures and in which.

DETAILED DESCRIPTION OF THE INVENTION

Figure 1:
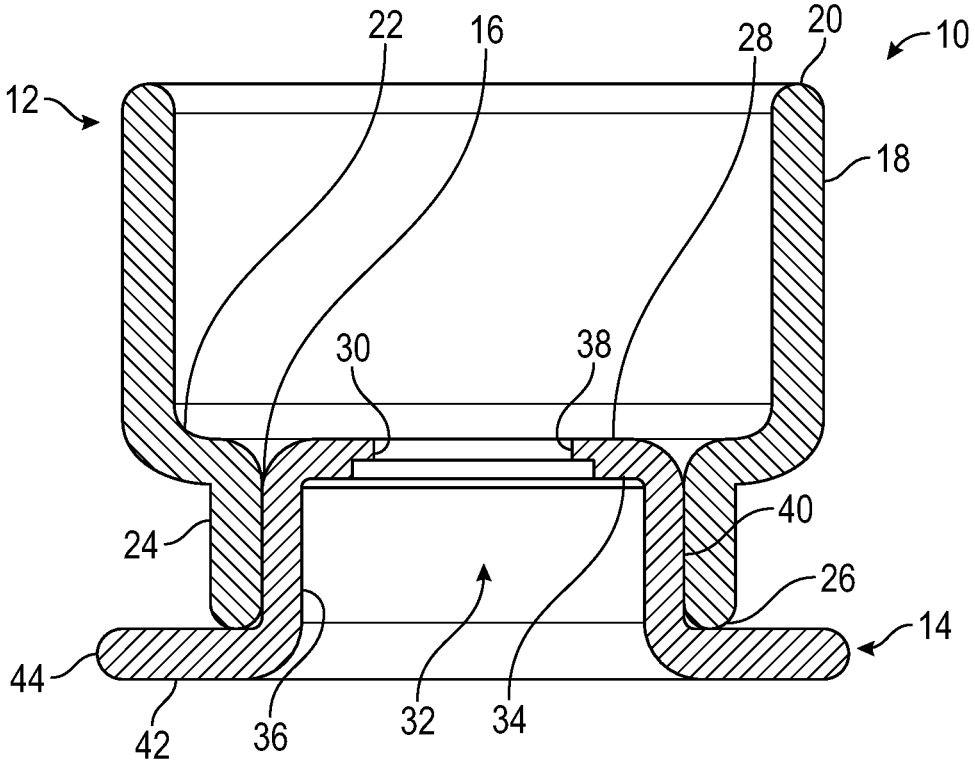
FIG. 1 is a cut through image of one embodiment of a two piece primer insert.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

Shortcomings of the known methods of producing polymer or substantially polymer ammunition include the possibility of the projectile being pushed into the cartridge casing, the bullet pull being too light such that the bullet can fall out, the bullet pull being too insufficient to create sufficient chamber pressure, the bullet pull not being uniform from round to round, and portions of the cartridge casing breaking off upon firing causing the weapon to jam or damage or danger when subsequent rounds are fired or when the casing portions themselves become projectiles. The present invention overcomes these and other shortcomings and provides improvements in cartridge case design and performance polymer materials.

Reliable cartridge manufacture requires uniformity from one cartridge to the next in order to obtain consistent ballistic performance. Among other considerations, proper bullet seating and bullet-to-casing fit is required. In this manner, a desired pressure develops within the casing during firing prior to bullet and casing separation. Historically, bullets employ a cannelure, which is a slight annular depression formed in a surface of the bullet at a location determined to be the optimal seating depth for the bullet. In this manner, a visual inspection of a cartridge could determine whether or not the bullet is seated at the proper depth. Once the bullet is inserted into the casing to the proper depth, one of two standard procedures is incorporated to lock the bullet in its proper location. One method is the crimping of the entire end of the casing into the cannelure. A second method does not crimp the casing end; rather the bullet is pressure fitted into the casing.

The polymeric ammunition cartridges of the present invention are of a caliber typically carried by soldiers in combat for use in their combat weapons. The present invention is not limited to the described caliber and is believed to be applicable to other calibers as well. This includes various small, medium and large caliber munitions, including 5.56 mm, 7.62 mm, 308, 338, 3030, 3006, and .50 caliber ammunition cartridges, as well as medium/small caliber ammunition such as 380 caliber, 38 caliber, 9 mm, 10 mm, 20 mm, 25 mm, 30 mm, 40 mm, 45 caliber and the like. The projectile and the corresponding cartridge may be of any desired size, e.g., .223, .243, .25-06, .270, .300, .308, .338, .30-30, .30-06, .45-70 or .50-90, 50 caliber, 45 caliber, 380 caliber or 38 caliber, 5.56 mm, 6 mm, 6.5 mm, 7 mm, 7.62 mm, 8 mm, 9 mm, 10 mm, 12.7 mm, 14.5 mm, 14.7 mm, 20 mm, 25 mm, 30 mm, 40 mm, 57 mm, 60 mm, 75 mm, 76 mm, 81 mm, 90 mm, 100 mm, 105 mm, 106 mm, 115 mm, 120 mm, 122 mm, 125 mm, 130 mm, 152 mm, 155 mm, 165 mm, 175 mm, 203 mm or 460 mm, 4.2 inch or 8 inch. The cartridges, therefore, are of a caliber between about 0.05 and about 5 inches. Thus, the present invention is also applicable to the sporting goods industry for use by hunters and target shooters.

The present invention includes primer inserts that are made as a multi-piece insert. In one embodiment the multi-piece insert is a 2 piece insert but may be a 3, 4, 5, or 6 piece insert. Regardless of the number of pieces the multi-piece insert each piece may be of similar or dissimilar materials that are connected to form a unitary primer insert. The portions of the primer insert may be constructed from similar or dissimilar materials including metal-to-metal, polymer-to-polymer and metal-to-polymer.

Each of the pieces may be independently formed by a variety of methods and processes. For example. Each of the components may be formed by injection molding, including metal, alloy, polymer, composite injection molding. Each of the pieces may be independently made by any compressive forming process including deformation in an uniaxial or multiaxial compressive loading. The processes include rolling, where the material is passed through a pair of roller, extrusion, where the material is pushed through an orifice, die forming where the material is stamped by a press around or onto a die, forging where the material is shaped by localized compressive forces, indenting, where a tool is pressed into the workpiece. In addition the individual pieces may be formed by blanking and piercing, trimming, shaving, notching, perforating, nibbling, dinking, lancing, cutoff, stamping: progressive, coining, straight shearing; forging: smith, hammer forge, drop forge, press, impact, upset, no draft, high-energy-rate, cored, incremental and powder; rolling, cold rolling, hot rolling, sheet metal, shape, ring, transverse, cryorolling, orbital, cross-rolling, pressing, stretch forming, blanking, bulging, necking, nosing, bending, hemming, redrawing, ironing, flattening, swaging, spinning, peening, guerin process, wheelon process, magnetic pulse, staking, seaming, flanging, straightening, decambering, cold sizing, hubbing, hot metal gas forming, curling, hydroforming. The individual pieces may be formed by additive manufacturing including 3D printing; filament winding, produces composite pipes, tanks, etc.; direct metal laser sintering, fused deposition modeling; laminated object manufacturing; laser engineered net shaping; selective laser sintering or stereolithography.

In addition the individual pieces may be joined by one or more techniques including welding, electron beam welding, laser welding, thermite welding, induction welding; brazing, torch, induction brazing, furnace brazing, dip brazing; soldering, induction soldering, dip soldering, wave soldering, ultrasonic soldering; sintering; adhesive bonding; thermosetting bonding, thermoplastic bonding, epoxy bonding, adhesive alloy bonding; riveting; clinching; pinning; stitching; stapling; press fitting.

The individual pieces may be formed by punching, pressing, stamping, molding, coining, or by additive manufacturing. The individual pieces may be joined using various methods including smelting, clinching, pressing welding soldering, sintering, adhesive gluing, staking, and iterative addition by forming one piece into another piece.

In addition, the various components of the multi-piece insert may be pressed together to form a unitary insert. The individual portions held in position using stakes or retainers (e.g., ring and slot, stake, etc.). The method of connecting the individual pieces to form a unitary insert will depend on the materials being joined. For example, a metal insert may be constructed from two or more metal pieces with similar melting points are joined together to form a unitary insert through sintering. Similarly, a metal insert constructed from two or more metal pieces may be pressed together to form a unitary insert.

A metal insert constructed from two or more metal pieces may be joined by clinching or press-joining where the metal components are joined without additional components, using special tools to form an interlock between two or more components. The process is generally performed at room temperature but can be pre-heated to improve the material ductility. Additionally, a metal insert constructed from two or more metal pieces may be crimped together to form a unitary insert.

Regardless of the number of section each portion may be made from a single material that is milled, stamped, forged, machined, molded, cast or other method of forming a primer insert portion.

FIG. 1 is a cut through image of one embodiment of a two piece primer insert. The primer insert 10 is formed by joining a first primer insert portion 12 to a second primer insert portion 14. The primer insert 10 is formed by press joining the first primer insert portion 12 and the second primer insert portion 14 which forms a insert joint 16. The first primer insert portion 12 may be of the same or different materials than the second primer insert portion 14. The first primer insert portion 12 includes an insert coupling element 18 that extends from an insert tip 20 downward to an insert transition 22. The insert transition 22 transitions from the vertical region of the insert tip 20 to a horizontal region. The insert transition 22 is in communication with the first primer insert portion joining region 24 that extends to the first primer insert portion bottom 26. The first primer insert portion joining region 24 and the first primer insert portion bottom 26 are in pressed contact with the second primer insert portion 14 to form the insert joint 16. The second primer insert portion 14 includes an inner surface (not shown) that when overmolded into an ammunition cartridge (not shown) forms the bottom of the propellant chamber (not shown). The inner surface 28 includes a primer flash aperture 30 that extends through the inner surface 28 into the primer recess 32. The primer recess 32 includes a primer pocket bottom surface 34 and a primer pocket side walls 36. The primer recess 32 is adapted to fit a primer (not shown) and allow the primer to transmit through the primer flash aperture 30. The primer pocket bottom surface 34 includes a flash aperture groove 38 that extends around the primer flash aperture 30. The flash aperture groove 38 may extend across the primer recess bottom surface 34 covering any distance from the primer flash aperture 30 to the primer recess side walls 36. For example, the flash aperture groove 38 may be about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 32, 34, 36, 38, 40, 42, 44, 46, 48, 50, 52, 54, 56, 58, 60, 62, 64, 66, 68, 70, 72, 74, 76, 78, 80, 82, 84, 86, 88, 90, 92, 94, 96, 98, or even 100 percent of the distance from the primer flash aperture 30 to the primer recess side walls 36. The primer recess side walls 36 is opposite the second primer insert portion joining region 40. The second primer insert portion joining region 40 is in pressed contact with the first primer insert portion joining region 24 to form the insert joint 16 that is in pressed contact to retain the joining of the first primer insert portion 12 and the second primer insert portion 14. The second primer insert portion 14 includes a transition from the primer recess 32 to the outer surface 42 that extends to an extraction flange 44.

Figure 2:
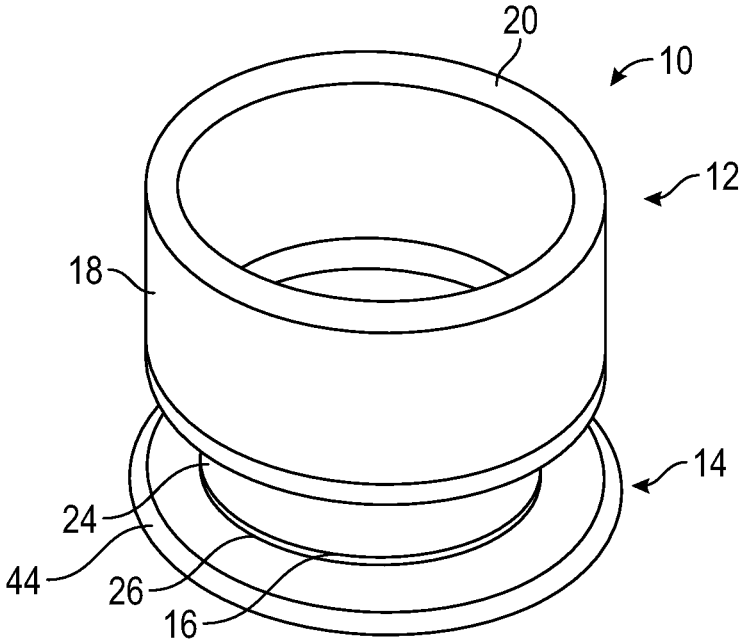
FIG. 2 is a perspective view of one embodiment of a two piece primer insert shown in FIG. 1.

FIG. 2 is a perspective view of one embodiment of a two piece primer insert. The primer insert 10 is formed by joining a first primer insert portion 12 to a second primer insert portion 14. The primer insert 10 is formed by press joining the first primer insert portion 12 and the second primer insert portion 14. The first primer insert portion 12 may be of the same or different materials than the second primer insert portion 14. The first primer insert portion 12 includes an insert coupling element 18 that extends from an insert tip 20 downward to an insert transition (not shown). The insert transition (not shown) transitions from the vertical region of the insert tip 20 to a horizontal region. The insert transition (not shown) is in communication with the first primer insert portion joining region 24 that extends to the first primer insert portion bottom 26. The first primer insert portion joining region 24 and the first primer insert portion bottom 26 are in pressed contact with the second primer insert portion 14 to form the insert joint 16. The second primer insert portion 14 includes 6 an inner surface (not shown) that when overmolded into an ammunition cartridge (not shown) forms the bottom of the propellant chamber (not shown). The inner surface (not shown) includes a primer flash aperture (not shown) that extends through the inner surface (not shown) into the primer pocket (not shown). The second primer insert portion joining region (not shown) is in pressed contact with the first primer insert portion joining region 24 to form the insert joint 16 that is in pressed contact to retain the joining of the first primer insert portion 12 and the second primer insert portion 14. The second primer insert portion 14 includes a transition from the primer recess (not shown) to the outer surface (not shown) that extends to an extraction flange 44.

Figure 3:
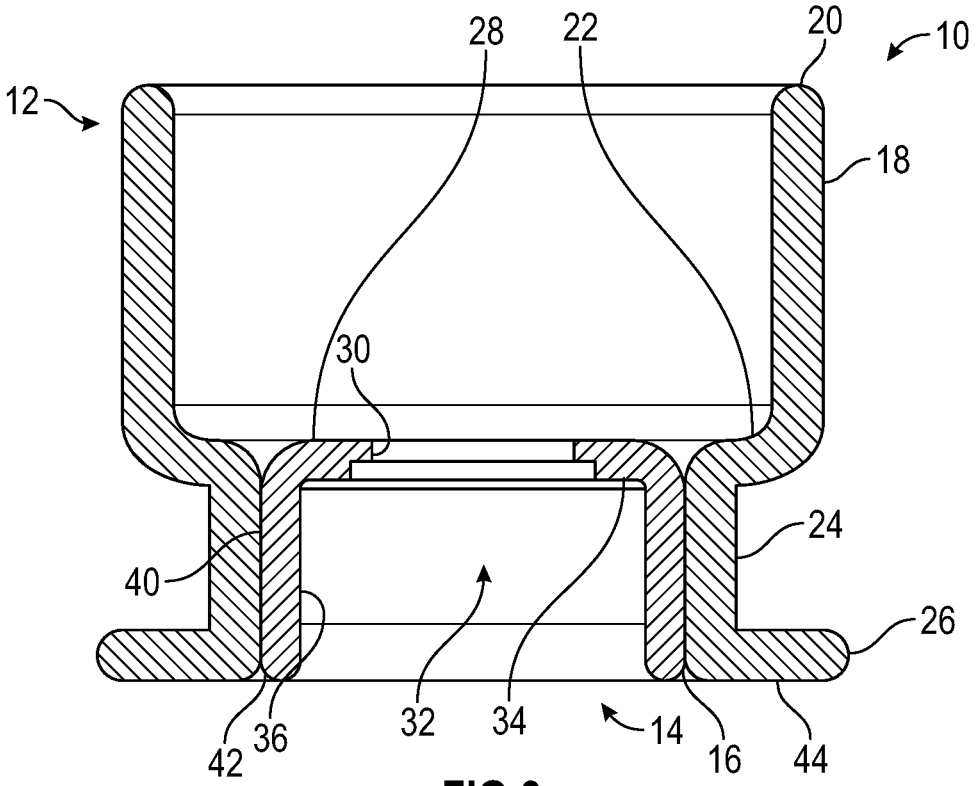
FIG. 3 is a cut through image of one embodiment of a two piece primer insert.

FIG. 3 is a cut through image of one embodiment of a two piece primer insert. The primer insert 10 is formed by joining a first primer insert portion 12 to a second primer insert portion 14. The primer insert 10 is formed by press joining the first primer insert portion 12 and the second primer insert portion 14 which forms a insert joint 16. The first primer insert portion 12 may be of the same or different materials than the second primer insert portion 14. The first primer insert portion 12 includes an insert coupling element 18 that extends from an insert tip 20 downward to an insert transition 22. The insert transition 22 transitions from the vertical region of the insert tip 20 to a horizontal region. The insert transition 22 is in communication with the first primer insert portion joining region 24 that extends to the first primer insert portion bottom 26. The first primer insert portion joining region 24 and the first primer insert portion bottom 26 are in pressed contact with the second primer insert portion 14 to form the insert joint 16. The first primer insert portion bottom 26 is extended to an extraction flange 44. The second primer insert portion 14 includes an inner surface 28 that when overmolded into an ammunition cartridge (not shown) forms the bottom of the propellant chamber (not shown). The inner surface 28 includes a primer flash aperture 30 that extends through the inner surface 28 into the primer recess 32. The primer recess 32 includes a primer pocket bottom surface 34 and a primer pocket side walls 36. The primer recess 32 is adapted to fit a primer (not shown) and to allow the primer to transmit through the primer flash aperture 30. The primer pocket bottom surface 34 includes a flash aperture groove 38 that extends around the primer flash aperture 30. The flash aperture groove 38 may extend across the primer recess bottom surface 34 covering any distance from the primer flash aperture 30 to the primer recess side walls 36. For example, the flash aperture groove 38 may be about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 32, 34, 36, 38, 40, 42, 44, 46, 48, 50, 52, 54, 56, 58, 60, 62, 64, 66, 68, 70, 72, 74, 76, 78, 80, 82, 84, 86, 88, 90, 92, 94, 96, 98, or even 100 percent of the distance from the primer flash aperture 30 to the primer recess side walls 36. The primer recess side walls 36 is opposite the second primer insert portion joining region 40. The second primer insert portion joining region 40 is in pressed contact with the first primer insert portion joining region 24 to form the insert joint 16 that is in pressed contact to retain the joining of the first primer insert portion 12 and the second primer insert portion 14. The second primer insert portion 14 includes a transition from the primer recess 32 to the outer surface 42.

Figure 4:
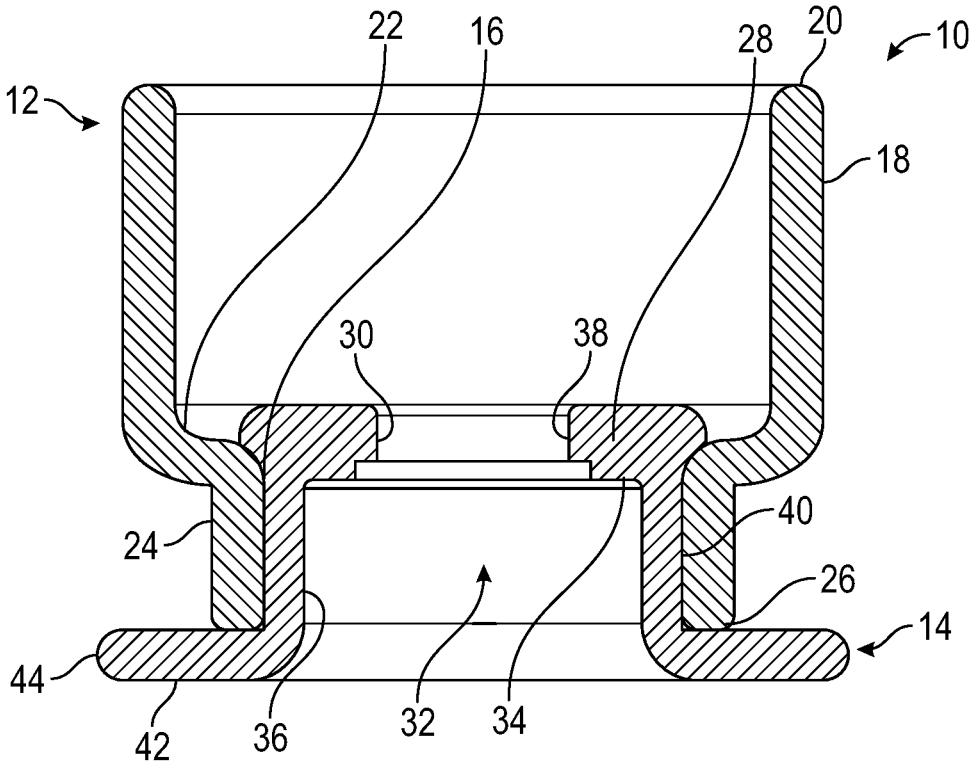
FIG. 4 is a cut through image of one embodiment of a two piece primer insert.

FIG. 4 is a cut through image of one embodiment of a two piece primer insert. The primer insert 10 is formed by joining a first primer insert portion 12 to a second primer insert portion 14. The primer insert 10 is formed by press joining the first primer insert portion 12 and the second primer insert portion 14 which forms a insert joint 16. The first primer insert portion 12 may be of the same or different materials than the second primer insert portion 14. The first primer insert portion 12 includes an insert coupling element 18 that extends from an insert tip 20 downward to an insert transition 22. The insert transition 22 transitions from the vertical region of the insert tip 20 to a horizontal region. The insert transition 22 is in communication with the first primer insert portion joining region 24 that extends to the first primer insert portion bottom 26. The first primer insert portion joining region 24 and the first primer insert portion bottom 26 are in pressed contact with the second primer insert portion 14 to form the insert joint 16. The second primer insert portion 14 includes an inner surface 28 that when overmolded into an ammunition cartridge (not shown) forms the bottom of the propellant chamber (not shown). The inner surface 28 includes a primer flash aperture 30 that extends through the inner surface 28 into the primer recess 32. The primer recess 32 includes a primer pocket bottom surface 34 and a primer pocket side walls 36. The primer recess 32 is adapted to fit a primer (not shown) and to allow the primer to transmit through the primer flash aperture 30. The primer pocket bottom surface 34 includes a flash aperture groove 38 that extends around the primer flash aperture 30. The flash aperture groove 38 may extend across the primer recess bottom surface 34 covering any distance from the primer flash aperture 30 to the primer recess side walls 36. For example, the flash aperture groove 38 may be about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 32, 34, 36, 38, 40, 42, 44, 46, 48, 50, 52, 54, 56, 58, 60, 62, 64, 66, 68, 70, 72, 74, 76, 78, 80, 82, 84, 86, 88, 90, 92, 94, 96, 98, or even 100 percent of the distance from the primer flash aperture 30 to the primer recess side walls 36. The primer recess side walls 36 is opposite the second primer insert portion joining region 40. The second primer insert portion joining region 40 is in pressed contact with the first primer insert portion joining region 24 to form the insert joint 16 that is in pressed contact to retain the joining of the first primer insert portion 12 and the second primer insert portion 14. The second primer insert portion 14 includes a transition from the primer recess 32 to the outer surface 42 that extends to an extraction flange 44.

Figure 5:
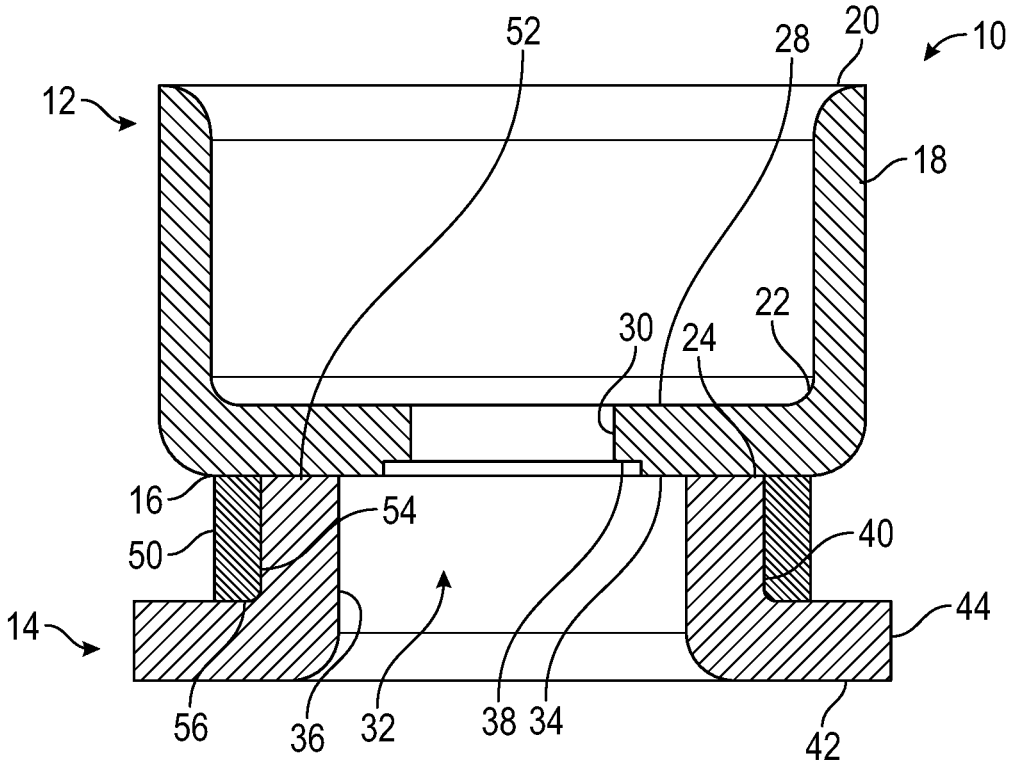
FIG. 5 is a cut through image of one embodiment of a multi piece primer insert.

FIG. 5 is a cut through image of one embodiment of a multi piece primer insert. The primer insert 10 is formed by joining a first primer insert portion 12 to a second primer insert portion 14 using a third primer insert portion 50. The primer insert 10 is formed by press-joining the first primer insert portion 12, the second primer insert portion 14 and the third primer insert portion 50 which forms a insert joint 16. The first primer insert portion 12 may be of the same or different materials than the second primer insert portion 14 and/or the third primer insert portion 50. The first primer insert portion 12 includes an insert coupling element 18 that extends from an insert tip 20 downward to an insert transition 22. The insert transition 22 transitions from the vertical region of the insert tip 20 to a horizontal region that includes an inner surface 28 that when overmolded into an ammunition cartridge (not shown) forms the bottom of the propellant chamber (not shown). The inner surface 28 and the primer pocket bottom surface 34 are part of the first primer insert portion 12. The inner surface 28 includes a primer flash aperture 30 that extends through the inner surface 28 into the primer recess 32. The primer pocket bottom surface 34 includes a flash aperture groove 38 that extends around the primer flash aperture 30. The flash aperture groove 38 may extend across the primer recess bottom surface 34 covering any distance from the primer flash aperture 30 to the primer recess side walls 36. For example, the flash aperture groove 38 may be about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 32, 34, 36, 38, 40, 42, 44, 46, 48, 50, 52, 54, 56, 58, 60, 62, 64, 66, 68, 70, 72, 74, 76, 78, 80, 82, 84, 86, 88, 90, 92, 94, 96, 98, or even 100 percent of the distance from the primer flash aperture 30 to the primer recess side walls 36. The first primer insert portion joining region 24 is an extension of the primer recess bottom surface 34. The first primer insert portion joining region 24 forms the insert joint 16 through pressed contact with second primer insert portion 14 and third primer insert portion 50. The primer recess 32 includes a primer pocket bottom surface 34 and a primer pocket side walls 36. The primer recess 32 is adapted to fit a primer (not shown) and to allow the primer to transmit through the primer flash aperture 30. The second primer insert portion 14 includes a second primer insert top portion 52 that contacts the first primer insert portion joining region 24. The second primer insert top portion 52 extends downwardly to form the primer pocket side walls 36 opposite an outer primer pocket side walls 54 to form the second primer insert portion joining region 40. The pressed contact between the third primer insert portion 50 and the outer primer pocket side walls 54 forms a second insert junction 56. The second primer insert portion joining region 40 is in pressed contact with the third primer insert portion 50 and the third primer insert portion 50 and the second primer insert top portion 52 are in contact with the first primer insert portion joining region 24 to form the insert joint 16 that is in pressed contact to retain the joining of the first primer insert portion 12, the second primer insert portion 14 and the third primer insert portion 50. The second primer insert portion 14 includes a transition from the primer recess 32 to the outer surface 42 that extends to an extraction flange 44.

Figure 6:
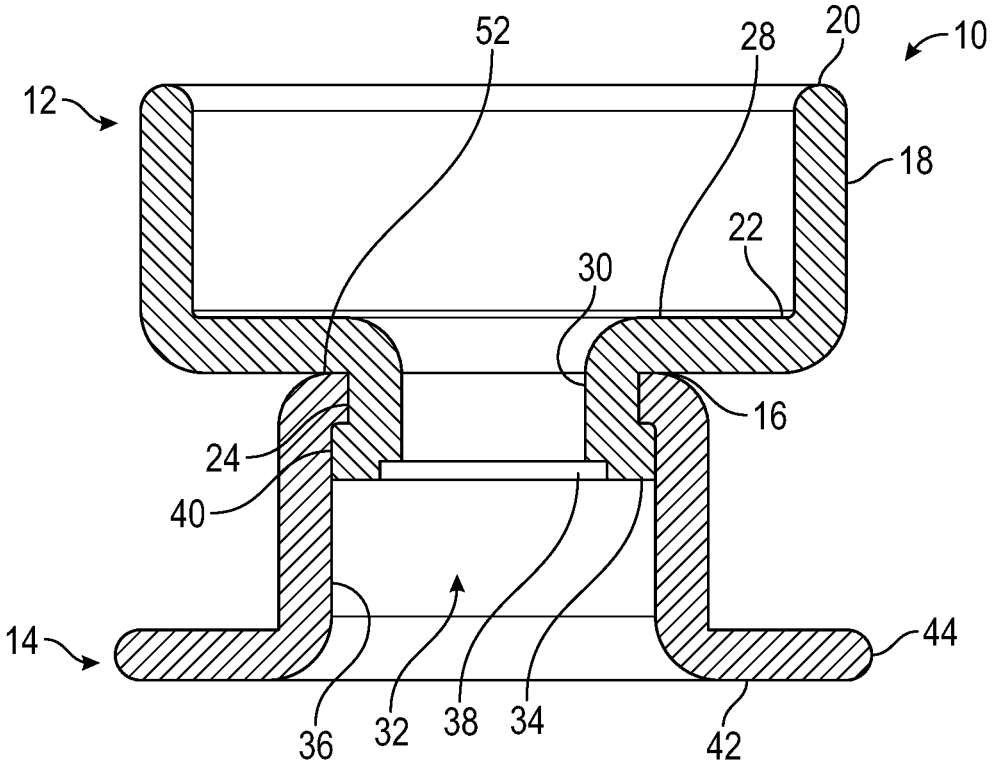
FIG. 6 is a cut through image of one embodiment of a two piece primer insert.

FIG. 6 is a cut through image of one embodiment of a two piece primer insert. The primer insert 10 is formed by joining a first primer insert portion 12 to a second primer insert portion 14. The primer insert 10 is formed by press joining the first primer insert portion 12 and the second primer insert portion 14 which forms a insert joint 16. The first primer insert portion 12 may be of the same or different materials than the second primer insert portion 14. The first primer insert portion 12 includes an insert coupling element 18 that extends from an insert tip 20 downward to an insert transition 22. The insert transition 22 transitions from the vertical region of the insert tip 20 to a horizontal region that includes an inner surface 28 that when overmolded into an ammunition cartridge (not shown) forms the bottom of the propellant chamber (not shown). The inner surface 28 and the primer pocket bottom surface 34 are part of the first primer insert portion 12. The inner surface 28 includes a primer flash aperture 30 that extends through the inner surface 28 into the primer recess 32. The primer pocket bottom surface 34 includes a flash aperture groove 38 that extends around the primer flash aperture 30. The flash aperture groove 38 may extend across the primer recess bottom surface 34 covering any distance from the primer flash aperture 30 to the primer recess side walls 36. For example, the flash aperture groove 38 may be about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 32, 34, 36, 38, 40, 42, 44, 46, 48, 50, 52, 54, 56, 58, 60, 62, 64, 66, 68, 70, 72, 74, 76, 78, 80, 82, 84, 86, 88, 90, 92, 94, 96, 98, or even 100 percent of the distance from the primer flash aperture 30 to the primer recess side walls 36. The first primer insert portion joining region 24 is an extension of the primer flash aperture 30 that press fits the second primer insert portion joining region 40. The primer recess 32 includes a primer pocket bottom surface 34 formed form the first primer insert portion 12 and a primer pocket side walls 36 formed from the second primer insert portion 14. The primer recess 32 is adapted to fit a primer (not shown) and to allow the primer to transmit through the primer flash aperture 30. The second primer insert portion 14 includes a second primer insert top portion 52 that contacts the first primer insert portion 12. The second primer insert top portion 52 extends downwardly to form the primer pocket side walls 36 and includes a transition from the primer recess 32 to the outer surface 42 that extends to an extraction flange 44.

Figure 7:
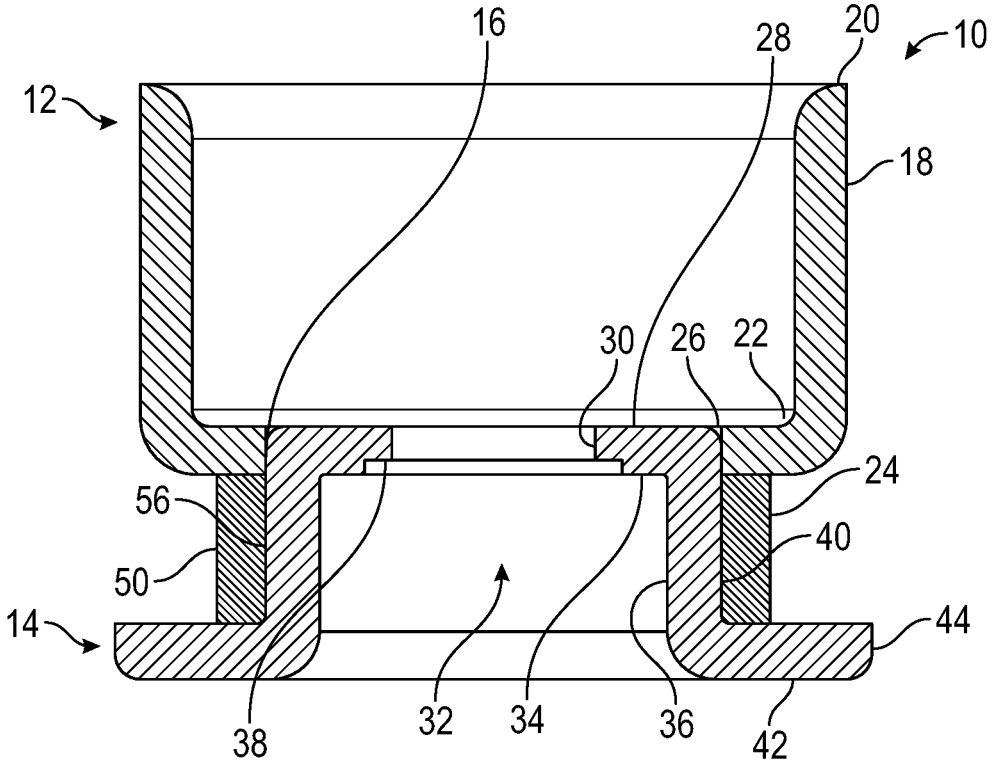
FIG. 7 is a cut through image of one embodiment of a multi-piece primer insert.

FIG. 7 is a cut through image of one embodiment of a multi-piece primer insert. The primer insert 10 is formed by joining a first primer insert portion 12 to a second primer insert portion 14 using a third primer insert portion 50. The primer insert 10 is formed by press-joining the first primer insert portion 12, the second primer insert portion 14 and the third primer insert portion 50 which forms a insert joint 16. The first primer insert portion 12 may be of the same or different materials than the second primer insert portion 14 and/or the third primer insert portion 50. The first primer insert portion 12 includes an insert coupling element 18 that extends from an insert tip 20 downward to an insert transition 22. The insert transition 22 transitions from the vertical region of the insert tip 20 to a horizontal region. The insert transition 22 is in communication with the first primer insert portion joining region 24 that extends to the first primer insert portion bottom 26. The first primer insert portion joining region 24 and the first primer insert portion bottom 26 are in pressed contact with the second primer insert portion 14 to form the insert joint 16. The second primer insert portion 14 includes an inner surface 28 that when overmolded into an ammunition cartridge (not shown) forms the bottom of the propellant chamber (not shown). The inner surface 28 includes a primer flash aperture 30 that extends through the inner surface 28 into the primer recess 32. The primer recess 32 includes a primer pocket bottom surface 34 and a primer pocket side walls 36. The primer recess 32 is adapted to fit a primer (not shown) and to allow the primer to transmit through the primer flash aperture 30. The primer pocket bottom surface 34 includes a flash aperture groove 38 that extends around the primer flash aperture 30. The flash aperture groove 38 may extend across the primer recess bottom surface 34 covering any distance from the primer flash aperture 30 to the primer recess side walls 36. For example, the flash aperture groove 38 may be about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 32, 34, 36, 38, 40, 42, 44, 46, 48, 50, 52, 54, 56, 58, 60, 62, 64, 66, 68, 70, 72, 74, 76, 78, 80, 82, 84, 86, 88, 90, 92, 94, 96, 98, or even 100 percent of the distance from the primer flash aperture 30 to the primer recess side walls 36. The primer recess side walls 36 is opposite the second primer insert portion joining region 40. The second primer insert portion joining region 40 is in pressed contact with the third primer insert portion 50 to form the second insert junction 56. The second primer insert portion 14 includes a transition from the primer recess 32 to the outer surface 42 that extends to an extraction flange 44.

Figure 8:
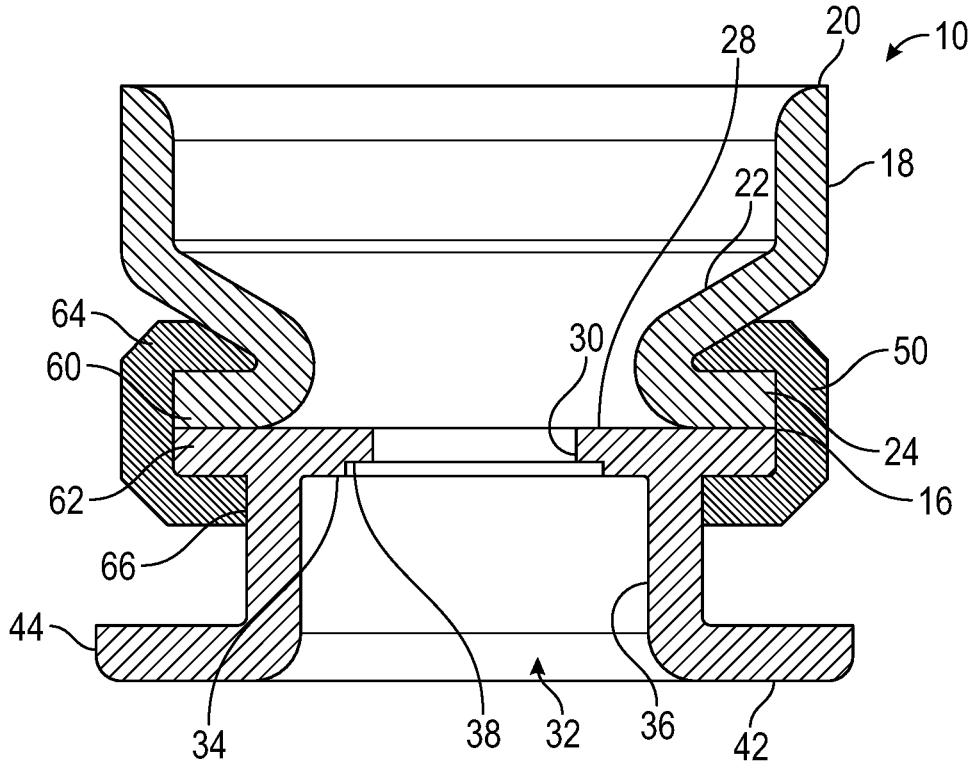
FIG. 8 is a cut through image of one embodiment of a multi-piece primer insert.

FIG. 8 is a cut through image of one embodiment of a multi-piece primer insert. The primer insert 10 is formed by joining a first primer insert portion 12 to a second primer insert portion 14 using a third primer insert portion 50. The primer insert 10 is formed by press-joining the first primer insert portion 12 and the second primer insert portion 14 by press joining the third primer insert portion 50 to connect the portions. The first primer insert portion 12 may be of the same or different materials than the second primer insert portion 14. The first primer insert portion 12 includes an insert coupling element 18 that extends from an insert tip 20 downward to an insert transition 22. The insert transition 22 transitions from the vertical region of the insert tip 20 to a horizontal region. The insert transition 22 is in communication with the first primer insert portion joining region 24 that extends outwardly to form an upper crimping region 60. The second primer insert portion 14 includes an inner surface 28 that when overmolded into an ammunition cartridge (not shown) forms the bottom of the propellant chamber (not shown). The inner surface 28 extends to form a lower crimping region 62. The lower crimping region 62 and the upper crimping region 60 align to form the insert joint 16. The inner surface 28 includes a primer flash aperture 30 that extends through the inner surface 28 into the primer recess 32. The primer recess 32 includes a primer pocket bottom surface 34 and a primer pocket side walls 36. The primer recess 32 is adapted to fit a primer (not shown) and to allow the primer to transmit through the primer flash aperture 30. The primer pocket bottom surface 34 includes a flash aperture groove 38 that extends around the primer flash aperture 30. The flash aperture groove 38 may extend across the primer recess bottom surface 34 covering any distance from the primer flash aperture 30 to the primer recess side walls 36. For example, the flash aperture groove 38 may be about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 32, 34, 36, 38, 40, 42, 44, 46, 48, 50, 52, 54, 56, 58, 60, 62, 64, 66, 68, 70, 72, 74, 76, 78, 80, 82, 84, 86, 88, 90, 92, 94, 96, 98, or even 100 percent of the distance from the primer flash aperture 30 to the primer recess side walls 36. The second primer insert portion 14 includes a transition from the primer recess 32 to the outer surface 42 that extends to an extraction flange 44. The insert joint 16 is connected using the third primer insert portion 50 which is pressed over the upper crimping region 60 and the lower crimping region 62. The third primer insert portion 50 includes an upper surface 64 that is pressed over the upper crimping region 60 and a lower surface 66 that is pressed over the lower crimping region 62.

Figure 9:
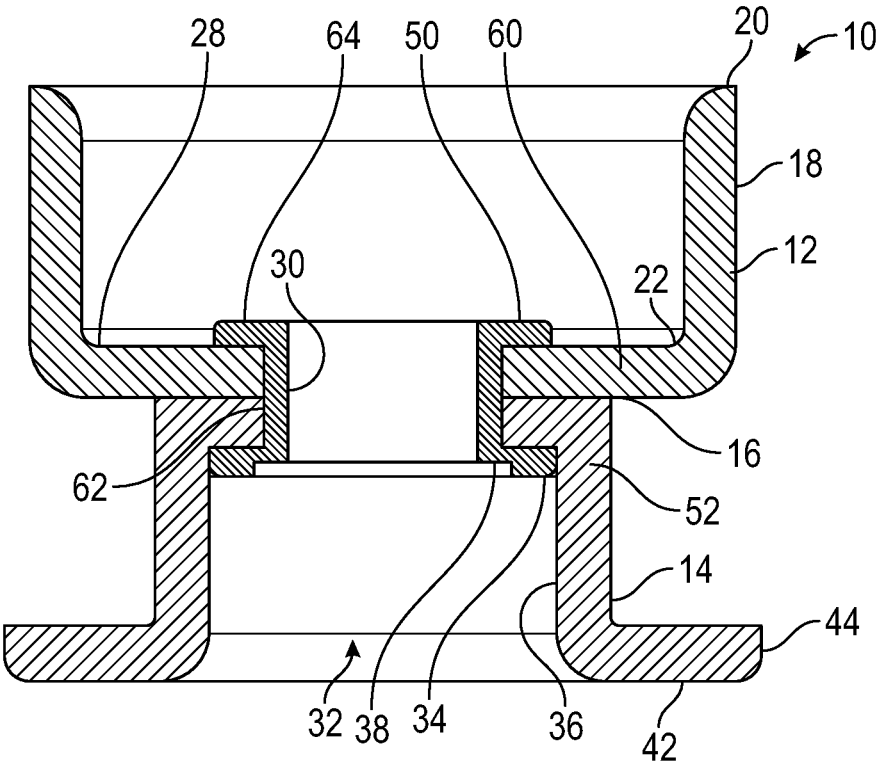
FIG. 9 is a cut through image of one embodiment of a multi-piece primer insert.

FIG. 9 is a cut through image of one embodiment of a multi-piece primer insert. The primer insert 10 is formed by joining a first primer insert portion 12 to a second primer insert portion 14 using a third primer insert portion 50. The primer insert 10 is formed by press-joining the first primer insert portion 12 and the second primer insert portion 14 by press joining the third primer insert portion 50 to connect the portions. The first primer insert portion 12 may be of the same or different materials than the second primer insert portion 14 or the third primer insert portion 50. The first primer insert portion 12 includes an insert coupling element 18 that extends from an insert tip 20 downward to an insert transition 22. The insert transition 22 transitions from the vertical region of the insert tip 20 to a horizontal region that includes an inner surface 28 that when overmolded into an ammunition cartridge (not shown) forms the bottom of the propellant chamber (not shown). The inner surface 28 terminates at an upper crimping region 60 that provides a passage through the first primer insert portion 12. The second primer insert portion 14 includes a lower crimping region 62 that contacts the upper crimping region 60 to form insert joint 16. The lower crimping region 62 extends to a second primer insert top portion 52 extends downwardly to form the primer pocket side walls 36. The second primer insert portion 14 includes a transition from the primer recess 32 to the outer surface 42 that extends to an extraction flange 44. The first primer insert portion 12 and the second primer insert portion 14 meet to form the insert joint 16. The insert joint 16 is connected using the third primer insert portion 50 which is pressed over the upper crimping region 60 and the lower crimping region 62. The third primer insert portion 50 includes an upper surface 64 that is pressed over the upper crimping region 60 and when overmolded into an ammunition cartridge (not shown) forms the bottom of the propellant chamber (not shown). The third primer insert portion 50 is pressed over the lower crimping region 62 to form the primer pocket bottom surface 34. The third primer insert portion 50 includes a primer flash aperture 30 that extends through the first primer insert portion 12 and the second primer insert portion 14 to form the primer pocket bottom surface 34. The primer pocket bottom surface 34 includes a flash aperture groove 38 that extends around the primer flash aperture 30. The flash aperture groove 38 may extend across the primer recess bottom surface 34 covering any distance from the primer flash aperture 30 to the primer recess side walls 36. For example, the flash aperture groove 38 may be about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 32, 34, 36, 38, 40, 42, 44, 46, 48, 50, 52, 54, 56, 58, 60, 62, 64, 66, 68, 70, 72, 74, 76, 78, 80, 82, 84, 86, 88, 90, 92, 94, 96, 98, or even 100 percent of the distance from the primer flash aperture 30 to the primer recess side walls 36. The primer recess 32 includes a primer pocket bottom surface 34 and a primer pocket side walls 36. The primer recess 32 is adapted to fit a primer (not shown) and to allow the primer to transmit through the primer flash aperture 30.

Figure 10:
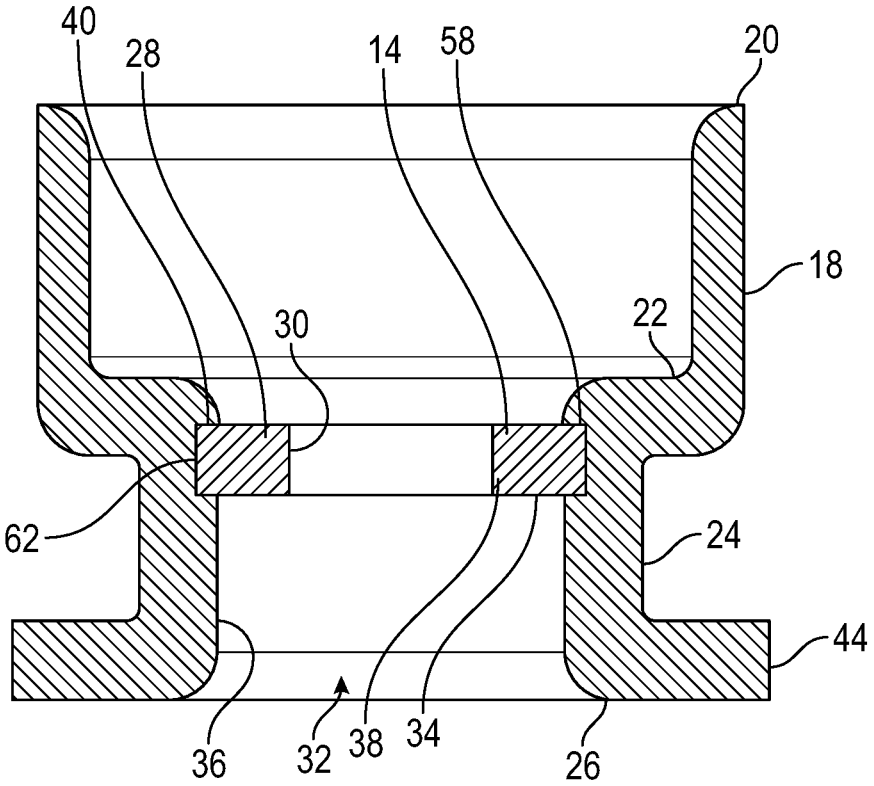
FIG. 10 is a cut through image of one embodiment of a two piece primer insert.

FIG. 10 is a cut through image of one embodiment of a two piece primer insert. The primer insert 10 is formed by joining a first primer insert portion 12 to a second primer insert portion 14. The primer insert 10 is formed by press joining the first primer insert portion 12 and the second primer insert portion 14. The first primer insert portion 12 may be of the same or different materials than the second primer insert portion 14. The first primer insert portion 12 includes an insert coupling element 18 that extends from an insert tip 20 downward to an insert transition 22. The insert transition 22 transitions from the vertical region of the insert tip 20 to a horizontal region. The insert transition 22 is in communication with the first primer insert portion joining region 24 that extends to the first primer insert portion bottom 26 is extended to an extraction flange 44. The first primer insert portion joining region 24 is in pressed contact with the second primer insert portion 14. The second primer insert portion 14 includes an inner surface 28 that when overmolded into an ammunition cartridge (not shown) forms the bottom of the propellant chamber (not shown). The inner surface 28 includes a primer flash aperture 30 that extends through the inner surface 28 into the primer recess 32. The primer recess 32 includes a primer pocket bottom surface 34 and a primer pocket side walls 36. The primer recess 32 is adapted to fit a primer (not shown) and to allow the primer to transmit through the primer flash aperture 30. The primer pocket bottom surface 34 includes a flash aperture groove 38 that extends around the primer flash aperture 30. The flash aperture groove 38 may extend across the primer recess bottom surface 34 covering any distance from the primer flash aperture 30 to the primer recess side walls 36. For example, the flash aperture groove 38 may be 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 32, 34, 36, 38, 40, 42, 44, 46, 48, 50, 52, 54, 56, 58, 60, 62, 64, 66, 68, 70, 72, 74, 76, 78, 80, 82, 84, 86, 88, 90, 92, 94, 96, 98, or even 100 percent of the distance from the primer flash aperture 30 to the primer recess side walls 36. The first primer insert portion joining region 24 includes the notch 58 adapted to pressively receive the second primer insert portion 14. The second primer insert portion joining region 40 is in pressed contact with the notch 58 to retain and join the first primer insert portion 12 and the second primer insert portion 14. In some embodiments the second primer insert portion 14 is a snap ring that includes a primer flash aperture 30 and flash aperture groove 38 that snap/press into the notch 58 in the first primer insert portion 12.

Figure 11:
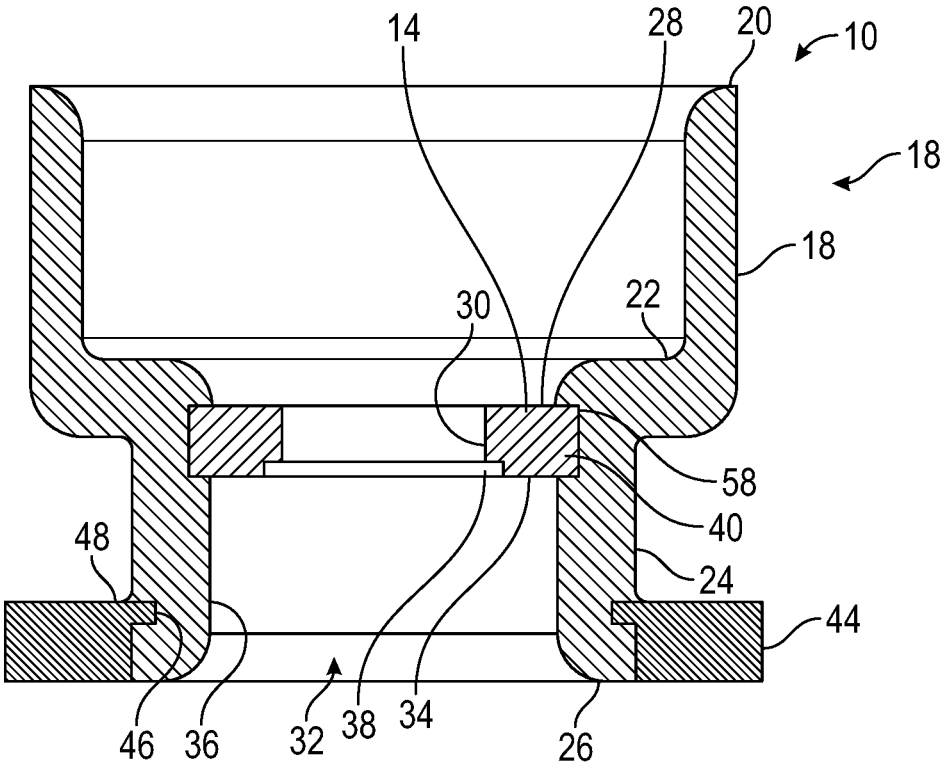
FIG. 11 is a cut through image of one embodiment of a multi-piece primer insert having a separate extraction flange.

FIG. 11 is a cut through image of one embodiment of a multi-piece primer insert having a separate extraction flange. The primer insert 10 is formed by joining a first primer insert portion 12 to a second primer insert portion 14. The primer insert 10 is formed by press-joining the first primer insert portion 12 and the second primer insert portion 14. The first primer insert portion 12 may be of the same or different materials than the second primer insert portion 14. The first primer insert portion 12 includes an insert coupling element 18 that extends from an insert tip 20 downward to an insert transition 22. The insert transition 22 transitions from the vertical region of the insert tip 20 to a horizontal region. The insert transition 22 is in communication with the first primer insert portion joining region 24 that extends to the first primer insert portion bottom 26. The first primer insert portion joining region 24 is in pressed contact with the second primer insert portion 14. The first primer insert portion bottom 26 includes an extraction flange ring notch 46 positioned in the lower portion of the first primer insert portion bottom 26 to accept an extraction flange 44. The extraction flange 44 includes an extraction flange tab 48 that mates to the extraction flange ring notch 46 to secure the extraction flange 44 to the primer insert 10 at the desired location. The second primer insert portion 14 includes an inner surface 28 that when overmolded into an ammunition cartridge (not shown) forms the bottom of the propellant chamber (not shown). The inner surface 28 includes a primer flash aperture 30 that extends through the inner surface 28 into the primer recess 32. The primer recess 32 includes a primer pocket bottom surface 34 and a primer pocket side walls 36. The primer recess 32 is adapted to fit a primer (not shown) and to allow the primer to transmit through the primer flash aperture 30. The primer pocket bottom surface 34 includes a flash aperture groove 38 that extends around the primer flash aperture 30. The flash aperture groove 38 may extend across the primer recess bottom surface 34 covering any distance from the primer flash aperture 30 to the primer recess side walls 36. For example, the flash aperture groove 38 may be about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 32, 34, 36, 38, 40, 42, 44, 46, 48, 50, 52, 54, 56, 58, 60, 62, 64, 66, 68, 70, 72, 74, 76, 78, 80, 82, 84, 86, 88, 90, 92, 94, 96, 98, or even 100 percent of the distance from the primer flash aperture 30 to the primer recess side walls 36. The first primer insert portion joining region 24 includes the notch 58 adapted to pressively receive the second primer insert portion 14. The second primer insert portion joining region 40 is in pressed contact with the notch 58 to retain and join the first primer insert portion 12 and the second primer insert portion 14. In some embodiments the second primer insert portion 14 is a snap ring that includes a primer flash aperture 30 and flash aperture groove 38 that snap/press into the notch 58 in the first primer insert portion 12.

Figure 12:
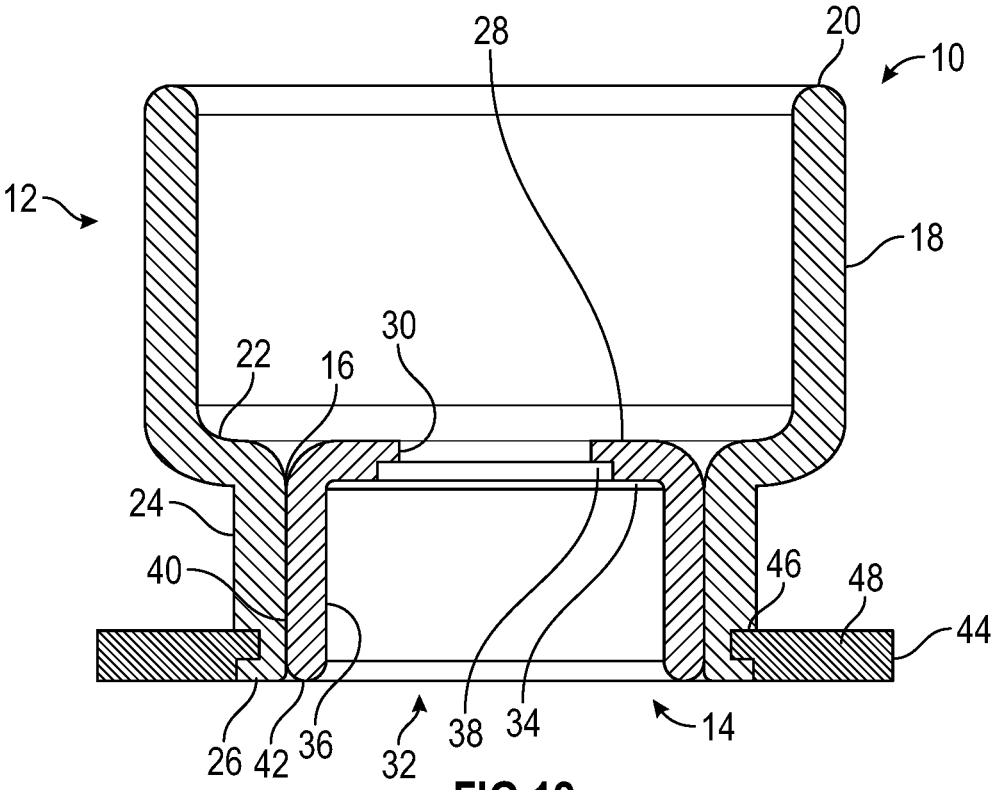
FIG. 12 is a cut through image of one embodiment of a two piece primer insert having a separate extraction flange.
Figure 13:
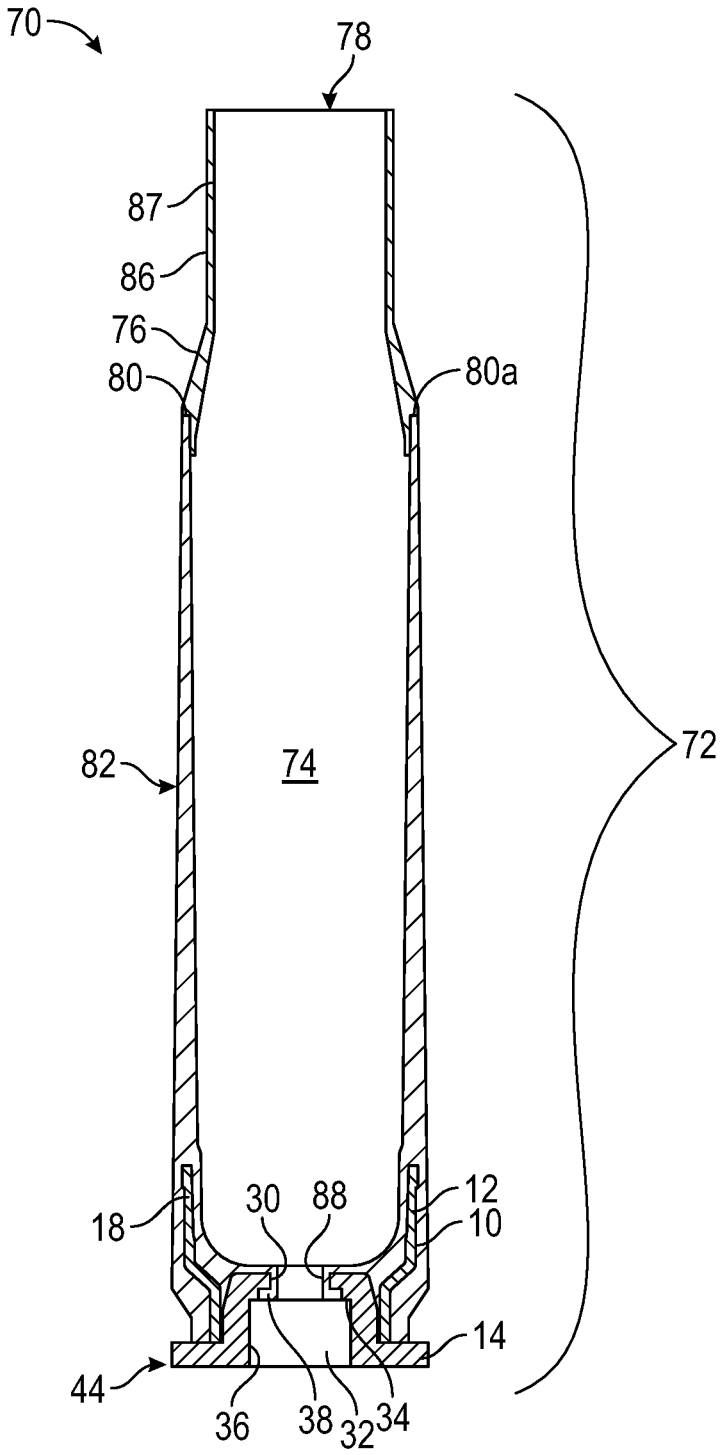
FIGS. 13, 14B, 15B, 16B, 17B, 18B, 19B, 20B, 21B, 24B, 25B, 26 and 27B individually show a side, cross-sectional view of a portion of a polymeric cartridge case having a two piece primer insert.

FIG. 12 is a cut through image of one embodiment of a two piece primer insert having a separate extraction flange. The primer insert 10 is formed by joining a first primer insert portion 12 to a second primer insert portion 14. The primer insert 10 is formed by press-joining the first primer insert portion 12 and the second primer insert portion 14 which forms a insert joint 16. The first primer insert portion 12 may be of the same or different materials than the second primer insert portion 14. The first primer insert portion 12 includes an insert coupling element 18 that extends from an insert tip 20 downward to an insert transition 22. The insert transition 22 transitions from the vertical region of the insert tip 20 to a horizontal region. The insert transition 22 is in communication with the first primer insert portion joining region 24 that extends to the first primer insert portion bottom 26. The first primer insert portion joining region 24 and the first primer insert portion bottom 26 are in pressed contact with the second primer insert portion 14 to form the insert joint 16. The first primer insert portion bottom 26 includes an extraction flange ring notch 46 positioned in the lower portion of the first primer insert portion bottom 26 to accept an extraction flange 44. The extraction flange 44 includes an extraction flange tab 48 that mates to the extraction flange ring notch 46 to secure the extraction flange 44 to the primer insert 10 at the desired location. The second primer insert portion 14 includes an inner surface 28 that when overmolded into an ammunition cartridge (not shown) forms the bottom of the propellant chamber (not shown). The inner surface 28 includes a primer flash aperture 30 that extends through the inner surface 28 into the primer recess 32. The primer recess 32 includes a primer pocket bottom surface 34 and a primer pocket side walls 36. The primer recess 32 is adapted to fit a primer (not shown) and to allow the primer to transmit through the primer flash aperture 30. The primer pocket bottom surface 34 includes a flash aperture groove 38 that extends around the primer flash aperture 30. The flash aperture groove 38 may extend across the primer recess bottom surface 34 covering any distance from the primer flash aperture 30 to the primer recess side walls 36. For example, the flash aperture groove 38 may be about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 32, 34, 36, 38, 40, 42, 44, 46, 48, 50, 52, 54, 56, 58, 60, 62, 64, 66, 68, 70, 72, 74, 76, 78, 80, 82, 84, 86, 88, 90, 92, 94, 96, 98, or even 100 percent of the distance from the primer flash aperture 30 to the primer recess side walls 36. The primer recess side walls 36 is opposite the second primer insert portion joining region 40. The second primer insert portion joining region 40 is in pressed contact with the first primer insert portion joining region 24 to form the insert joint 16 that is in pressed contact to retain the joining of the first primer insert portion 12 and the second primer insert portion 14. The second primer insert portion 14 includes a transition from the primer recess 32 to the outer surface 42.

FIGS. 13, 14B, 15B, 16B, 17B, 18B, 19B, 20B, 21B, 24B, 25B, 26 and 27B individually show a side, cross-sectional view of a portion of a polymeric cartridge case having a two piece primer insert. A cartridge 70 is shown manufactured with a polymer casing 72 showing a propellant chamber 74 with projectile aperture at the nose 76. The polymer casing 72 has a projectile aperture 78 extending from nose 76 rearward. The nose 76 may be formed with the nose joint 80 that mates to the middle body 82 through contact with the nose joint 80 and the body joint 84. Alternatively, the nose joint 80 and the body joint 84 may be positioned at different locations (e.g., nose joint 80*a*) on the nose depending on the specific application. The nose joint 80 and body joint 84 is shown as a male-female element, but may also be configured as other joints in alternate embodiments. The nose 76 has a shoulder 86 that is reduced to a chamber neck 87 to accommodate the projectile aperture 78. The nose 76 typically has a wall thickness between about 0.003 and about 0.200 inches; more preferably between about 0.005 and about 0.150; and more preferably between about 0.010 and about 0.050 inches. The middle body 82 is overmolded over the primer insert 10. The primer insert 10 is formed by joining a first primer insert portion 12 to a second primer insert portion 14. The insert coupling element 18, as shown is configured as a male element, however, all combinations of male and female configurations is acceptable as are variations in the height of the insert coupling element 18. The middle body 82 is molded and extends over the insert coupling element 18 and over the inner surface 28 into the primer flash aperture 30 to the flash aperture groove 38 forming a flash hole 88. A flash hole 88 is located in the primer recess 32 and extends through the bottom surface 34 into the propellant chamber 74. The polymer extends through the flash aperture groove 38 to form an aperture coating while retaining a passage to provide support and protection about the primer flash hole 88. The middle body 82 typically has a wall thickness between about 0.003 and about 0.200 inches; and more preferably between about 0.005 and about 0.150 inches; and more preferably between about 0.010 and about 0.050 inches. The nose 76 and nose 76 define the interior of propellant chamber 74 in which the powder charge (not shown) is contained. The interior volume of the propellant chamber 74 may be varied to provide the volume necessary for complete filling of the propellant chamber 74 by the propellant chosen so that a simplified volumetric measure of propellant can be utilized when loading the cartridge. Either a particulate or consolidated propellant can be used. The primer flash hole 88 communicates with the propellant chamber 74 so that upon detonation of primer (not shown) the powder (not shown) in propellant chamber 74 will be ignited. The projectile (not shown) is held in place within chamber case neck 87 at the projectile aperture 78 by an interference fit or adhesive. Mechanical crimping of the projectile aperture 78 can also be applied to increase the bullet pull force holding the bullet (not shown) in place. The bullet (not shown) may be inserted into place following the completion of the filling of propellant chamber 74. An optional first and second annular groove (cannelures) may be provided in the bullet-end in the interlock surface of the male coupling element to provide a snap-fit between the two components. The projectile (not shown) can also be retained through welding or bonding together using solvent, adhesive, spin-welding, vibration-welding, ultrasonic-welding or laser-welding techniques. The welding or bonding increases the joint strength so the casing can be extracted from the hot gun casing after firing at the cook-off temperature. The nose 76 and middle body 82 can then be welded or bonded together using solvent, adhesive, spin-welding, vibration-welding, ultrasonic-welding or laser-welding techniques. The welding or bonding increases the joint strength so the casing can be extracted from the hot gun casing after firing at the cook-off temperature.

FIGS. 14A, 15A, 16A, 17A, 18A, 19A, 20A, 21A, 22A, 24A, 25A and 27A are cut through images of one embodiment of a two piece primer insert having a support structure. FIGS. 14A, 15A, 16A, 17A, 18A, 19A, 20A, 21A, 22A, 24A, 25A and 27A individually show a primer insert 10 is formed by joining a first primer insert portion 12 to a second primer insert portion 14. The primer insert 10 is formed by press joining the first primer insert portion 12 and the second primer insert portion 14 which forms a insert joint 16. The first primer insert portion 12 may be of the same or different materials than the second primer insert portion 14. The first primer insert portion 12 includes an insert coupling element 18 that extends from an insert tip 20 downward to an insert transition 22. The insert transition 22 transitions from the vertical region of the insert tip 20 to a horizontal region. The insert transition 22 is in communication with the first primer insert portion joining region 24 that extends to the first primer insert portion bottom 26. The first primer insert portion joining region 24 and the first primer insert portion bottom 26 are in pressed contact with the second primer insert portion 14 to form the insert joint 16. The second primer insert portion 14 includes an inner surface (not shown) that when overmolded into an ammunition cartridge (not shown) forms the bottom of the propellant chamber (not shown). The inner surface 28 includes a primer flash aperture 30 that extends through the inner surface 28 into the primer recess 32. The primer recess 32 includes a primer pocket bottom surface 34 and a primer pocket side walls 36. The primer recess 32 is adapted to fit a primer (not shown) and allow the primer to transmit through the primer flash aperture 30. The primer pocket bottom surface 34 includes a flash aperture groove 38 that extends around the primer flash aperture 30. The flash aperture groove 38 may extend across the primer recess bottom surface 34 covering any distance from the primer flash aperture 30 to the primer recess side walls 36. For example, the flash aperture groove 38 may be about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 32, 34, 36, 38, 40, 42, 44, 46, 48, 50, 52, 54, 56, 58, 60, 62, 64, 66, 68, 70, 72, 74, 76, 78, 80, 82, 84, 86, 88, 90, 92, 94, 96, 98, or even 100 percent of the distance from the primer flash aperture 30 to the primer recess side walls 36. The primer recess side walls 36 is opposite the second primer insert portion joining region 40. The second primer insert portion joining region 40 is in pressed contact with the first primer insert portion joining region 24 to form the insert joint 16 that is in pressed contact to retain the joining of the first primer insert portion 12 and the second primer insert portion 14. The second primer insert portion 14 includes a transition from the primer recess 32 to the outer surface 42 that extends to an extraction flange 44.

Figure 14A:
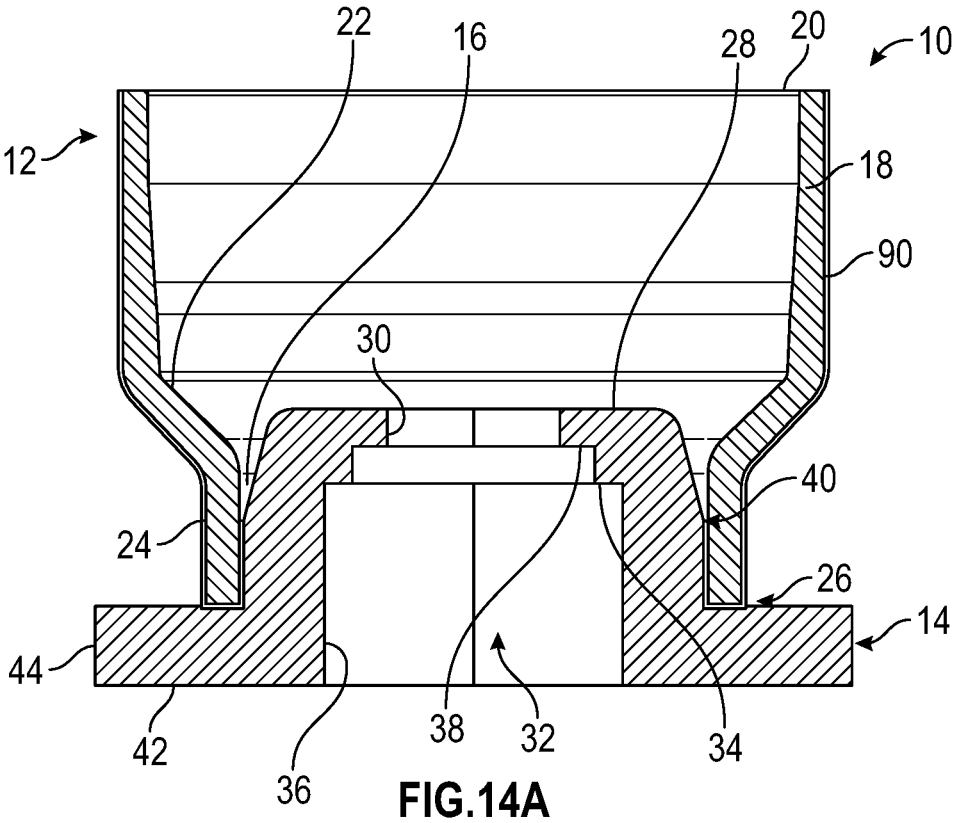
FIGS. 14A, 15A, 16A, 17A, 18A, 19A, 20A, 21A, 22A, 24A, 25A and 27A are cut through images of one embodiment of a two piece primer insert having a support structure.

FIG. 14A shows a primer insert 10 having the first primer insert portion 12 joined to the second primer insert portion 14 at insert joint 16 with the support structure 90 positioned on the outer surface of the first primer insert portion 12. The support structure 90 may be formed to approximate the exterior wall. The support structure 90 may extend over at least a portion of the outer surface of the first primer insert portion 12 and even extend past the insert tip 20. The support structure 90 may be at least about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 32, 34, 36, 38, 40, 42, 44, 46, 48, 50, 52, 54, 56, 58, 60, 62, 64, 66, 68, 70, 72, 74, 76, 78, 80, 82, 84, 86, 88, 90, 92, 94, 96, 98, or even 100 percent of the height of the outer surface of the first primer insert portion 12. Similarly, the support structure 90 may extend at least about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 32, 34, 36, 38, 40, 42, 44, 46, 48, 50, 52, 54, 56, 58, 60, 62, 64, 66, 68, 70, 72, 74, 76, 78, 80, 82, 84, 86, 88, 90, 92, 94, 96, 98, or even 100 percent higher than the outer surface of the first primer insert portion 12.

Figure 14B:
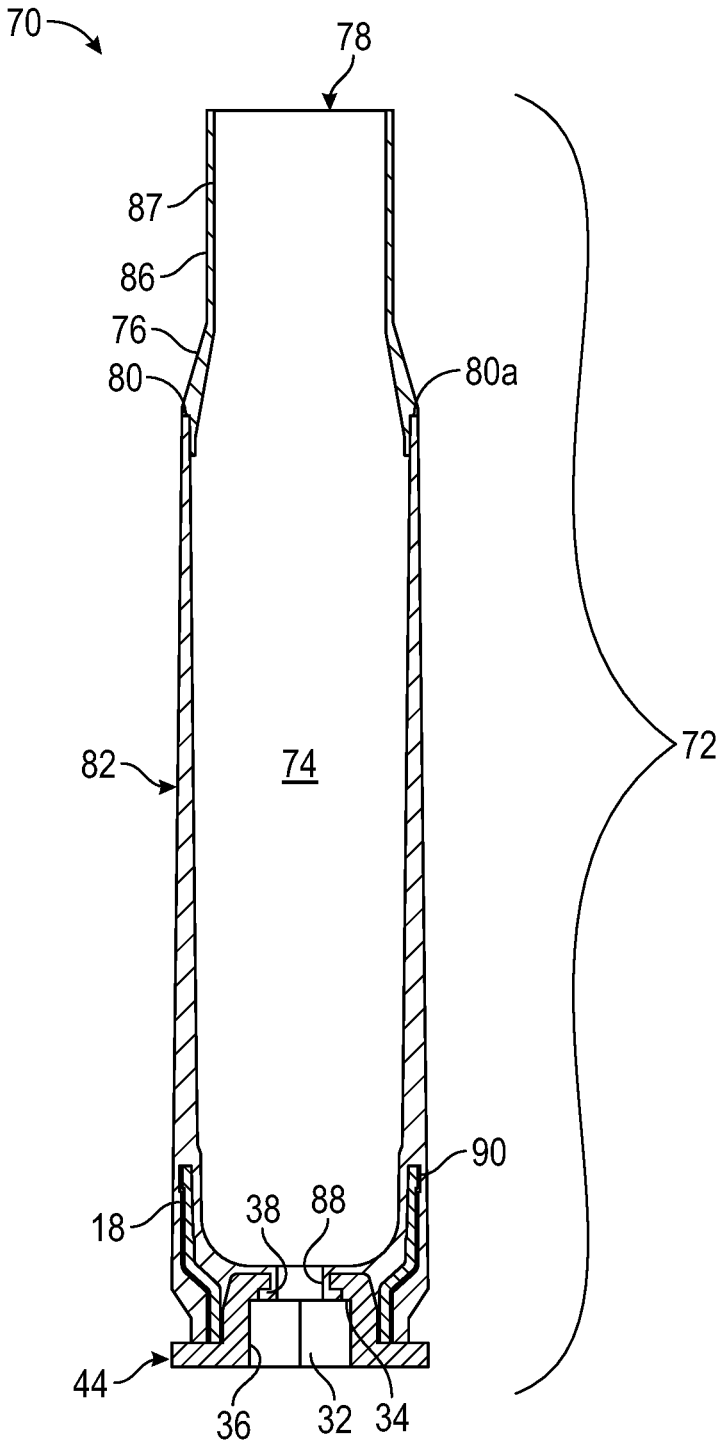

FIG. 14B shows a side, cross-sectional view of a portion of a polymeric cartridge case overmolding a two piece primer insert having the first primer insert portion 12 joined to the second primer insert portion 14 at insert joint 16 with the support structure 90 positioned on the outer surface of the first primer insert portion 12. The support structure 90 may be formed to approximate the exterior wall.

Figure 15A:
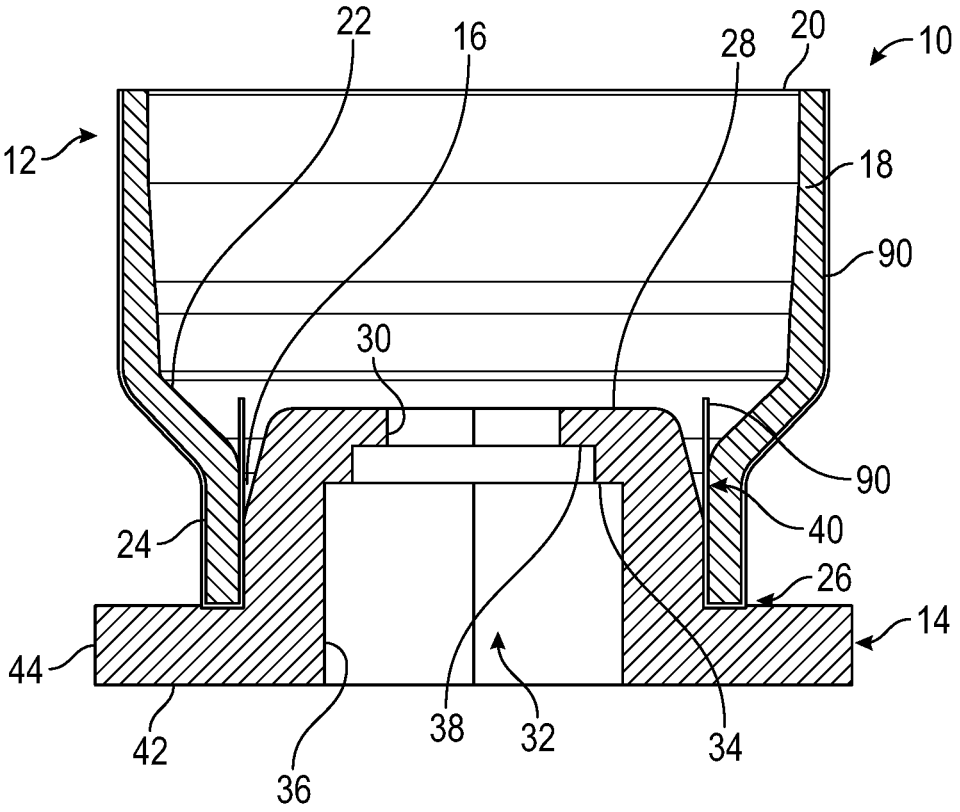

FIG. 15A shows a primer insert 10 having the first primer insert portion 12 joined to the second primer insert portion 14 with the support structure 90 positioned on the outer surface of the first primer insert portion 12 and extending into the insert joint 16. The support structure 90 may extend into the insert joint 16 to any degree necessary including into the inner surface 28. The support structure 90 may be formed to approximate the exterior wall or may have a general shape.

Figure 15B:
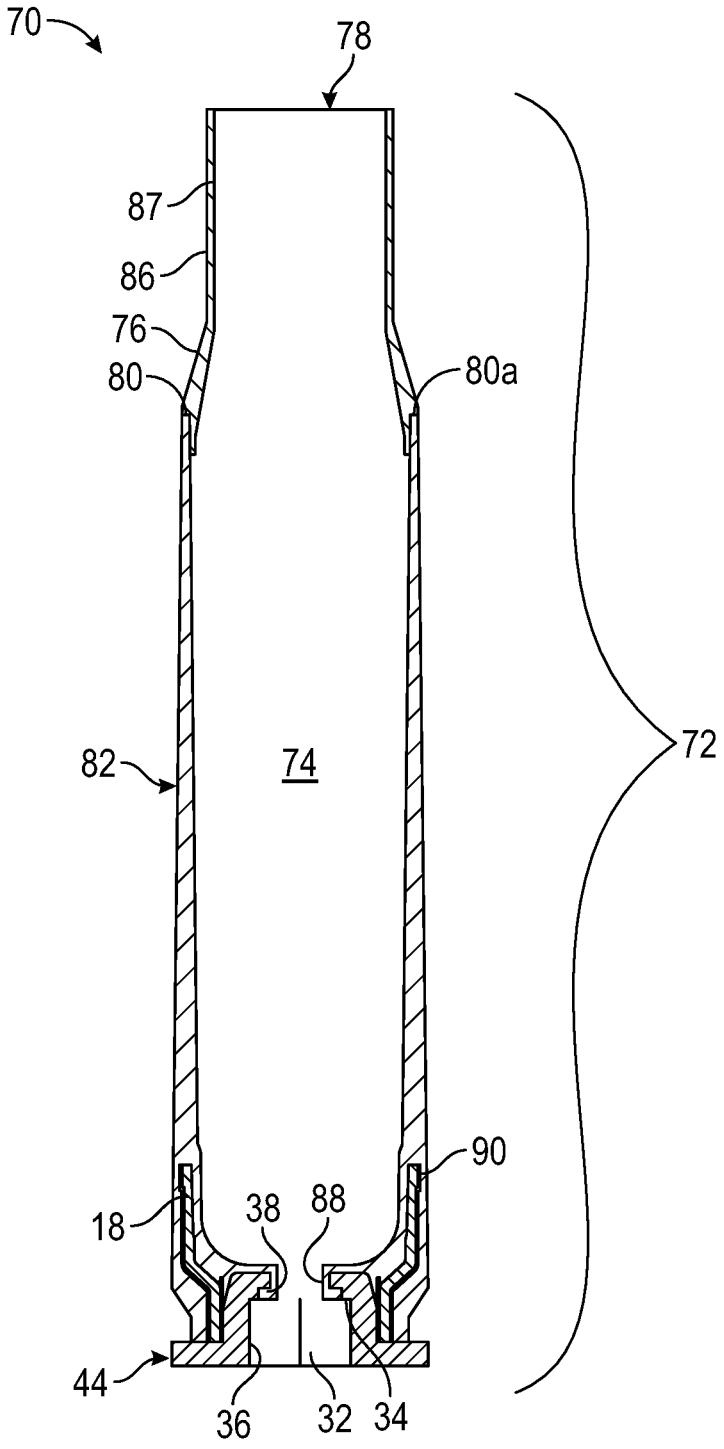

FIG. 15B shows a side, cross-sectional view of a portion of a polymeric cartridge case overmolding a primer insert 10 having the first primer insert portion 12 joined to the second primer insert portion 14 with the support structure 90 positioned on the outer surface of the first primer insert portion 12 and extending into the insert joint 16. The support structure 90 may extend into the insert joint 16 to any degree necessary including into the inner surface 28. The support structure 90 may be formed to approximate the exterior wall or may have a general shape.

Figure 16A:
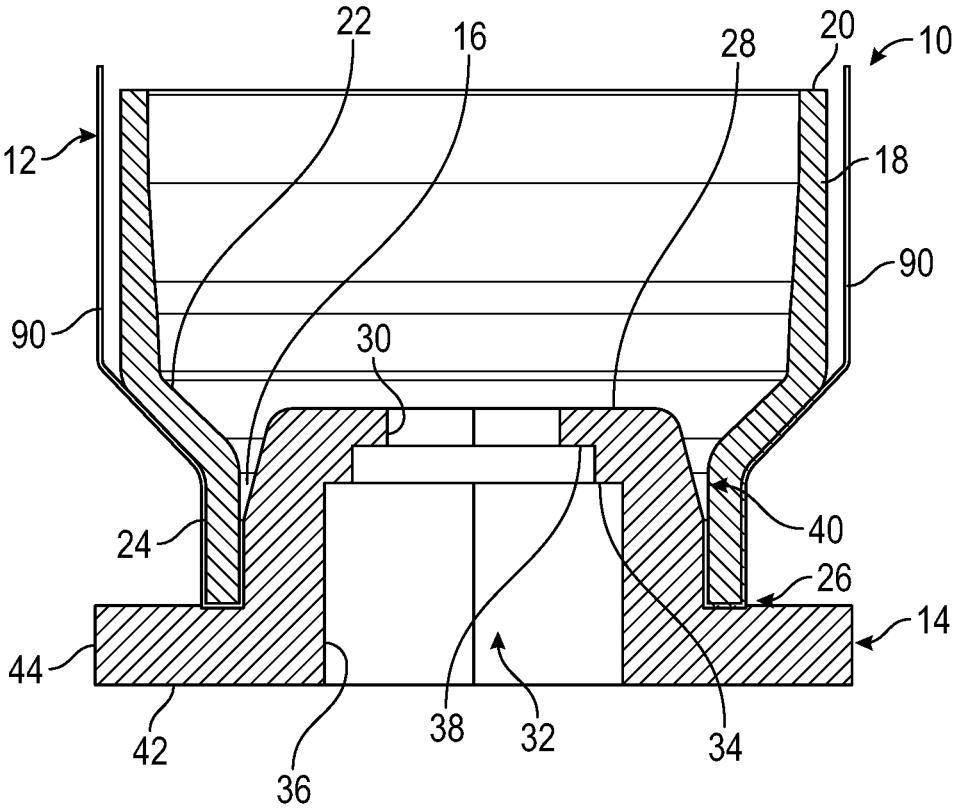

FIG. 16A shows a primer insert 10 having the first primer insert portion 12 joined to the second primer insert portion 14 with the support structure 90 positioned on the outer surface of the first primer insert portion 12. The support structure 90 may be formed to have a general shape. The support structure 90 may be at least about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 32, 34, 36, 38, 40, 42, 44, 46, 48, 50, 52, 54, 56, 58, 60, 62, 64, 66, 68, 70, 72, 74, 76, 78, 80, 82, 84, 86, 88, 90, 92, 94, 96, 98, or even 100 percent of the height of the outer surface of the first primer insert portion 12. Similarly, the support structure 90 may extend at least about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 32, 34, 36, 38, 40, 42, 44, 46, 48, 50, 52, 54, 56, 58, 60, 62, 64, 66, 68, 70, 72, 74, 76, 78, 80, 82, 84, 86, 88, 90, 92, 94, 96, 98, or even 100 percent higher than the outer surface of the first primer insert portion 12.

Figure 16B:
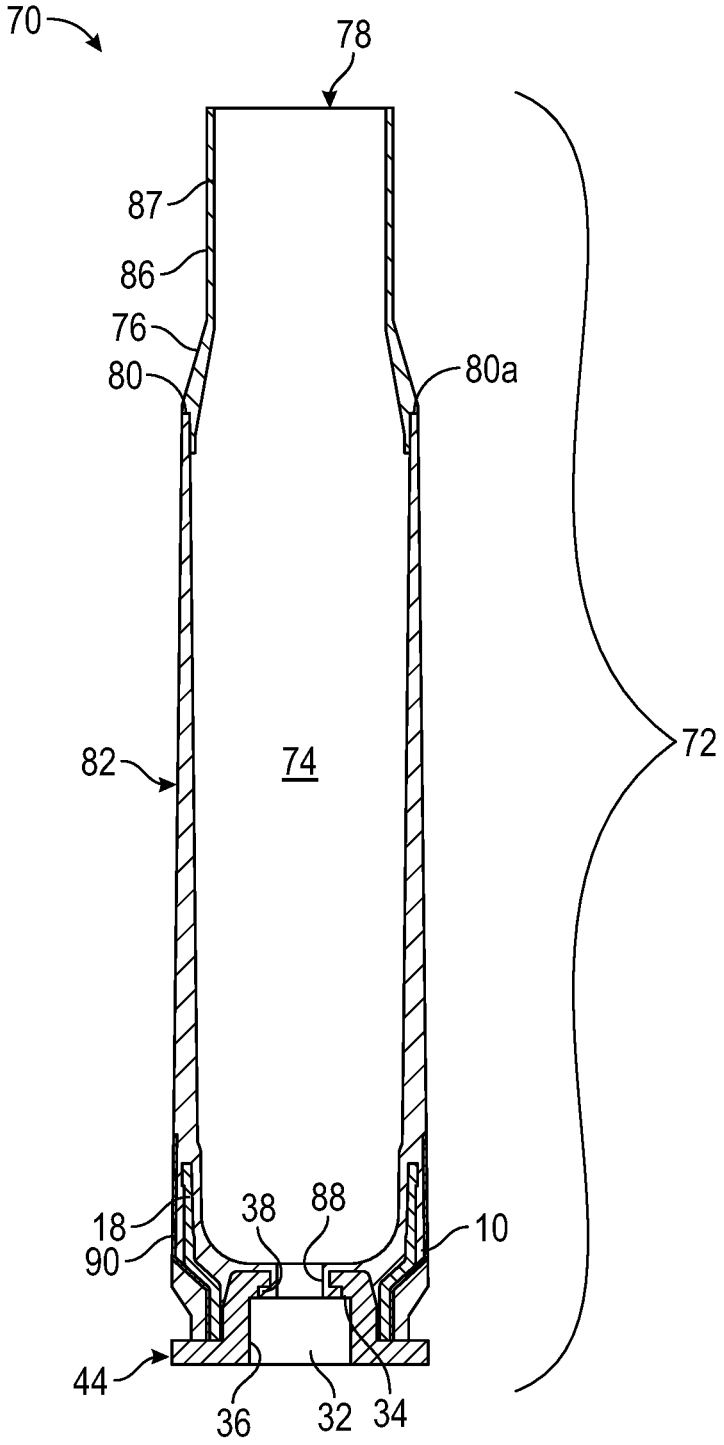

FIG. 16B shows a side, cross-sectional view of a portion of a polymeric cartridge case overmolding a primer insert 10 having the first primer insert portion 12 joined to the second primer insert portion 14 with the support structure 90 positioned on the outer surface of the first primer insert portion 12. The support structure 90 may be formed to have a general shape.

Figure 17A:
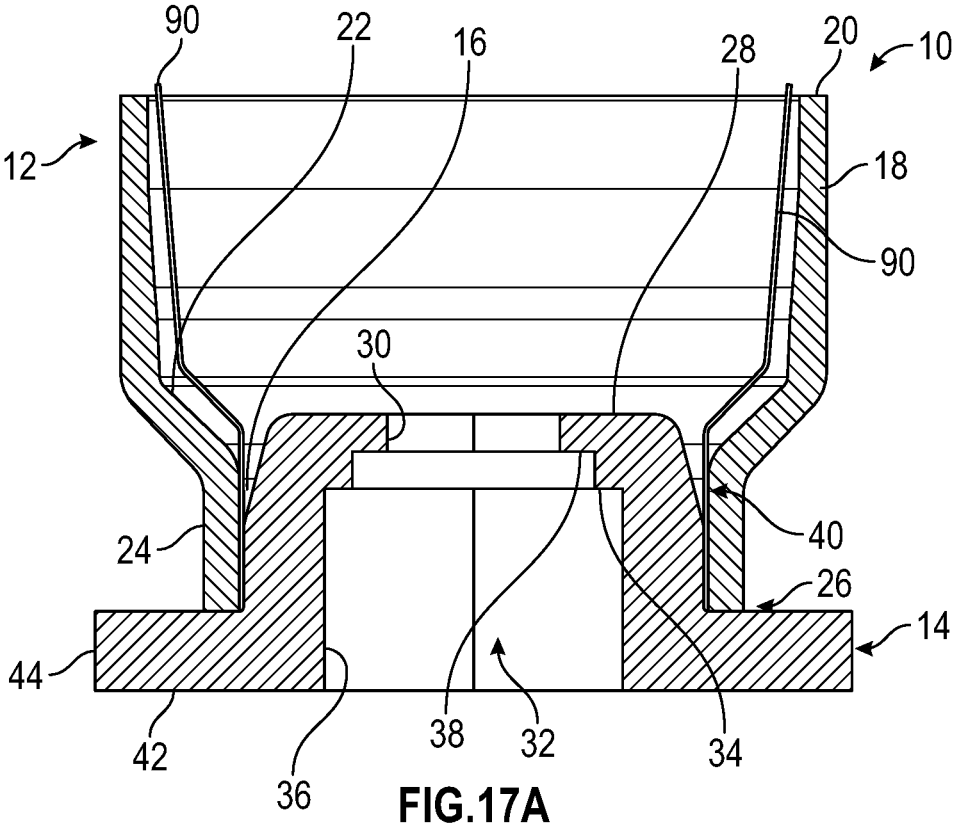

FIG. 17A shows a primer insert 10 having the first primer insert portion 12 joined to the second primer insert portion 14 with the support structure 90 positioned on the outer surface of the first primer insert portion 12 and extending into the insert joint 16. The support structure 90 may extend into the insert joint 16 and into the interior surface of the first primer insert portion 12. The support structure 90 may be of any height extending under the insert tip 20 (not shown) or above the insert tip 20 as shown. The support structure 90 may be formed to approximate the interior wall or may have a general shape. The support structure 90 may be at least about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 32, 34, 36, 38, 40, 42, 44, 46, 48, 50, 52, 54, 56, 58, 60, 62, 64, 66, 68, 70, 72, 74, 76, 78, 80, 82, 84, 86, 88, 90, 92, 94, 96, 98, or even 100 percent of the height of the inner surface of the first primer insert portion 12. Similarly, the support structure 90 may extend at least about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 32, 34, 36, 38, 40, 42, 44, 46, 48, 50, 52, 54, 56, 58, 60, 62, 64, 66, 68, 70, 72, 74, 76, 78, 80, 82, 84, 86, 88, 90, 92, 94, 96, 98, or even 100 percent higher than the inner surface of the first primer insert portion 12.

Figure 17B:
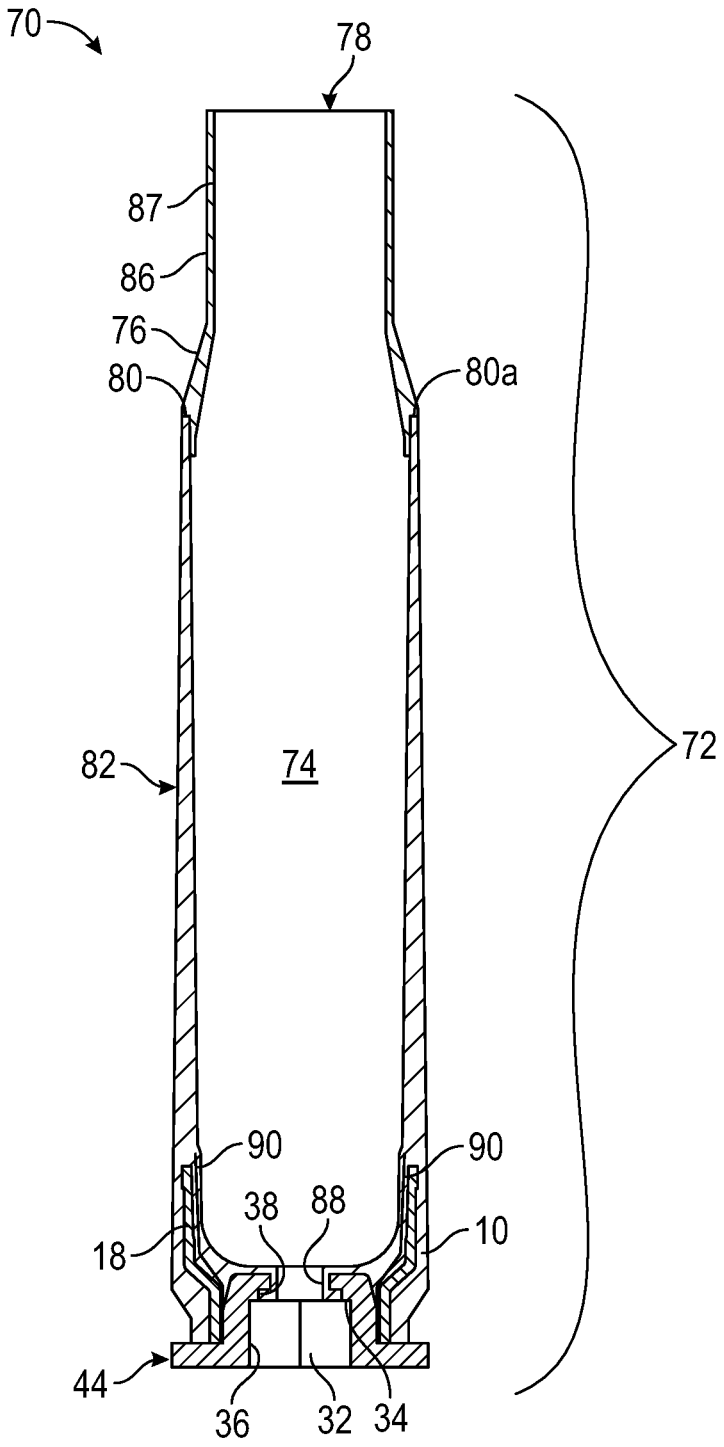

FIG. 17B shows a side, cross-sectional view of a portion of a polymeric cartridge case overmolding a primer insert 10 having the first primer insert portion 12 joined to the second primer insert portion 14 with the support structure 90 positioned on the outer surface of the first primer insert portion 12 and extending into the insert joint 16. The support structure 90 may extend into the insert joint 16 and into the interior surface of the first primer insert portion 12. The support structure 90 may be of any height extending under the insert tip 20 (not shown) or above the insert tip 20 as shown. The support structure 90 may be formed to approximate the interior wall or may have a general shape.

Figure 18A:
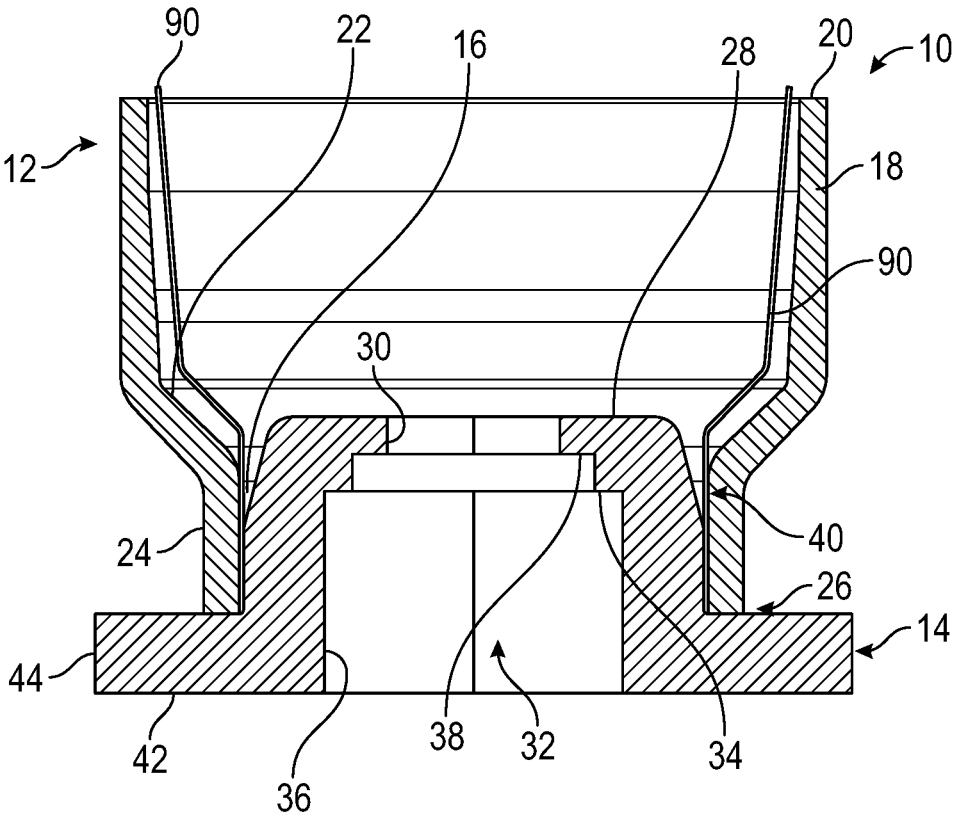

FIG. 18A shows a primer insert 10 having the first primer insert portion 12 joined to the second primer insert portion 14 at insert joint 16 with the support structure 90 positioned in the insert joint 16 and extending into the interior of the first primer insert portion 12 toward the insert tip 20. The support structure 90 may extend into the insert joint 16 any degree necessary to secure the support structure 90 to the primer insert 10. The support structure 90 may be of any height extending under the insert tip 20 (not shown) or above the insert tip 20 as shown. The support structure 90 may be at least about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 32, 34, 36, 38, 40, 42, 44, 46, 48, 50, 52, 54, 56, 58, 60, 62, 64, 66, 68, 70, 72, 74, 76, 78, 80, 82, 84, 86, 88, 90, 92, 94, 96, 98, or even 100 percent of the height of the outer surface of the first primer insert portion 12. Similarly, the support structure 90 may extend at least about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 32, 34, 36, 38, 40, 42, 44, 46, 48, 50, 52, 54, 56, 58, 60, 62, 64, 66, 68, 70, 72, 74, 76, 78, 80, 82, 84, 86, 88, 90, 92, 94, 96, 98, or even 100 percent higher than the outer surface of the first primer insert portion 12. The support structure 90 may be formed to approximate the interior wall.

Figure 18B:
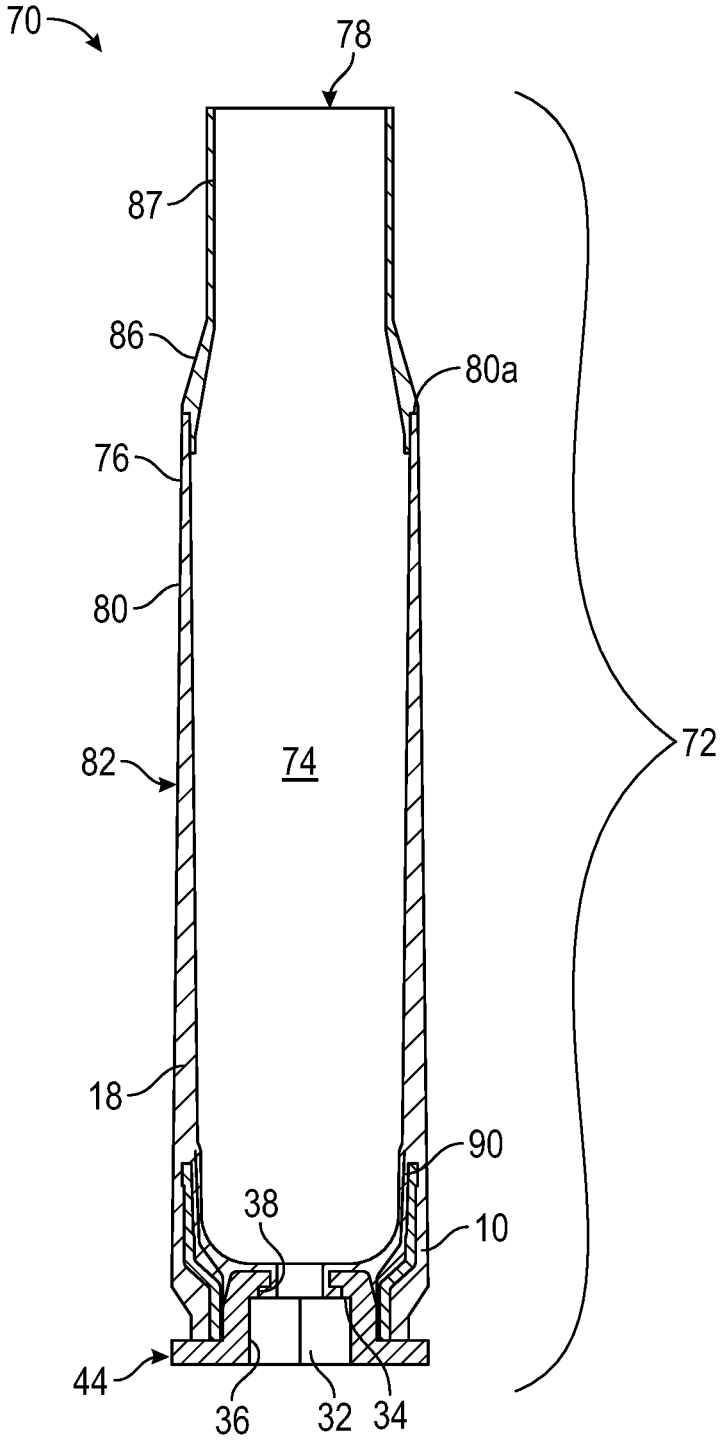

FIG. 18B shows a side, cross-sectional view of a portion of a polymeric cartridge case overmolding a primer insert 10 having the first primer insert portion 12 joined to the second primer insert portion 14 at insert joint 16 with the support structure 90 positioned in the insert joint 16 and extending into the interior of the first primer insert portion 12 toward the insert tip 20. The support structure 90 may extend into the insert joint 16 any degree necessary to secure the support structure 90 to the primer insert 10. The support structure 90 may be of any height extending under the insert tip 20 (not shown) or above the insert tip 20 as shown. The support structure 90 may be formed to approximate the interior wall.

Figure 19A:
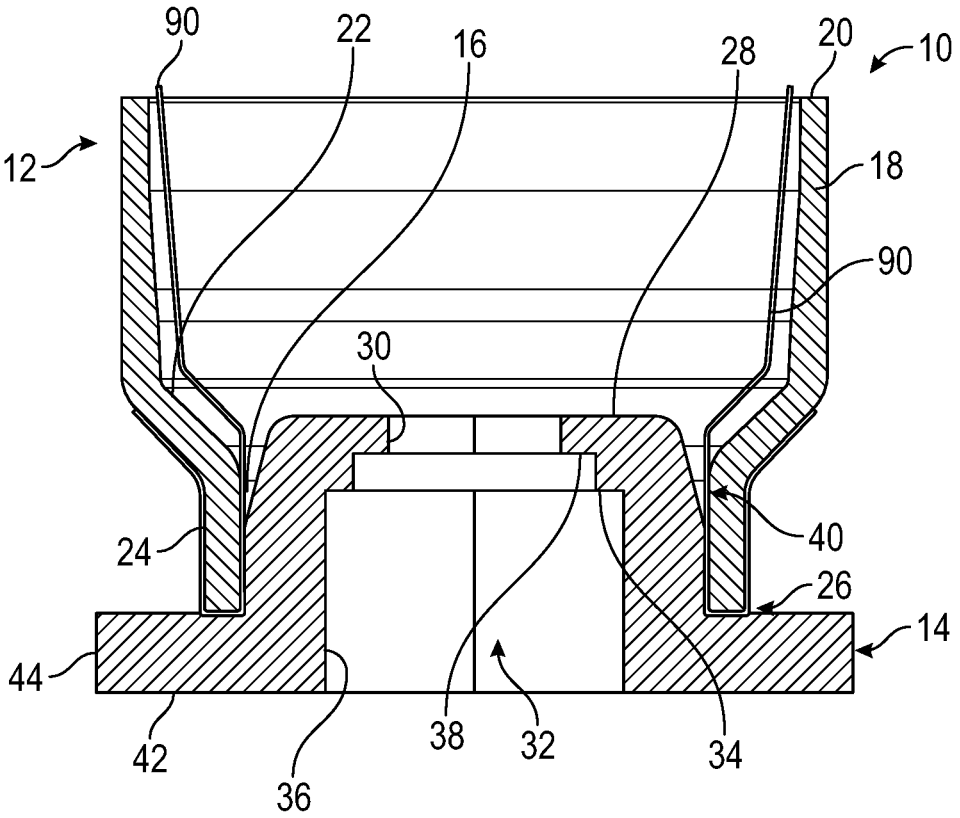

FIG. 19A shows a primer insert 10 having the first primer insert portion 12 joined to the second primer insert portion 14 with the support structure 90 positioned on the outer surface of the first primer insert portion 12 and extending into the insert joint 16. The support structure 90 extends up a portion of the exterior wall of the first primer insert portion 12. The support structure 90 may extend into the insert joint 16 and into the interior surface of the first primer insert portion 12. The support structure 90 may be of any height extending under the insert tip 20 (not shown) or above the insert tip 20 as shown. The support structure 90 may be at least about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 32, 34, 36, 38, 40, 42, 44, 46, 48, 50, 52, 54, 56, 58, 60, 62, 64, 66, 68, 70, 72, 74, 76, 78, 80, 82, 84, 86, 88, 90, 92, 94, 96, 98, or even 100 percent of the height of the outer surface of the first primer insert portion 12. Similarly, the support structure 90 may extend at least about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 32, 34, 36, 38, 40, 42, 44, 46, 48, 50, 52, 54, 56, 58, 60, 62, 64, 66, 68, 70, 72, 74, 76, 78, 80, 82, 84, 86, 88, 90, 92, 94, 96, 98, or even 100 percent higher than the outer surface of the first primer insert portion 12. The support structure 90 may be formed to approximate the exterior wall or may have a general shape.

Figure 19B:
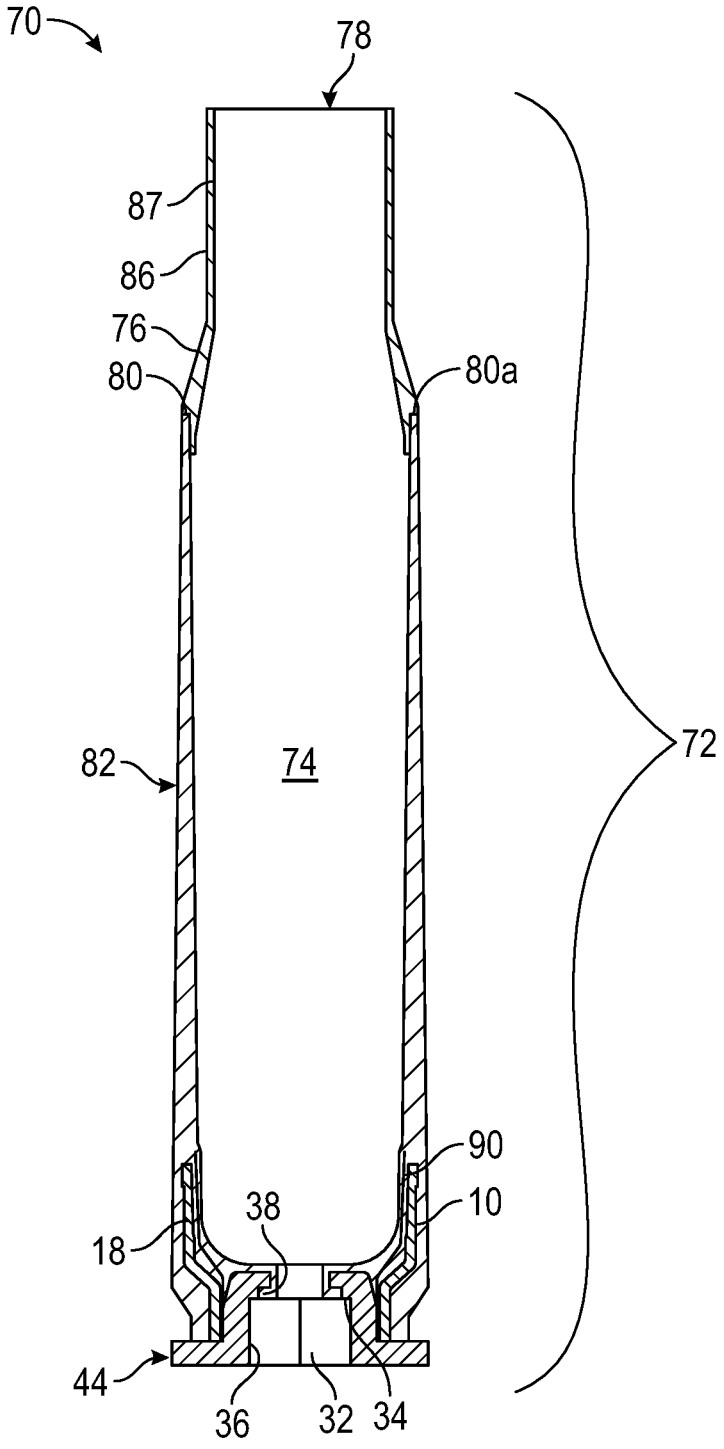

FIG. 19B shows a side, cross-sectional view of a portion of a polymeric cartridge case overmolding a primer insert 10 having the first primer insert portion 12 joined to the second primer insert portion 14 with the support structure 90 positioned on the outer surface of the first primer insert portion 12 and extending into the insert joint 16. The support structure 90 extends up a portion of the exterior wall of the first primer insert portion 12. The support structure 90 may extend into the insert joint 16 and into the interior surface of the first primer insert portion 12. The support structure 90 may be of any height extending under the insert tip 20 (not shown) or above the insert tip 20 as shown. The support structure 90 may be formed to approximate the exterior wall or may have a general shape.

Figure 20A:
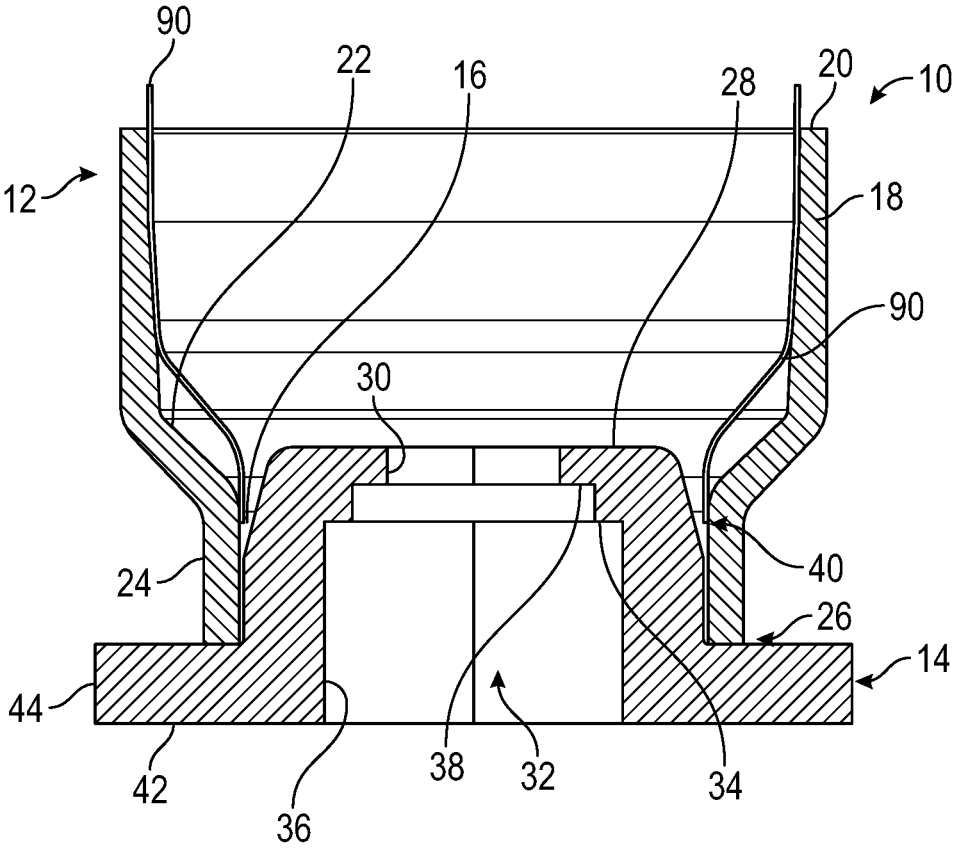

FIG. 20A shows a primer insert 10 having the first primer insert portion 12 joined to the second primer insert portion 14 at insert joint 16 with the support structure 90 positioned in the insert joint 16 and extending into the interior of the first primer insert portion 12 toward the insert tip 20. The support structure 90 may extend into the insert joint 16 any degree necessary to secure the support structure 90 to the primer insert 10. The support structure 90 may be of any height extending under the insert tip 20 (not shown) or above the insert tip 20 as shown. The support structure 90 may be at least about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 32, 34, 36, 38, 40, 42, 44, 46, 48, 50, 52, 54, 56, 58, 60, 62, 64, 66, 68, 70, 72, 74, 76, 78, 80, 82, 84, 86, 88, 90, 92, 94, 96, 98, or even 100 percent of the height of the outer surface of the first primer insert portion 12. Similarly, the support structure 90 may extend at least about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 32, 34, 36, 38, 40, 42, 44, 46, 48, 50, 52, 54, 56, 58, 60, 62, 64, 66, 68, 70, 72, 74, 76, 78, 80, 82, 84, 86, 88, 90, 92, 94, 96, 98, or even 100 percent higher than the outer surface of the first primer insert portion 12. The support structure 90 may be formed to approximate the interior wall.

Figure 20B:
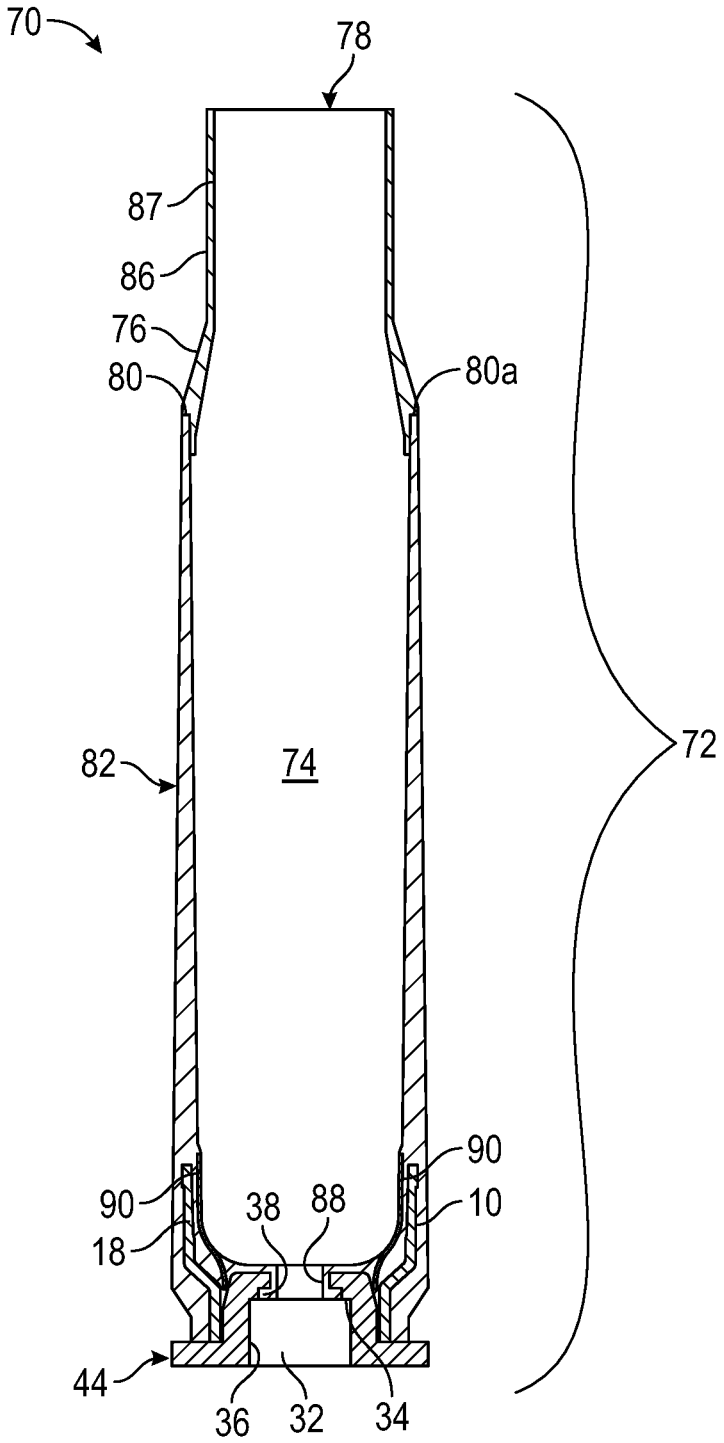

FIG. 20B shows a side, cross-sectional view of a portion of a polymeric cartridge case overmolding a primer insert 10 having the first primer insert portion 12 joined to the second primer insert portion 14 at insert joint 16 with the support structure 90 positioned in the insert joint 16 and extending into the interior of the first primer insert portion 12 toward the insert tip 20. The support structure 90 may extend into the insert joint 16 any degree necessary to secure the support structure 90 to the primer insert 10. The support structure 90 may be of any height extending under the insert tip 20 (not shown) or above the insert tip 20 as shown. The support structure 90 may be formed to approximate the interior wall.

Figure 21A:
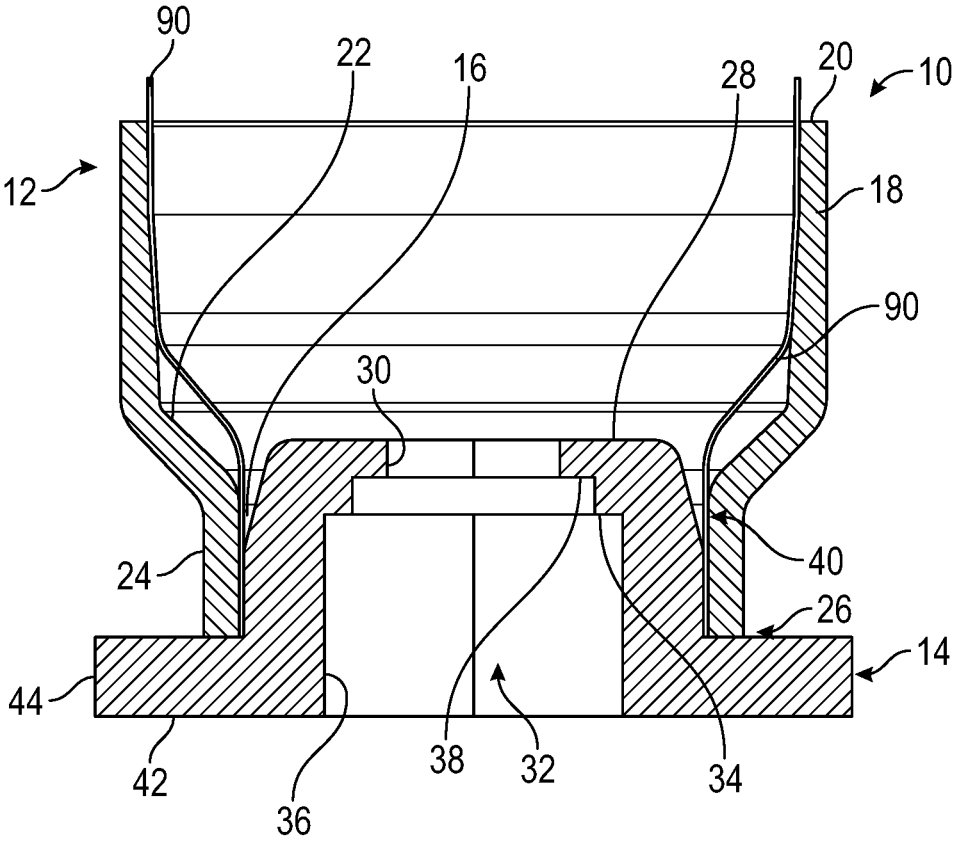
Figure 21B:
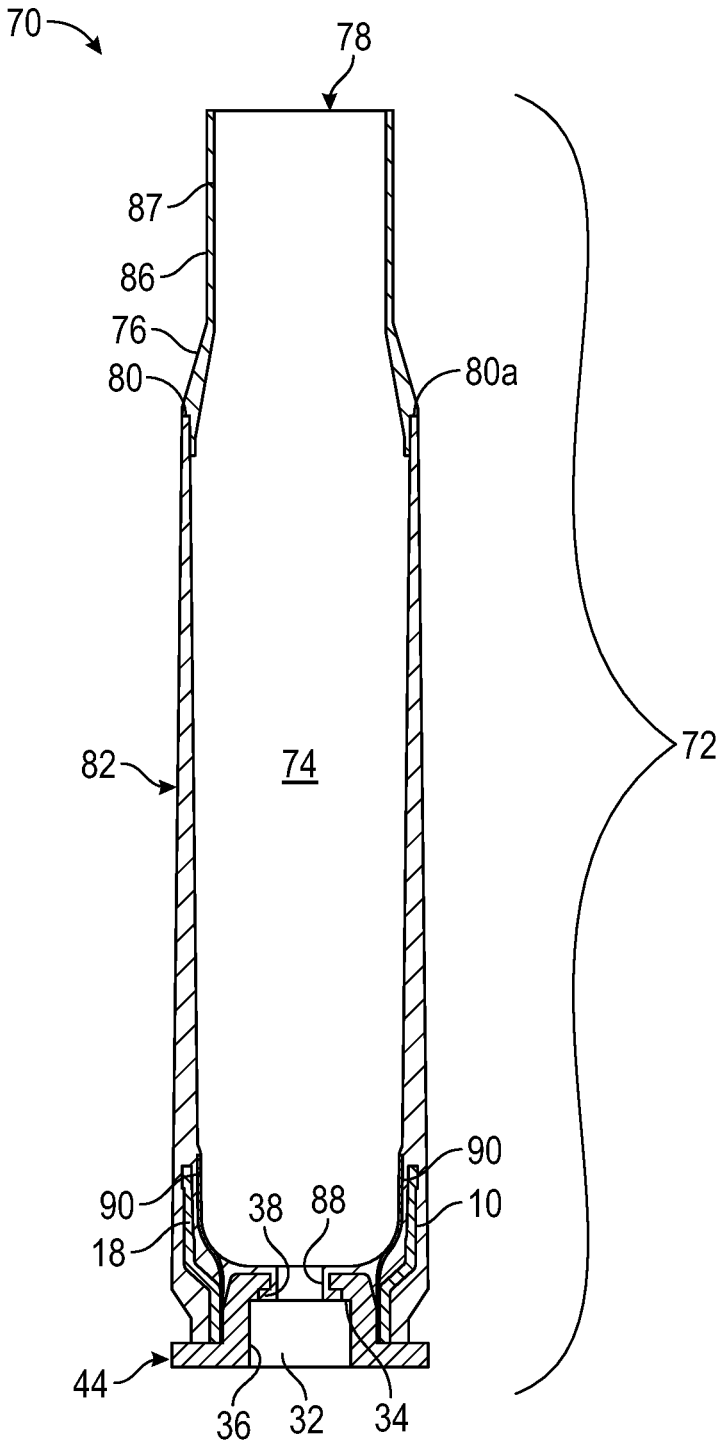

FIGS. 21A (insert) and 21B (overmolded into an ammunition cartridge) shows a primer insert 10 having the first primer insert portion 12 joined to the second primer insert portion 14 at insert joint 16 with the support structure 90 secured in the junction of the first primer insert portion 12 and the second primer insert portion 14 without being inserted into the insert joint 16. The support structure 90 is positioned at the insert joint 16 and extending into the interior of the first primer insert portion 12 toward the insert tip 20. The support structure 90 may be of any height extending under the insert tip 20 (not shown) or above the insert tip 20 as shown. The support structure 90 may be formed to approximate the interior wall. The support structure 90 may be secured through the addition of an adhesive, resin, metal, alloy, composite or polymer material that is placed in at the insert joint 16 junction of the first primer insert portion 12 and the second primer insert portion 14 to secure the support structure 90. In other embodiments, the support structure 90 may be lose or secured by physically attaching the support structure 90 to the insert joint 16, the first primer insert portion 12, the second primer insert portion 14 or a combination thereof. This may be through welding, melting, fusing or other methods known to the skilled artisan. In yet other embodiments the support structure 90 may be secured to the insert joint 16, the first primer insert portion 12, the second primer insert portion 14 or a combination thereof through the addition of a securing mechanism, e.g., snap ring, clip, ring, tab etc. In another embodiment, the support structure 90 may be secured by pressing a portion of the insert joint 16, the first primer insert portion 12, the second primer insert portion 14 or a combination thereof to retain the support structure 90.

The support structure 90 may be a mesh, weave, a sheet, perforated sheet, a textured sheet, individual fibers, strands, filaments or similar structure. The support structure 90 may be constructed from one or more polymers, one or more metals, one or more alloys or a combination there of. The mesh may be a wire mesh, a polymer mesh, an alloy mesh or a combination thereof. The mesh may be of a significant hole density (i.e., 1 to 800 holes per inch and more specifically at least about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, 100, 101, 102, 103, 104, 105, 106, 107, 108, 109, 110, 111, 112, 113, 114, 115, 116, 117, 118, 119, 120, 121, 122, 123, 124, 125, 126, 127, 128, 129, 130, 131, 132, 133, 134, 135, 136, 137, 138, 139, 140, 141, 142, 143, 144, 145, 146, 147, 148, 149, 150, 151, 152, 153, 154, 155, 156, 157, 158, 159, 160, 161, 162, 163, 164, 165, 166, 167, 168, 169, 170, 171, 172, 173, 174, 175, 176, 177, 178, 179, 180, 181, 182, 183, 184, 185, 186, 187, 188, 189, 190, 191, 192, 193, 194, 195, 196, 197, 198, 199, 200, 201, 202, 203, 204, 205, 206, 207, 208, 209, 210, 211, 212, 213, 214, 215, 216, 217, 218, 219, 220, 221, 222, 223, 224, 225, 226, 227, 228, 229, 230, 231, 232, 233, 234, 235, 236, 237, 238, 239, 240, 241, 242, 243, 244, 245, 246, 247, 248, 249, 250, 251, 252, 253, 254, 255, 256, 257, 258, 259, 260, 261, 262, 263, 264, 265, 266, 267, 268, 269, 270, 271, 272, 273, 274, 275, 276, 277, 278, 279, 280, 281, 282, 283, 284, 285, 286, 287, 288, 289, 290, 291, 292, 293, 294, 295, 296, 297, 298, 299, 300, 301, 302, 303, 304, 305, 306, 307, 308, 309, 310, 311, 312, 313, 314, 315, 316, 317, 318, 319, 320, 321, 322, 323, 324, 325 or more holes per inch). In addition, the mesh may be uniformed or asymmetric in hole positioning. For example, the mesh may have a hole density of around 200 holes per inch at the mesh at the bottom of the insert and about 100 holes per inch at the opposite end of the insert.

In addition, the support structure 90 may be formed, shaped, pressed, pulled, woven into shape or otherwise altered such that the support structure 90 contours to the shape (or roughly approximates the shape) of the insert walls.

The support structure 90 may be loosely placed, frictionally held in the insert, welded into position in or on the insert, affixed to the insert using an adhesive, resin, epoxy, polymer metal, welds, melts, or other material.

Figure 22A:
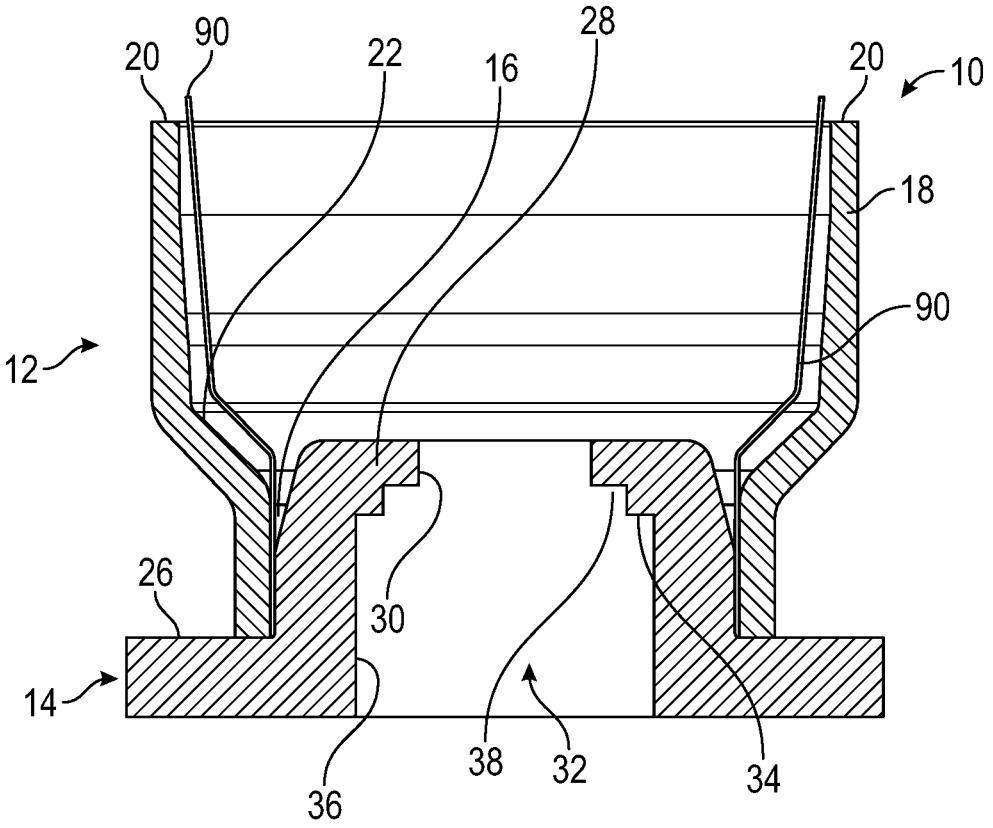

FIG. 22A shows a primer insert 10 having the first primer insert portion 12 joined to the second primer insert portion 14 at insert joint 16 with the support structure 90 extending from the interior surface over the insert tip 20 and down the exterior surface of the first primer insert portion 12. The support structure 90 may extend down at least a portion of the exterior surface of the first primer insert portion 12. In some embodiments the support structure 90 will extend at least to the second primer insert portion 14 but in other embodiments the support structure 90 will extend over at least a portion of the second primer insert portion 14. The support structure 90 may be formed to approximate the wall of the first primer insert portion 12. The support structure 90 may be free moving or secured through the addition of an adhesive, resin, metal, alloy, composite or polymer material that is placed in at the insert joint 16 junction of the first primer insert portion 12 and the second primer insert portion 14 to secure the support structure 90.

Figure 23A:
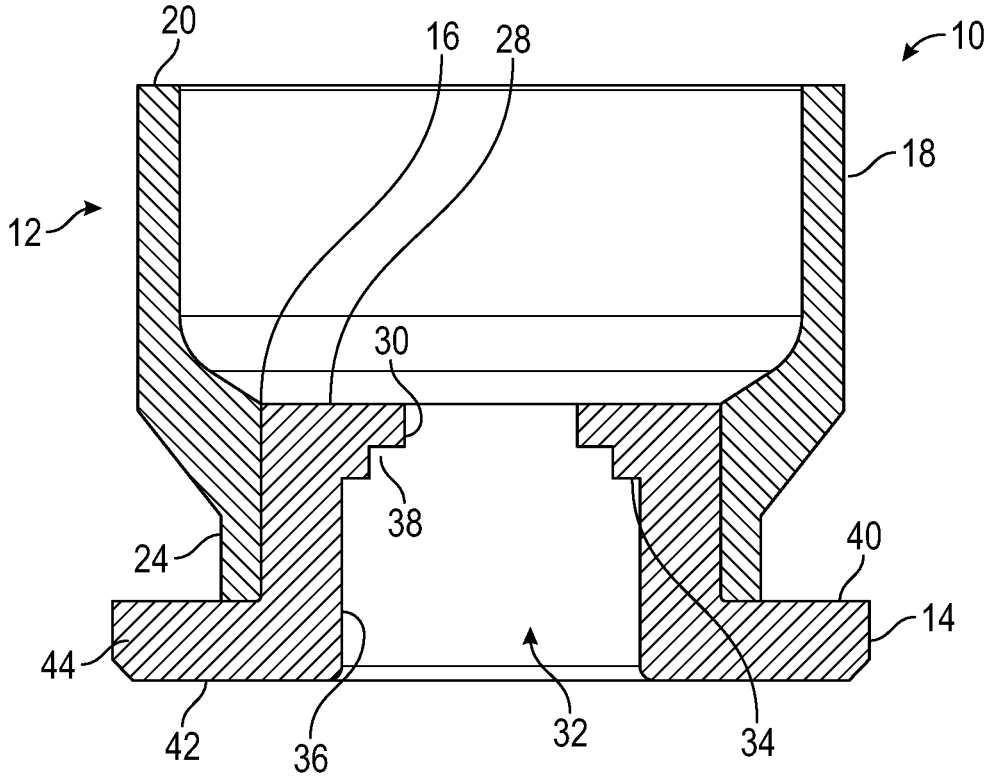
FIGS. 23A-23N are perspective views of different embodiments of the first primer insert portion 12 having surface protrusions 100 positioned on the outside of the first primer insert portion 12.
Figure 23C:
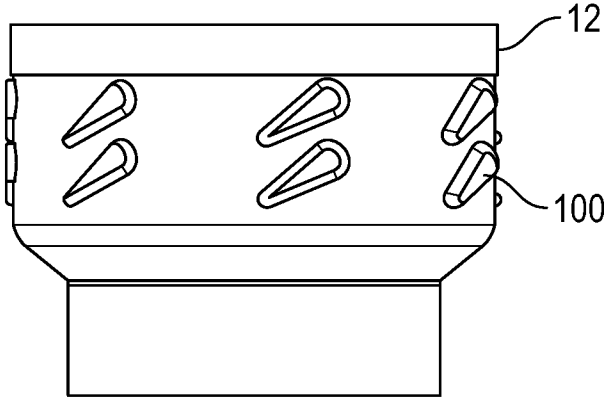
Figure 23E:
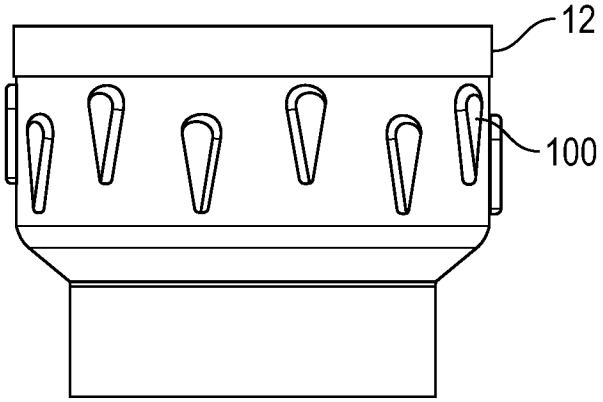
Figure 23B:
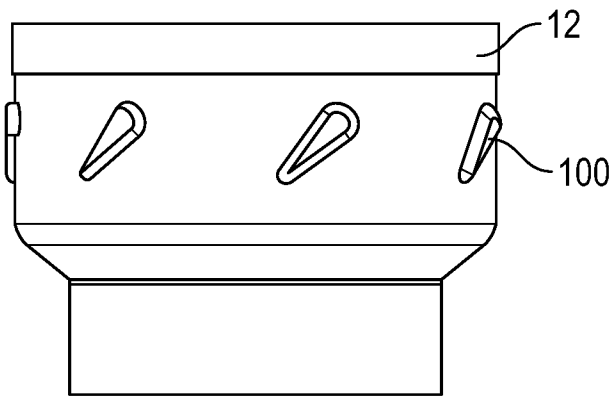
Figure 23D:
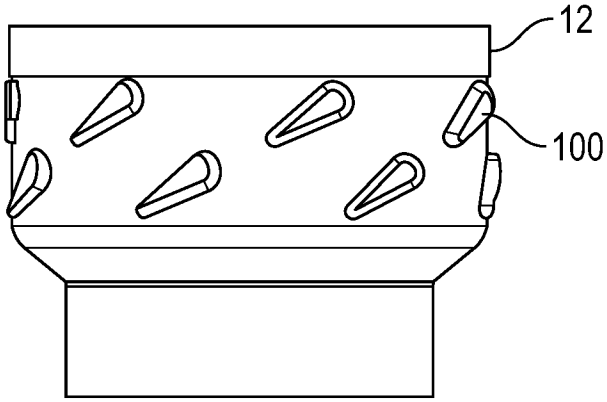
Figure 23G:
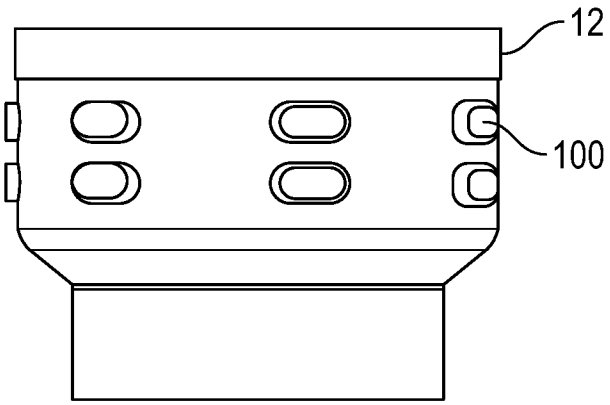
Figure 23I:
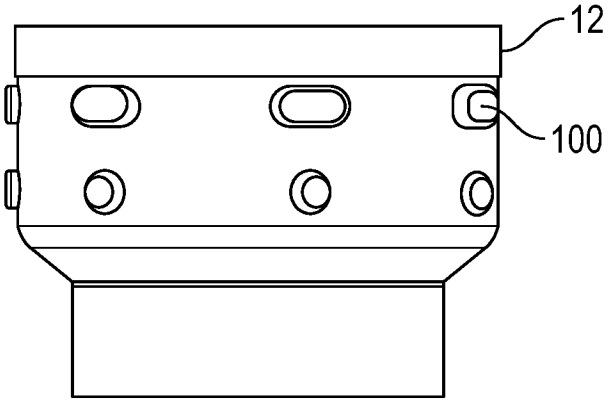
Figure 23F:
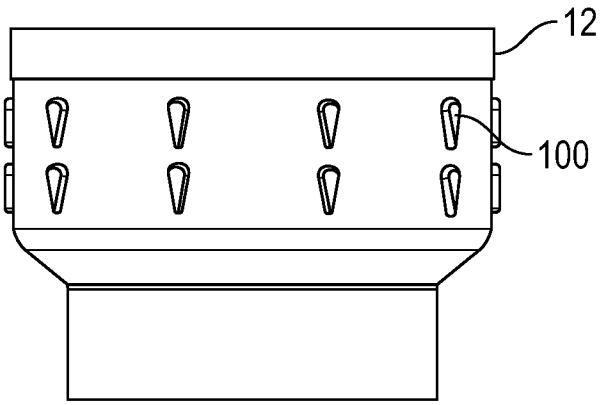
Figure 23H:
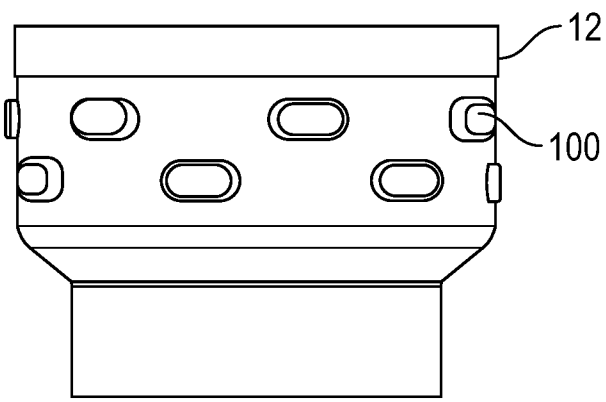
Figure 23K:
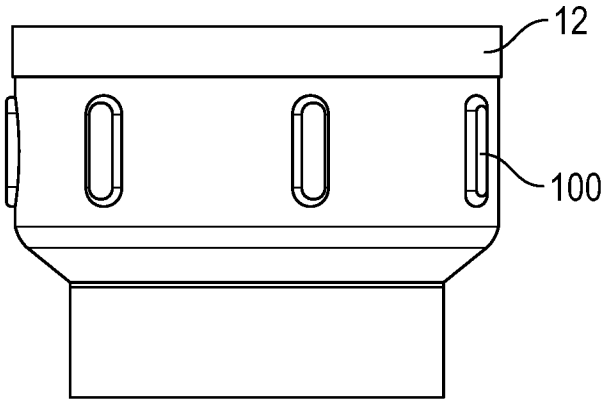
Figure 23M:
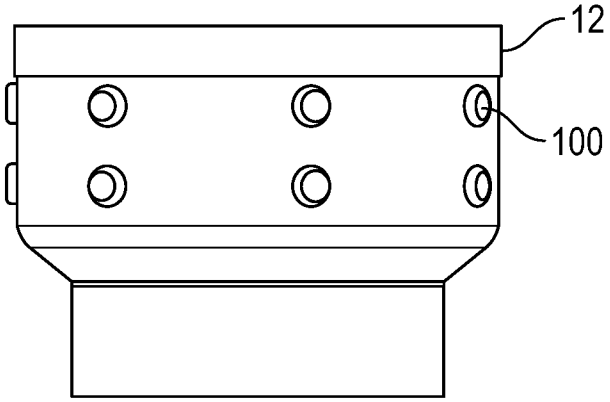
Figure 23J:
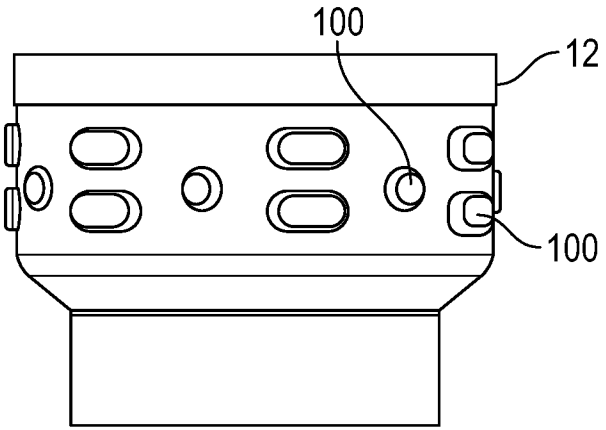
Figure 23L:
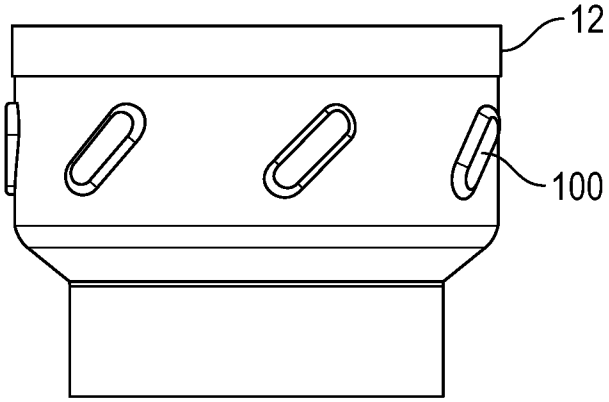
Figure 23N:
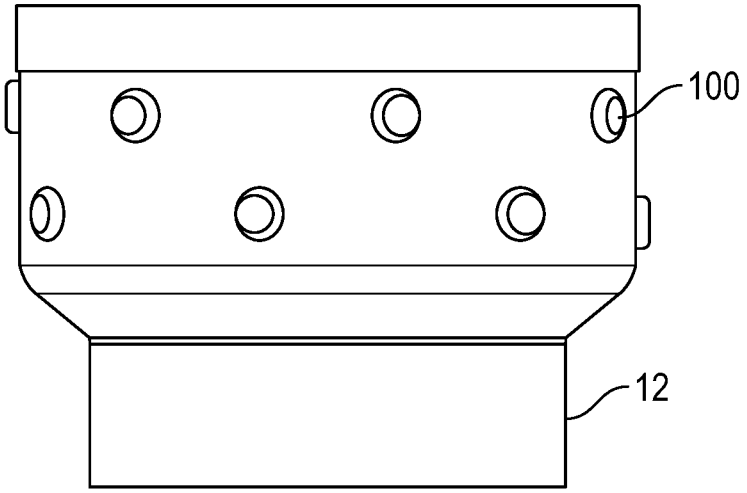

FIG. 23A is a cut through image of one embodiment of a two piece primer insert. The primer insert 10 is formed by joining a first primer insert portion 12 to a second primer insert portion 14. The primer insert 10 is formed by press joining the first primer insert portion 12 and the second primer insert portion 14 which forms a insert joint 16. The first primer insert portion 12 may be of the same or different materials than the second primer insert portion 14. The first primer insert portion 12 includes an insert coupling element 18 that extends from an insert tip 20 downward to an insert transition 22. The insert transition 22 transitions from the vertical region of the insert tip 20 to a horizontal region. The insert transition 22 is in communication with the first primer insert portion joining region 24 that extends to the first primer insert portion bottom 26. The first primer insert portion joining region 24 and the first primer insert portion bottom 26 are in pressed contact with the second primer insert portion 14 to form the insert joint 16. The second primer insert portion 14 includes an inner surface (not shown) that when overmolded into an ammunition cartridge (not shown) forms the bottom of the propellant chamber (not shown). The inner surface 28 includes a primer flash aperture 30 that extends through the inner surface 28 into the primer recess 32. The primer recess 32 includes a primer pocket bottom surface 34 and a primer pocket side walls 36. The primer recess 32 is adapted to fit a primer (not shown) and allow the primer to transmit through the primer flash aperture 30. The primer pocket bottom surface 34 includes a flash aperture groove 38 that extends around the primer flash aperture 30. The flash aperture groove 38 may extend across the primer recess bottom surface 34 covering any distance from the primer flash aperture 30 to the primer recess side walls 36. The primer recess side walls 36 is opposite the second primer insert portion joining region 40. The second primer insert portion joining region 40 is in pressed contact with the first primer insert portion joining region 24 to form the insert joint 16 that is in pressed contact to retain the joining of the first primer insert portion 12 and the second primer insert portion 14. The second primer insert portion 14 includes a transition from the primer recess 32 to the outer surface 42 that extends to an extraction flange 44.

FIGS. 23B-23N are perspective views of different embodiments, of FIG. 23A showing the first primer insert portion 12 having surface protrusions 100 positioned on the outside of the first primer insert portion 12. The surface protrusions 100 may be affixed to the surface or may be an integral portion of the first primer insert portion 12. The surface protrusions 100 may be affixed by adhesive, epoxy, welding, melting, fusing, surface tension, friction or any other mechanism that will allow the surface protrusions 100 to be held in position. The surface protrusions 100 may be positioned in a uniformed manner in uniformed rows or staggered rows, in a random pattern, and may be aligned vertically, horizontally, or at any angle there between. Although the surface protrusions 100 are shown as circles, spheres, squares, triangles, or teardrops the surface protrusions 100 may have any shape and be of any size.

Figure 24A:
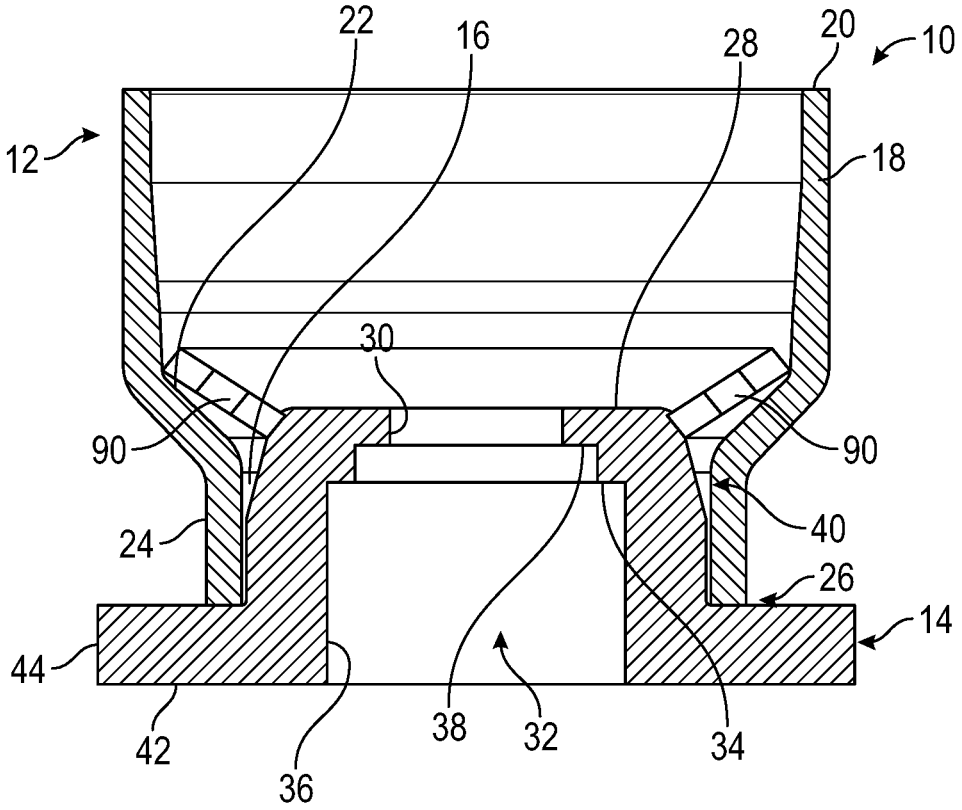

FIG. 24A shows a primer insert 10 having the first primer insert portion 12 joined to the second primer insert portion 14 at insert joint 16 with the support structure 90 positioned in the insert joint 16 and extending into the interior of the first primer insert portion 12 toward the insert tip 20. The support structure 90 may extend about the insert joint 16 in part or in whole into, over or a combination thereof. The support structure 90 may be of any width, thickness or profile being straight curved or a combination thereof. The support structure 90 may be at least about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 32, 34, 36, 38, 40, 42, 44, 46, 48, 50, 52, 54, 56, 58, 60, 62, 64, 66, 68, 70, 72, 74, 76, 78, 80, 82, 84, 86, 88, 90, 92, 94, 96, 98, or even 100 percent of inner surface 28. The support structure 90 may be formed to approximate the interior wall.

Figure 24B:
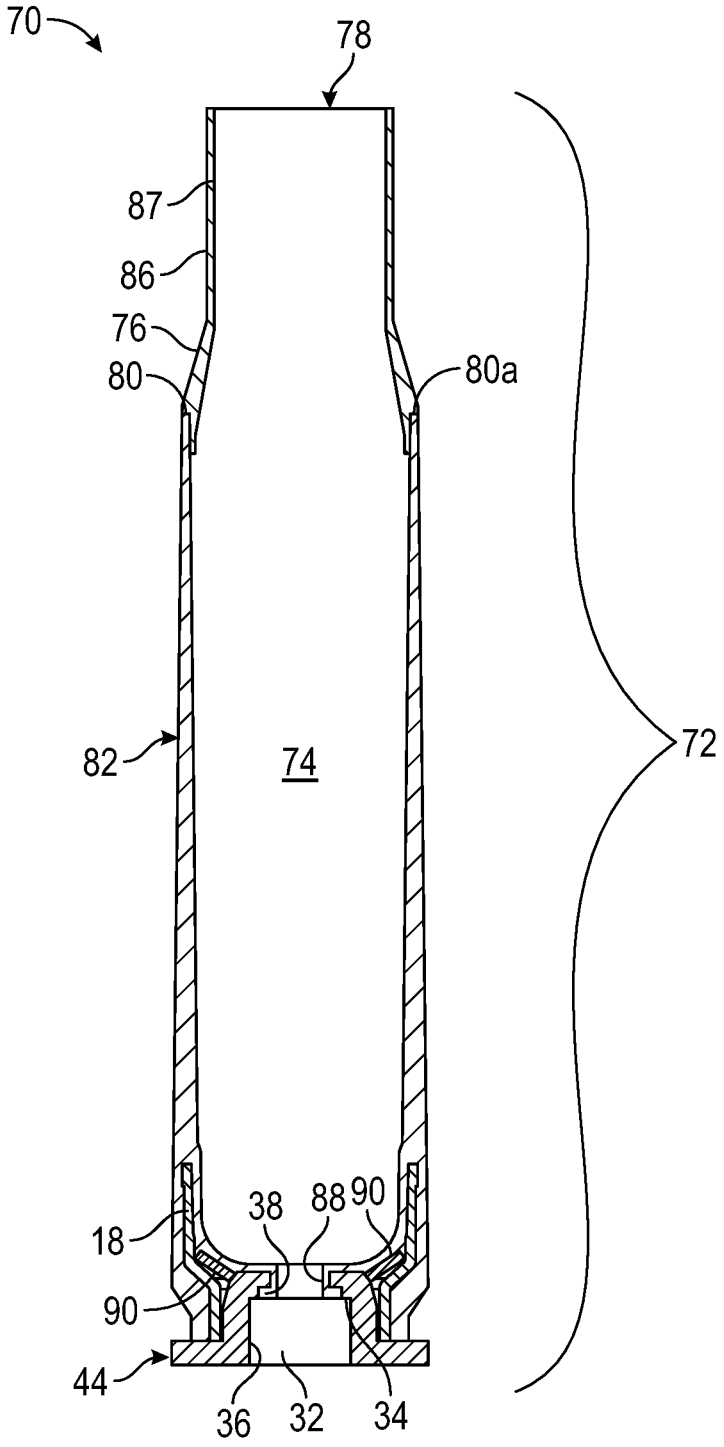

FIG. 24B shows a side, cross-sectional view of a portion of a polymeric cartridge case overmolding a primer insert 10 having the first primer insert portion 12 joined to the second primer insert portion 14 at insert joint 16 with the support structure 90 positioned in the insert joint 16 and extending into the interior of the first primer insert portion 12. The support structure 90 may be formed to approximate the interior wall.

Figure 25A:
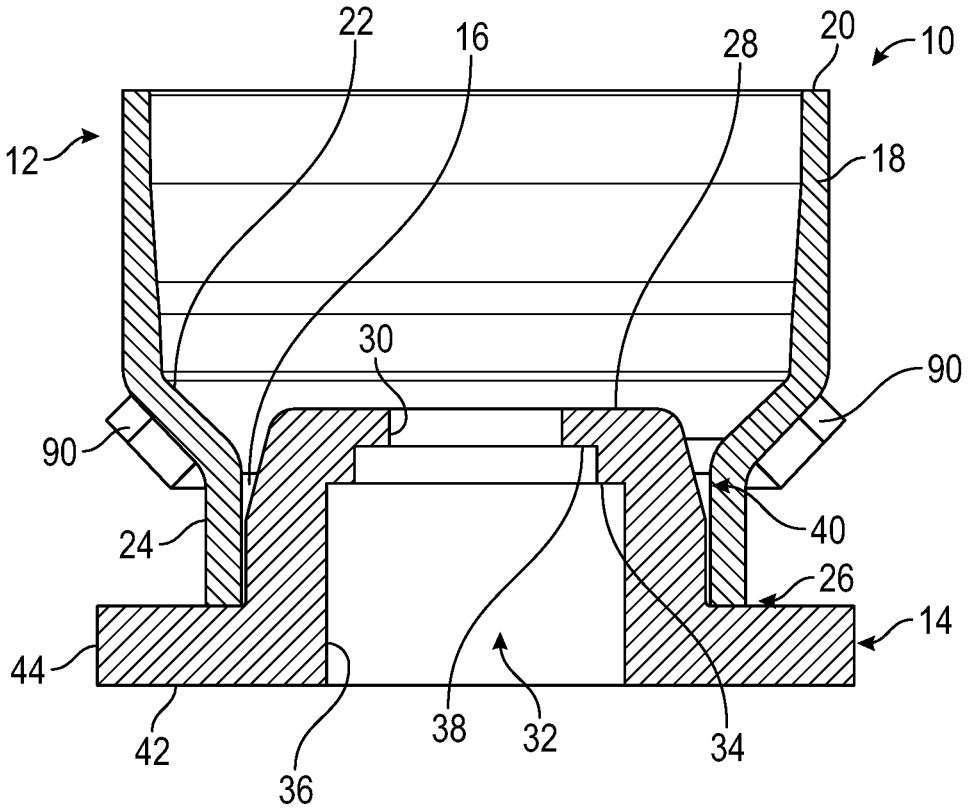

FIG. 25A shows a primer insert 10 having the first primer insert portion 12 joined to the second primer insert portion 14 at insert joint 16 with the support structure 90 positioned on the exterior of the first primer insert portion 12. The support structure 90 may extend about the insert joint 16 in part or in whole into, over or a combination thereof. The support structure 90 may be of any width, thickness or profile being straight curved or a combination thereof. The support structure 90 may be at least about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 32, 34, 36, 38, 40, 42, 44, 46, 48, 50, 52, 54, 56, 58, 60, 62, 64, 66, 68, 70, 72, 74, 76, 78, 80, 82, 84, 86, 88, 90, 92, 94, 96, 98, or even 100 percent of the exterior surface. The support structure 90 may be formed to approximate the exterior wall.

Figure 25B:
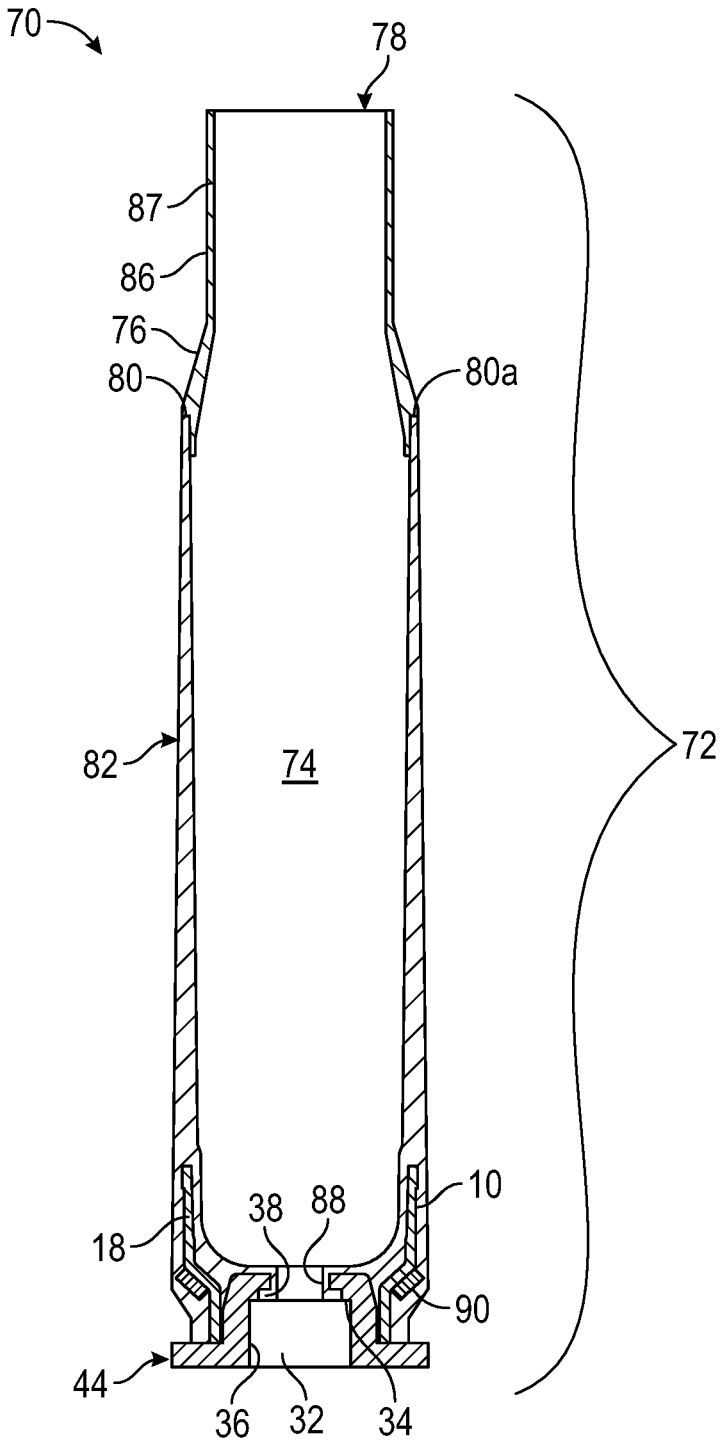

FIG. 25B shows a side, cross-sectional view of a portion of a polymeric cartridge case overmolding a primer insert 10 having the first primer insert portion 12 joined to the second primer insert portion 14 at insert joint 16 with the support structure 90 positioned on the exterior of the primer insert portion 12. The support structure 90 may be formed to approximate the interior wall.

Figure 26:
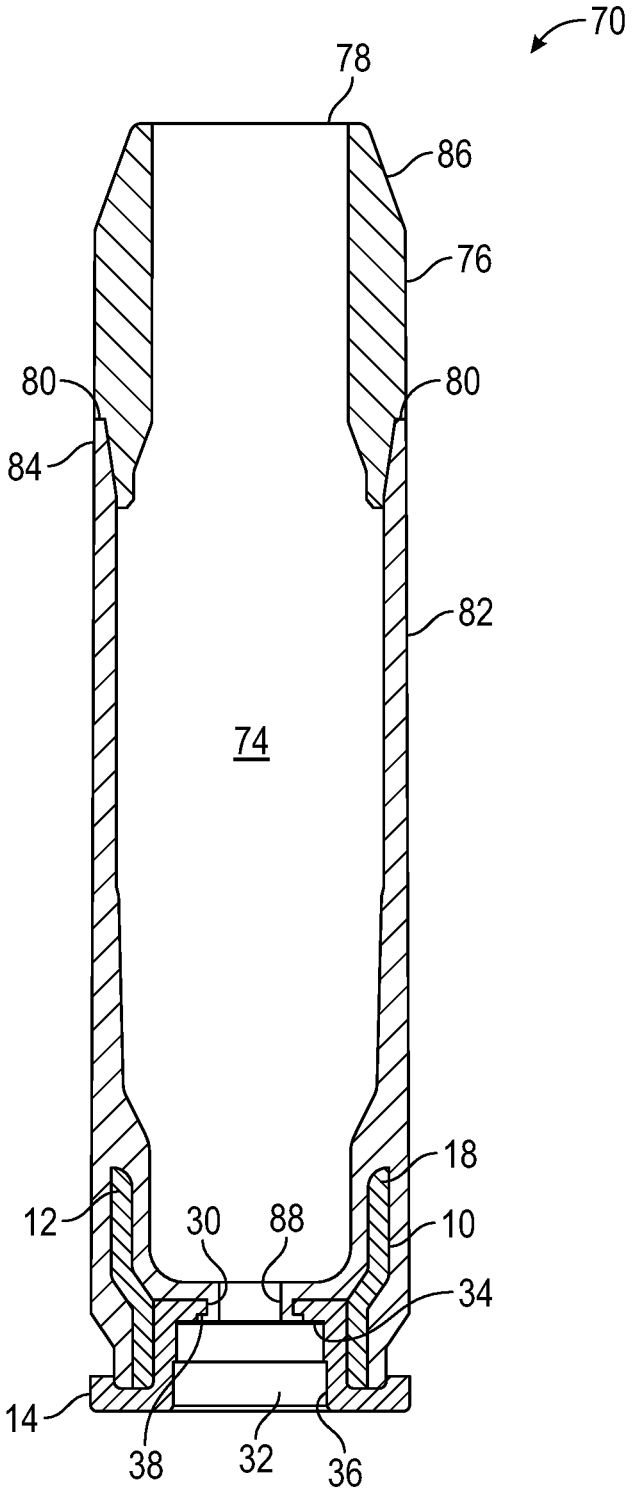

FIG. 26 shows a side, cross-sectional view of a portion of a polymeric cartridge case overmolding a primer insert 10 having the first primer insert portion 12 joined to the second primer insert portion 14. A cartridge 70 is shown manufactured with a polymer casing 72 showing a propellant chamber 74 with projectile aperture at the nose 76. The polymer casing 72 has a projectile aperture 78 extending from nose 76 rearward. The nose 76 may be formed with the nose joint 80 that mates to the middle body 82 through contact with the nose joint 80 and the body joint 84. Alternatively, the nose joint 80 and the body joint 84 may be positioned at different locations (e.g., nose joint 80*a*) on the nose depending on the specific application. The nose joint 80 and body joint 84 is shown as a male-female element, but may also be configured as other joints in alternate embodiments. The nose 76 has a shoulder 86 that is reduced to a chamber neck 87 to accommodate the projectile aperture 78.

Figure 27A:
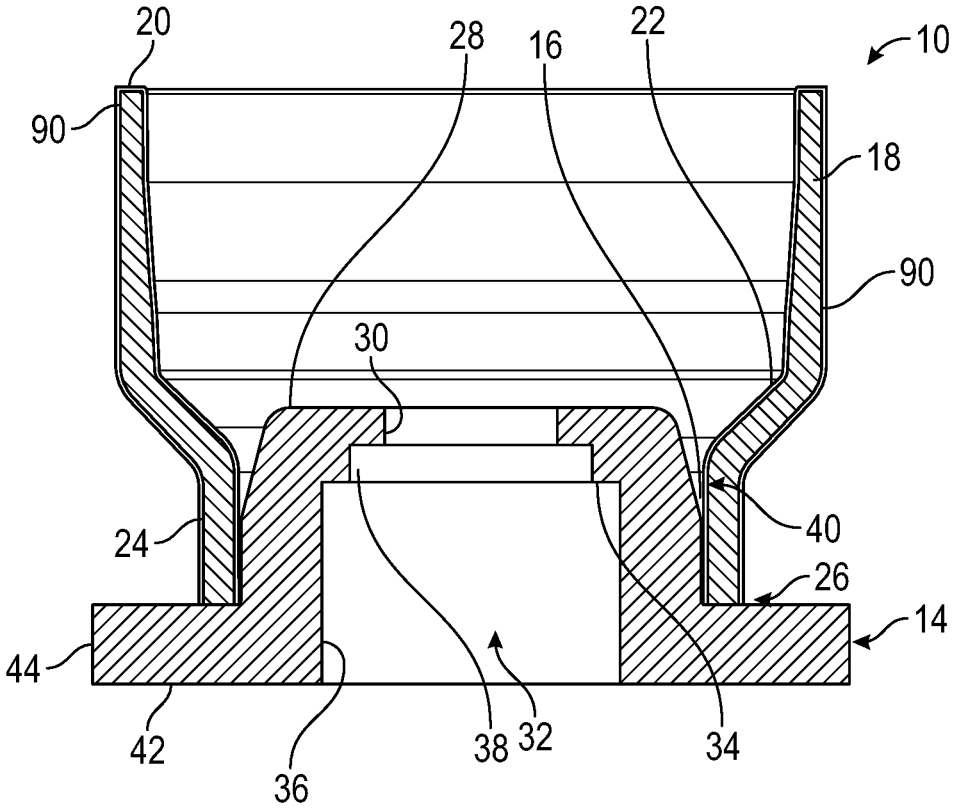

FIG. 27A shows a primer insert 10 having the first primer insert portion 12 joined to the second primer insert portion 14 with the support structure 90 positioned on the outer surface of the first primer insert portion 12 and extending over the tip 20 and into the insert joint 16. The support structure 90 may extend into the insert joint 16 to any degree necessary including into the inner surface 28. The support structure 90 may be formed to approximate the exterior wall or may have a general shape.

Figure 27B:
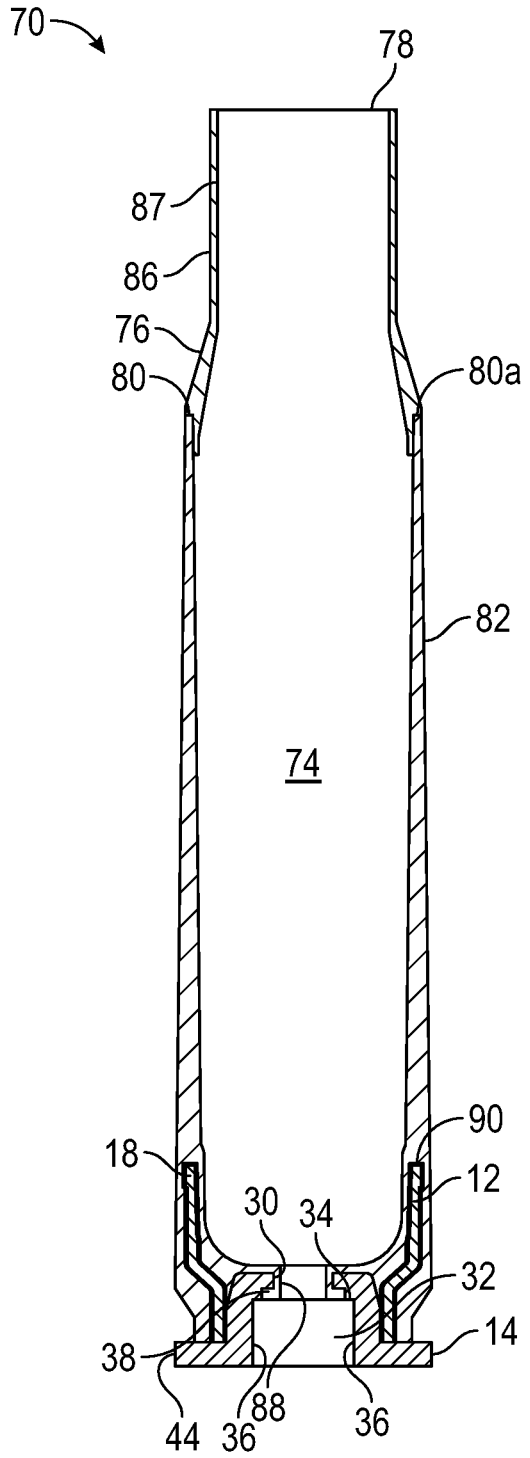

FIG. 27B shows a side, cross-sectional view of a portion of a polymeric cartridge case overmolding a primer insert 10 having the first primer insert portion 12 joined to the second primer insert portion 14 with the support structure 90 positioned on the outer surface of the first primer insert portion 12 and extending over the tip 20 and into the insert joint 16. The support structure 90 may extend into the insert joint 16 to any degree necessary including into the inner surface 28. The support structure 90 may be formed to approximate the exterior wall or may have a general shape.

The individual pieces may be formed by punching, pressing, stamping, molding, coining, or by additive manufacturing. The individual pieces may be joined by clinching, pressing welding soldering, sintering, adhesive gluing, staking, and iterative addition by forming one piece into another piece.

In addition, the various components of the multi-piece insert may be pressed together to form a unitary insert. The individual portions held in position using stakes or retainers (e.g., ring and slot, stake, etc.). The method of connecting the individual pieces to form a unitary insert will depend on the materials being joined. For example, a metal insert may be constructed from two or more metal pieces with similar melting points are joined together to form a unitary insert through sintering. Similarly, a metal insert constructed from two or more metal pieces may be pressed together to form a unitary insert.

Multiple piece inserts of the present invention may be configured in various ways. For example, the insert may be include three insert pieces, three insert pieces configured without the need for a diffuser, three insert pieces where one piece is a diffuser, three insert pieces where the diffuser is between the other insert pieces.

The present invention includes a diffuser that is positioned between the primer and the bottom of the primer recess. The diffuser includes a diffuser aperture that aligns with the flash hole and may include a diffuser aperture extension that fits in the flash hole. The diffuser diverts the combustion effect away from the over-molded polymer material of the middle body component. The affects being the impact from igniting the primer as far as pressure and heat to divert the energy of the primer off of the polymer and directing it to the flash hole. The diffuser can be between 0.0001 to 0.015 inches (e.g., 0.0001, 0.0002, 0.0003, 0.0004, 0.0005, 0.0006, 0.0007, 0.0008, 0.0009, 0.001, 0.002, 0.003, 0.004, 0.005, 0.006, 0.007, 0.008, 0.009, 0.010, 0.011, 0.012, 0.013, 0.014, or 0.015) in thickness and made from metal, polymer, composite, or other material, e.g., half hard brass. For example, the diffuser can be between about 0.005 inches thick for a 5.56 diffuser 50. For example, the outer diameter of the diffuser for a 5.56 or 223 case is 0.173 and the inner diameter is 0.080. The diffuser could be made of any material that can withstand the energy from the ignition of the primer, e.g., alloys, metals, steel, stainless, cooper, aluminum, resins and polymers. The diffuser can be produced in "T", 'L" or "I" shape by drawing the material by MIM, PIM, milling, machining, or using a stamping and draw die. In the "T", 'L" or "I" shape diffusers the center ring can be 0.001 to 0.010 tall and the outer diameter is 0.090 and the inner diameter 0.080, individually 0.001, 0.002, 0.003, 0.004, 0.005, 0.006, 0.007, 0.008, 0.009, 0.010, 0.011, 0.012, 0.013, 0.014, 0.015, 0.02, 0.02.5, 0.03, 0.04, 0.05, 0.06, 0.07, 0.08, 0.09, 0.1, or 0.2.

The inserts joint may connect the upper primer insert portion, the middle insert and the lower primer insert portion by threading, riveting, locking, friction fitting, coining, snap fitting, chemical bonding, chemical welding, soldering, smelting, sintering, adhesive bonding, laser welding, ultrasonic welding, friction spot welding, friction stir welding spin-welding, vibration-welding, ultrasonic-welding or laser-welding techniques. In addition, multiple methods may be used to increase the joint strength.

Chemical welding and chemical bonding involves the use of chemical compositions that undergoes a chemical or physical reaction resulting in the joining of the materials and the formation of a unitary primer insert. The chemicals may join the surfaces through the formation of a layer that contacts both surfaces or by melting the surfaces to a single interface between the surfaces.

Adhesive bonding involves the use of a polymeric adhesive, which undergoes a chemical or physical reaction, for eventual joint formation. The upper primer insert portion mates to the lower primer insert portion at the insert joint to which an adhesive material has been added to form a unitary primer insert. The adhesive includes high-strength and tough adhesives that can withstand both static and alternating loads.

Sintering involves the process of compacting and forming a solid mass of material by heat and/or pressure without melting it to the point of liquefaction. Materials that are identical or similar may be sintered in the temperature range for the specific time, e.g., stainless steel may be heated for 30-60 minutes at a temperature of between 2000-2350° F. However, materials that are dissimilar may be heated at the within the common temperature range (±400° F.) for the specific time (±0.5-2 hours). For example, the upper primer insert portion may be stainless steel with a temperature range form 2000-2350° F. for 30-60 minutes and the lower primer insert portion may be nickel 1850-2100° F. for 30-45 minutes (and vice versa) to allow the sintering at between 2000-2100° F. for 30-60 minutes. Similarly, the upper primer insert portion may be stainless steel with a temperature range form 2000-2350° F. for 30-60 minutes and the lower primer insert portion may be tungsten carbide 2600-2700° F. for 20-30 minutes to allow the sintering at between 2300-2600° F. for 30-60 minutes or longer if necessary. The skilled artisan readily understands the parameters associated with sintering materials of similar and different compositions and therefor there is no need in reciting all of the various combinations that can be formed in this application.

Welding techniques including laser welding, ultrasonic welding, friction spot welding, and friction stir welding. The welding methods can use the existing materials to fill in the insert joint or an additional material may be used to fill in the insert joint. The dissimilar multi-metal welded unitary primer insert must be examined to determine the crack sensitivity, ductility, susceptibility to corrosion, etc. In some cases, it is necessary to use a third metal that is soluble with each metal in order to produce a successful joint.

The two piece primer insert used in polymeric cartridge cases includes an upper primer insert portion and a lower primer insert portion joined at insert joint. The individual upper primer insert portion and lower primer insert portion may be formed in various methods. For example the individual upper primer insert portion and lower primer insert portion may be formed by metal injection molding, polymer injection molding, stamping, milling, molding, machining, punching, fine blanking, smelting, or any other method that will form insert portions that may be joined together to form a primer insert.

The two piece primer insert includes an individual upper primer insert portion and lower primer insert portion formed in various methods. For example, the individual upper primer insert portion and lower primer insert portion may be formed by stamping, milling, or machining and then joined together to form a primer insert.

For example, the individual upper primer insert portion, the lower primer insert portion or both may be formed by fineblanking, punching, pressing, stamping, molding, coining, milled, stamped, forged, machined, molded, cast or by additive manufacturing. The individual pieces may be joined by clinching, pressing welding soldering, sintering, adhesive gluing, staking, and iterative addition by forming one piece into another piece. Fineblanking is a specialty type of metal stamping that can achieve part characteristics such as flatness and a full sheared edge to a degree that is nearly impossible using a conventional metal cutting or punching process and is used to achieve flatness and cut edge characteristics that are unobtainable by conventional stamping and punching methods. When the punch makes contact with the sheet, the metal begins to deform and bulge around the point of the punch. As the yield strength of the part material is exceeded by the downward force of the press, the point of the punch begins to penetrate the metal's surface. Both the punch and matrix, or button, begin to cut from their respective sides. When the ultimate tensile strength has been reached, the metal breaks or fractures from the edge of the punch to the edge of the matrix. This results in a cut edge that appears to be partially cut and partially broken or fractured. This cut edge condition often is referred to as the "cut band." In most cases, the cut edge has about 10 percent to 30 percent of shear, and the remainder is fractured. The fracture has two primary causes. The distance between the punch and the matrix creates a leverage action and tends to pull the metal apart, causing it to rupture. The deformation that is allowed during the cutting process also allows the metal to fracture prematurely. Allowing the metal to deform severely during the cutting process results in straining of the metal, which in turn causes a stress. Trapped stresses in a product cause it to lose its flatness, which is why it is very difficult to maintain a critical flatness characteristic using conventional methods. Fineblanking requires the use of three very high-pressure pads in a special press. These pads hold the metal flat during the cutting process and keep the metal from plastically deforming during punch entry. Most fineblanking operations incorporate a V-ring into one of the high-pressure pads. This ring also is commonly referred to as a "stinger" or "impingement" ring. Before the punch contacts the part, the ring impales the metal, surrounds the perimeter of the part, and traps the metal from moving outward while pushing it inward toward the punch. This reduces rollover at the cut edge. Fineblanking operations usually require clearances of less than 0.0005 inch per side. This small clearance, combined with high pressure, results in a fully sheared part edge. Fineblanking is much like a cold extruding process. The slug (or part) is pushed or extruded out of the strip while it is held very tightly between the high-pressure holding plates and pads. The tight hold of the high-pressure plates prevents the metal from bulging or plastically deforming during the extrusion process.

The two piece primer insert includes an individual upper primer insert portion and lower primer insert portion formed in various methods. For example, the individual upper primer insert portion and lower primer insert portion may be formed by molding, injection molding or metal injection molding and then joined together to form a primer insert. For example, when the individual upper primer insert portion and lower primer insert portion or both are metal injection molded, the raw materials are metal powders and a thermoplastic binder. There are at least two Binders included in the blend, a primary binder and a secondary binder. This blended powder mix is worked into the plasticized binder at elevated temperature in a kneader or shear roll extruder. The intermediate product is the so-called feedstock. It is usually granulated with granule sizes of several millimeters. In metal injection molding, only the binders are heated up, and that is how the metal is carried into the mold cavity. In preparing a feedstock, it is important first to measure the actual density of each lot of both the metal powders and binders. This is extremely important especially for the metal powders in that each lot will be different based on the actual chemistry of that grade of powder. For example, 316L is comprised of several elements, such as Fe, Cr, Ni, Cu, Mo, P, Si, S and C. In order to be rightfully called a 316L, each of these elements must meet a minimum and maximum percentage weight requirement as called out in the relevant specification. Hence the variation in the chemistry within the specification results in a significant density variation within the acceptable composition range. Depending on the lot received from the powder producer, the density will vary depending on the actual chemistry received. The metal may be low alloy steels 2200, 2700, 4605, 316L, 420, 430L, 17-4, 17-4PH, 17-7, F15, Fe-3% Si, Fe-50% Ni, and Fe-50% Co. In addition to the specific metal compositions may include common commercial designations e.g., C-0000 Copper and Copper Alloys; CFTG-3806-K Diluted Bronze Bearings; CNZ-1818 Copper and Copper Alloys; CNZP-1816 Copper and Copper Alloys; CT-1000 Copper and Copper Alloys; CT-1000-K Bronze Bearings; CTG-1001-K Bronze Bearings; CTG-1004-K Bronze Bearings; CZ-1000 Copper and Copper Alloys; CZ-2000 Copper and Copper Alloys; CZ-3000 Copper and Copper Alloys; CZP-1002 Copper and Copper Alloys; CZP-2002 Copper and Copper Alloys; CZP-3002 Copper and Copper Alloys; F-0000 Iron and Carbon Steel; F-0000-K Iron and Iron-Carbon Bearings; F-0005 Iron and Carbon Steel; F-0005-K Iron and Iron-Carbon Bearings; F-0008 Iron and Carbon Steel; F-0008-K Iron and Iron-Carbon Bearings; FC-0200 Iron-Copper and Copper Steel; FC-0200-K Iron-Copper Bearings; FC-0205 Iron-Copper and Copper Steel; FC-0205-K Iron-Copper-Carbon Bearings; FC-0208 Iron-Copper and Copper Steel; FC-0208-K Iron-Copper-Carbon Bearings; FC-0505 Iron-Copper and Copper Steel; FC-0508 Iron-Copper and Copper Steel; FC-0508-K Iron-Copper-Carbon Bearings; FC-0808 Iron-Copper and Copper Steel; FC-1000 Iron-Copper and Copper Steel; FC-1000-K Iron-Copper Bearings; FC-2000-K Iron-Copper Bearings; FC-2008-K Iron-Copper-Carbon Bearings; FCTG-3604-K Diluted Bronze Bearings; FD-0200 Diffusion-Alloyed Steel; FD-0205 Diffusion-Alloyed Steel; FD-0208 Diffusion-Alloyed Steel; FD-0400 Diffusion-Alloyed Steel; FD-0405 Diffusion-Alloyed Steel; FD-0408 Diffusion-Alloyed Steel; FF-0000 Soft-Magnetic Alloys; FG-0303-K Iron-Graphite Bearings; FG-0308-K Iron-Graphite Bearings; FL-4005 Prealloyed Steel; FL-4205 Prealloyed Steel; FL-4400 Prealloyed Steel; FL-4405 Prealloyed Steel; FL-4605 Prealloyed Steel; FL-4805 Prealloyed Steel; FL-48105 Prealloyed Steel; FL-4905 Prealloyed Steel; FL-5208 Prealloyed Steel; FL-5305 Prealloyed Steel; FLC-4608 Sinter-Hardened Steel; FLC-4805 Sinter-Hardened Steel; FLC-48108 Sinter-Hardened Steel; FLC-4908 Sinter-Hardened Steel; FLC2-4808 Sinter-Hardened Steel; FLDN2-4908 Diffusion-Alloyed Steel; FLDN4C2-4905 Diffusion-Alloyed Steel; FLN-4205 Hybrid Low-Alloy Steel; FLN-48108 Sinter-Hardened Steel; FLN2-4400 Hybrid Low-Alloy Steel; FLN2-4405 Hybrid Low-Alloy Steel; FLN2-4408 Sinter-Hardened Steel; FLN2C-4005 Hybrid Low-Alloy Steel; FLN4-4400 Hybrid Low-Alloy Steel; FLN4-4405 Hybrid Low-Alloy Steel; FLN4-4408 Sinter Hardened Steel; FLN4C-4005 Hybrid Low-Alloy Steel; FLN6-4405 Hybrid Low-Alloy Steel; FLN6-4408 Sinter-Hardened Steel; FLNC-4405 Hybrid Low-Alloy Steel; FLNC-4408 Sinter-Hardened Steel; FN-0200 Iron-Nickel and Nickel Steel; FN-0205 Iron-Nickel and Nickel Steel; FN-0208 Iron-Nickel and Nickel Steel; FN-0405 Iron-Nickel and Nickel Steel; FN-0408 Iron-Nickel and Nickel Steel; FN-5000 Soft-Magnetic Alloys; FS-0300 Soft-Magnetic Alloys; FX-1000 Copper-Infiltrated Iron and Steel; FX-1005 Copper-Infiltrated Iron and Steel; FX-1008 Copper-Infiltrated Iron and Steel; FX-2000 Copper-Infiltrated Iron and Steel; FX-2005 Copper-Infiltrated Iron and Steel; FX-2008 Copper-Infiltrated Iron and Steel; FY-4500 Soft-Magnetic Alloys; FY-8000 Soft-Magnetic Alloys; P/F-1020 Carbon Steel PF; P/F-1040 Carbon Steel PF; P/F-1060 Carbon Steel PF; P/F-10C40 Copper Steel PF; P/F-10050 Copper Steel PF; P/F-10060 Copper Steel PF; P/F-1140 Carbon Steel PF; P/F-1160 Carbon Steel PF; P/F-11C40 Copper Steel PF; P/F-11050 Copper Steel PF; P/F-11060 Copper Steel PF; P/F-4220 Low-Alloy P/F-42XX Steel PF; P/F-4240 Low-Alloy P/F-42XX Steel PF; P/F-4260 Low-Alloy P/F-42XX Steel PF; P/F-4620 Low-Alloy P/F-46XX Steel PF; P/F-4640 Low-Alloy P/F-46XX Steel PF; P/F-4660 Low-Alloy P/F-46XX Steel PF; P/F-4680 Low-Alloy P/F-46XX Steel PF; SS-303L Stainless Steel—300 Series Alloy; SS-303N1 Stainless Steel—300 Series Alloy; SS-303N2 Stainless Steel—300 Series Alloy; SS-304H Stainless Steel—300 Series Alloy; SS-304L Stainless Steel—300 Series Alloy; SS-304N1 Stainless Steel—300 Series Alloy; SS-304N2 Stainless Steel—300 Series Alloy; SS-316H Stainless Steel—300 Series Alloy; SS-316L Stainless Steel—300 Series Alloy; SS-316N1 Stainless Steel—300 Series Alloy; SS-316N2 Stainless Steel—300 Series Alloy; SS-409L Stainless Steel—400 Series Alloy; SS-409LE Stainless Steel—400 Series Alloy; SS-410 Stainless Steel—400 Series Alloy; SS-410L Stainless Steel—400 Series Alloy; SS-430L Stainless Steel—400 Series Alloy; SS-430N2 Stainless Steel—400 Series Alloy; SS-434L Stainless Steel—400 Series Alloy; SS-434LCb Stainless Steel—400 Series Alloy; and SS-434N2 Stainless Steel—400 Series Alloy.

Titanium alloys that may be used in this invention include any alloy or modified alloy known to the skilled artisan including titanium grades 5-38 and more specifically titanium grades 5, 9, 18, 19, 20, 21, 23, 24, 25, 28, 29, 35, 36 or 38. Grades 5, 23, 24, 25, 29, 35, or 36 annealed or aged; Grades 9, 18, 28, or 38 cold-worked and stress-relieved or annealed; Grades 9, 18, 23, 28, or 29 transformed-beta condition; and Grades 19, 20, or 21 solution-treated or solution-treated and aged. Grade 5, also known as Ti6Al4V, Ti-6Al-4V or Ti 6-4, is the most commonly used alloy. It has a chemical composition of 6% aluminum, 4% vanadium, 0.25% (maximum) iron, 0.2% (maximum) oxygen, and the remainder titanium. It is significantly stronger than commercially pure titanium while having the same stiffness and thermal properties (excluding thermal conductivity, which is about 60% lower in Grade 5 Ti than in CP Ti); Grade 6 contains 5% aluminum and 2.5% tin. It is also known as Ti-5Al-2.5Sn. This alloy has good weldability, stability and strength at elevated temperatures; Grade 7 and 7H contains 0.12 to 0.25% palladium. This grade is similar to Grade 2. The small quantity of palladium added gives it enhanced crevice corrosion resistance at low temperatures and high pH; Grade 9 contains 3.0% aluminum and 2.5% vanadium. This grade is a compromise between the ease of welding and manufacturing of the "pure" grades and the high strength of Grade 5; Grade 11 contains 0.12 to 0.25% palladium; Grade 12 contains 0.3% molybdenum and 0.8% nickel; Grades 13, 14, and 15 all contain 0.5% nickel and 0.05% ruthenium; Grade 16 contains 0.04 to 0.08% palladium; Grade 16H contains 0.04 to 0.08% palladium; Grade 17 contains 0.04 to 0.08% palladium; Grade 18 contains 3% aluminum, 2.5% vanadium and 0.04 to 0.08% palladium; Grade 19 contains 3% aluminum, 8% vanadium, 6% chromium, 4% zirconium, and 4% molybdenum; Grade 20 contains 3% aluminum, 8% vanadium, 6% chromium, 4% zirconium, 4% molybdenum and 0.04% to 0.08% palladium; Grade 21 contains 15% molybdenum, 3% aluminum, 2.7% niobium, and 0.25% silicon; Grade 23 contains 6% aluminum, 4% vanadium, 0.13% (maximum) Oxygen; Grade 24 contains 6% aluminum, 4% vanadium and 0.04% to 0.08% palladium. Grade 25 contains 6% aluminum, 4% vanadium and 0.3% to 0.8% nickel and 0.04% to 0.08% palladium; Grades 26, 26H, and 27 all contain 0.08 to 0.14% ruthenium; Grade 28 contains 3% aluminum, 2.5% vanadium and 0.08 to 0.14% ruthenium; Grade 29 contains 6% aluminum, 4% vanadium and 0.08 to 0.14% ruthenium; Grades 30 and 31 contain 0.3% cobalt and 0.05% palladium; Grade 32 contains 5% aluminum, 1% tin, 1% zirconium, 1% vanadium, and 0.8% molybdenum; Grades 33 and 34 contain 0.4% nickel, 0.015% palladium, 0.025% ruthenium, and 0.15% chromium; Grade 35 contains 4.5% aluminum, 2% molybdenum, 1.6% vanadium, 0.5% iron, and 0.3% silicon; Grade 36 contains 45% niobium; Grade 37 contains 1.5% aluminum; and Grade 38 contains 4% aluminum, 2.5% vanadium, and 1.5% iron. The mechanical properties are very similar to Grade 5, but has good cold workability similar to grade 9. One embodiment includes a Ti6Al4V composition. One embodiment includes a composition having 3-12% aluminum, 2-8% vanadium, 0.1-0.75% iron, 0.1-0.5% oxygen, and the remainder titanium. More specifically, about 6% aluminum, about 4% vanadium, about 0.25% iron, about 0.2% oxygen, and the remainder titanium. For example, one Ti composition may include 10 to 35% Cr, 0.05 to 15% Al, 0.05 to 2% Ti, 0.05 to 2% $Y_2O_5$, with the balance being either Fe, Ni or Co, or an alloy consisting of 20±1.0% Cr, 4.5±0.5% Al, 0.5±0.1% $Y_2O_5$ or $ThO_2$, with the balance being Fe. For example, one Ti composition may include 15.0-23.0% Cr, 0.5-2.0% Si, 0.0-4.0% Mo, 0.0-1.2% Nb, 0.0-3.0% Fe, 0.0-0.5% Ti, 0.0-0.5% Al, 0.0-0.3% Mn, 0.0-0.1% Zr, 0.0-0.035% Ce, 0.005-0.025% Mg, 0.0005-0.005% B, 0.005-0.3% C, 0.0-20.0% Co, balance Ni. Sample Ti-based feedstock component includes 0-45% metal powder; 15-40% binder; 0-10% Polymer (e.g., thermoplastics and thermosets); surfactant 0-3%; lubricant 0-3%; sintering aid 0-1%. Another sample Ti-based feedstock component includes about 62% TiH2 powder as a metal powder; about 29% naphthalene as a binder; about 2.1-2.3% polymer (e.g., EVA/epoxy); about 2.3% SURFONIC N-100° as a Surfactant; lubricant is 1.5% stearic acid as a; about 0.4% silver as a sintering Aid. Examples of metal compounds include metal hydrides, such as TiH2, and intermetallics, such as TiAl and $TiAl_3$. A specific instance of an alloy includes Ti-6Al,4V, among others. In another embodiment, the metal powder comprises at least approximately 45% of the volume of the feedstock, while in still another, it comprises between approximately 54.6% and 70.0%. In addition, Ti—Al alloys may consists essentially of 32-38% of Al and the balance of Ti and contains 0.005-0.20% of B, and the alloy which essentially consists of the above quantities of Al and Ti and contains, in addition to the above quantity of B, up to 0.2% of C, up to 0.3% of O and/or up to 0.3% of N (provided that O+N add up to 0.4%) and c) 0.05-3.0% of Ni and/or 0.05-3.0% of Si, and the balance of Ti.

Examples of metals for use in the present invention include but are not limited to: stainless steel including martensitic and austenitic stainless steel, steel alloys, tungsten alloys, soft magnetic alloys such as iron, iron-silicon, electrical steel, iron-nickel (50Ni-50F3), low thermal expansion alloys, or combinations thereof. In one embodiment, the powdered metal is a mixture of stainless steel, brass and tungsten alloy. The stainless steel used in the present invention may be any 1 series carbon steels, 2 series nickel steels, 3 series nickel-chromium steels, 4 series molybdenum steels, series chromium steels, 6 series chromium-vanadium steels, 7 series tungsten steels, 8 series nickel-chromium-molybdenum steels, or 9 series silicon-manganese steels, e.g., 102, 174, 201, 202, 300, 302, 303, 304, 308, 309, 316, 316L, 316Ti, 321, 405, 408, 409, 410, 416, 420, 430, 439, 440, 446 or 601-665 grade stainless steel. For example, the individual upper primer insert portion and lower primer insert portion may be formed from SAE grade: 409, 410, 430, 440A, 440B, 440C, 440F, 410, 416, 420, 420F, 430F, 431, 630 (17-4 stainless steel), 301, 301LN, 304, 304L, 304L, 304LN, 304H, 305, 310, 310S, 316, 316LN, 316L, 316L, 316L, 316Ti, 316LN, 317L, 321, 321H, 2304, 2205, J405, 904L, or 254SMO, As known to those of ordinary skill in the art, stainless steel is an alloy of iron and at least one other component that imparts corrosion resistance. As such, in one embodiment, the stainless steel is an alloy of iron and at least one of chromium, nickel, silicon, molybdenum, or mixtures thereof. Examples of such alloys include, but are not limited to, an alloy containing about 1.5 to about 2.5 percent nickel, no more than about 0.5 percent molybdenum, no more than about 0.15 percent carbon, and the balance iron with a density ranging from about 7 g/cm$^3$ to about 8 g/cm$^3$; an alloy containing about 6 to about 8 percent nickel, no more than about 0.5 percent molybdenum, no more than about 0.15 percent carbon, and the balance iron with a density ranging from about 7 g/cm$^3$ to about 8 g/cm$^3$; an alloy containing about 0.5 to about 1 percent chromium, about 0.5 percent to about 1 percent nickel, no more than about 0.5 percent molybdenum, no more than about 0.2 percent carbon, and the balance iron with a density ranging from about 7 g/cm$^3$ to about 8 g/cm$^3$; an alloy containing about 2 to about 3 percent nickel, no more than about 0.5 percent molybdenum, about 0.3 to about 0.6 percent carbon, and the balance iron with a density ranging from about 7 g/cm$^3$ to about 8 g/cm$^3$; an alloy containing about 6 to about 8 percent nickel, no more than about 0.5 percent molybdenum, about 0.2 to about 0.5 percent carbon, and the balance iron with a density ranging from about 7 g/cm$^3$ to about 8 g/cm$^3$; an alloy containing about 1 to about 1.6 percent chromium, about 0.5 percent or less nickel, no more than about 0.5 percent molybdenum, about 0.9 to about 1.2 percent carbon, and the balance iron with a density ranging from about 7 g/cm$^3$ to about 8 g/cm$^3$; and combinations thereof.

Suitable tungsten alloys include an alloy containing about 2.5 to about 3.5 percent nickel, about 0.5 percent to about 2.5 percent copper or iron, and the balance tungsten with a density ranging from about 17.5 g/cm$^3$ to about 18.5 g/cm$^3$; about 3 to about 4 percent nickel, about 94 percent tungsten, and the balance copper or iron with a density ranging from about 17.5 g/cm$^3$ to about 18.5 g/cm$^3$; and mixtures thereof.

The polymeric and composite casing components may be injection molded. Polymeric materials for the bullet-end and middle body components must have propellant compatibility and resistance to gun cleaning solvents and grease, as well as resistance to chemical, biological and radiological agents. The polymeric materials must have a temperature resistance higher than the cook-off temperature of the propellant, typically about 320° F. The polymeric materials must have elongation-to-break values that to resist deformation under interior ballistic pressure as high as 60,000 psi in all environments (temperatures from about −65 to about 320° F. and humidity from 0 to 100% relative humidity). According to one embodiment, the middle body component is either molded onto or snap-fit to the casing head-end component after which the bullet-end component is snap-fit or interference fit to the middle body component. The components may be formed from high-strength polymer, composite or ceramic.

Examples of suitable high strength polymers include composite polymer material including a tungsten metal powder, nylon 6/6, nylon 6, and glass fibers; and a specific gravity in a range of 3-10. The tungsten metal powder may be 50%-96% of a weight of the bullet body. The polymer material also includes about 0.5-15%, preferably about 1-12%, and most preferably about 2-9% by weight, of nylon 6/6, about 0.5-15%, preferably about 1-12%, and most preferably about 2-9% by weight, of nylon 6, and about 0.5-15%, preferably about 1-12%, and most preferably about 2-9% by weight, of glass fibers. It is most suitable that each of these ingredients be included in amounts less than 10% by weight. The cartridge casing body may be made of a modified ZYTEL® resin, available from E.I. DuPont De Nemours Co., a modified 612 nylon resin, modified to increase elastic response.

Examples of suitable polymers include polyurethane prepolymer, cellulose, fluoro-polymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadinen-styrene, thermoplastic fluoro polymers, inomers, polyamides, polyamide-imides, polyacrylates, polyatherketones, polyaryl-sulfones, polybenzimidazoles, polycarbonates, polybutylene, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, or urethane hybrids. Examples of suitable polymers also include aliphatic or aromatic polyamide, polyeitherimide, polysulfone, polyphenylsulfone, poly-phenylene oxide, liquid crystalline polymer and polyketone. Examples of suitable composites include polymers such as polyphenylsulfone reinforced with between about 30 and about 70 weight percent, and preferably up to about 65 weight percent of one or more reinforcing materials selected from glass fiber, ceramic fiber, carbon fiber, mineral fillers, organo nanoclay, or carbon nanotube. Preferred reinforcing materials, such as chopped surface-treated E-glass fibers provide flow characteristics at the above-described loadings comparable to unfilled polymers to provide a desirable combination of strength and flow characteristics that permit the molding of head-end components. Composite components can be formed by machining or injection molding. Finally, the cartridge case must retain sufficient joint strength at cook-off temperatures. More specifically, polymers suitable for molding of the projectile-end component have one or more of the following properties: Yield or tensile strength at −65° F.>10,000 psi Elongation-to-break at −65° F.>15% Yield or tensile strength at 73° F.>8,000 psi Elongation-to-break at 73° F.>50% Yield or tensile strength at 320° F.>4,000 psi Elongation-to-break at 320° F.>80%. Polymers suitable for molding of the middle-body component have one or more of the following properties: Yield or tensile strength at −65° F.>10,000 psi Yield or tensile strength at 73° F.>8,000 psi Yield or tensile strength at 320° F.>4,000 psi.

Commercially available polymers suitable for use in the present invention thus include polyphenylsulfones; copolymers of polyphenylsulfones with polyether-sulfones or polysulfones; copolymers and blends of polyphenylsulfones with polysiloxanes; poly(etherimide-siloxane); copolymers and blends of polyetherimides and polysiloxanes, and blends of polyetherimides and poly(etherimide-siloxane) copolymers; and the like. Particularly preferred are polyphenylsulfones and their copolymers with poly-sulfones or polysiloxane that have high tensile strength and elongation-to-break to sustain the deformation under high interior ballistic pressure. Such polymers are commercially available, for example, RADEL® R5800 polyphenylesulfone from Solvay Advanced Polymers. The polymer can be formulated with up to about 10 wt % of one or more additives selected from internal mold release agents, heat stabilizers, anti-static agents, colorants, impact modifiers and UV stabilizers.

The polymers of the present invention can also be used for conventional two-piece metal-plastic hybrid cartridge case designs and conventional shotgun shell designs. One example of such a design is an ammunition cartridge with a one-piece substantially cylindrical polymeric cartridge casing body with an open projectile-end and an end opposing the projectile-end with a male or female coupling element; and a cylindrical metal cartridge casing head-end component with an essentially closed base end with a primer hole opposite an open end having a coupling element that is a mate for the coupling element on the opposing end of the polymeric cartridge casing body joining the open end of the head-end component to the opposing end of the polymeric cartridge casing body. The high polymer ductility permits the casing to resist breakage.

One embodiment includes a multi-cavity nose mold for the nose portion and a multi-cavity base mold for the base portion having a metal insert over-molded with a polymer based material. In this embodiment the polymer in the base includes a lip or flange to extract the case from the weapon.

One multi-cavity nose mold to produce the nose of the 5.56, 7.62, 50 caliber, 12.7 mm case can be made using a stripper plate tool using an Osco hot spur and two subgates per cavity. Another embodiment includes a subsonic version, the difference from the standard and the subsonic version is the walls are thicker thus requiring less powder. This will decrease the velocity of the bullet thus creating a subsonic round.

The extracting inserts is used to give the polymer case a tough enough ridge and groove for the weapons extractor to grab and pull the case out the chamber of the gun. The insert may be made of 17-4 or 17-7 stainless steel that is hardened to between 30-70rc or between 42-45rc. The insert may be made of aluminum, brass, cooper, steel or even an engineered resin with enough tensile strength.

The insert is over molded in an injection molded process using a nano clay particle filled Nylon material. The inserts can be machined or stamped. In addition, an engineered resin able to withstand the demand on the insert allows injection molded and/or even transfer molded.

One of ordinary skill in the art will know that many propellant types and weights can be used to prepare workable ammunition and that such loads may be determined by a careful trial including initial low quantity loading of a given propellant and the well known stepwise increasing of a given propellant loading until a maximum acceptable load is achieved. Extreme care and caution is advised in evaluating new loads. The propellants available have various burn rates and must be carefully chosen so that a safe load is devised.

The components may be made of polymeric compositions, metals, ceramics, alloys, or combinations and mixtures thereof. In addition, the components may be mixed and matched with one or more components being made of different materials. For example, the middle body component (not shown) may be polymeric; the nose may be polymeric; and a substantially cylindrical insert (not shown) may be metal. Similarly, the middle body component (not shown) may be polymeric; the nose may be metal; and a substantially cylindrical insert (not shown) may be an alloy. The middle body component (not shown) may be polymeric; the nose may be an alloy; and a substantially cylindrical insert (not shown) may be an alloy. The middle body component (not shown); the nose; and/or the substantially cylindrical insert may be made of a metal that is formed by a metal injection molding process.

The primer insert is bound to the middle body component. In the metal injection molding process of making the primer insert a mold is made in the shape of the primer insert including the desired profile of the primer recess (not shown). The primer insert includes a coupling element extending from a bottom surface that is opposite a top surface (not shown). Located in the top surface (not shown) is a primer recess (not shown) that extends toward the bottom surface. A primer flash hole (not shown) is located in the primer insert and extends through the bottom surface into the powder chamber. The coupling end (not shown) extends through the primer flash hole (not shown) to form an aperture coating (not shown) while retaining a passage from the top surface (not shown) through the bottom surface (not shown) and into the powder chamber to provides support and protection about the primer flash hole (not shown). When contacted the coupling end (not shown) interlocks with the coupling element, through the coupling element that extends with a taper to a smaller diameter at the tip (not shown) to form a physical interlock between primer insert and middle body component.

For example, the metal injection molding process, which generally involves mixing fine metal powders with binders to form a feedstock that is injection molded into a closed mold, may be used to form a substantially cylindrical insert. After ejection from the mold, the binders are chemically or thermally removed from the substantially cylindrical insert so that the part can be sintered to high density. During the sintering process, the individual metal particles metallurgically bond together as material diffusion occurs to remove most of the porosity left by the removal of the binder.

The raw materials for metal injection molding are metal powders and a thermoplastic binder. There are at least two binders included in the blend, a primary binder and a secondary binder. This blended powder mix is worked into the plasticized binder at elevated temperature in a kneader or shear roll extruder. The intermediate product is the so-called feedstock. It is usually granulated with granule sizes of several millimeters. In metal injection molding, only the binders are heated up, and that is how the metal is carried into the mold cavity.

The two piece primer insert includes an individual upper primer insert portion and lower primer insert portion formed in various methods. For example, the individual upper primer insert portion may be formed by metal injection molding, polymer injection molding, stamping, milling, molding, machining, punching, fine blanking, smelting, or any other method. The lower primer insert portion may be formed by metal injection molding, polymer injection molding, stamping, milling, molding, machining, punching, fine blanking, smelting, or any other method that will form insert portions.

The individual upper primer insert portion may be formed from any material, any metal, any alloy, any plastic, any polymer or any composition known to the skilled artisan or listed herein. The individual lower primer insert portion may be formed from any material, any metal, any alloy, any plastic, any polymer or any composition known to the skilled artisan or listed herein.

The upper primer insert portion, the lower primer insert portion or both may be made from entirely or in part from a copolymer of polylactic acid and polycarbonate, the concentration polylactic acid may be between 5-97% and the polycarbonate may be between 5-97%. The 5-97% is meant to be inclusive and include all percentages between 5 and 97 including fractional increments thereof, e.g., 5, 5.25, 5.5, 6, 6.75, 7, 7.4, 8, 8.9, 9, 10 15, 20, 25, 30, 35, 40, 45, 50, 55, 60, 65, 70, 75, 80, 85, 90, 95, or 97. In addition, the copolymer may include other polymers, additives, fibers, nanoclay, metals etc. When other polymers or components are present the combined percentage of polylactic acid and polycarbonate may be 5, 6, 7, 8, 9, 10 15, 20, 25, 30, 35, 40, 45, 50, 55, 60, 65, 70, 75, 80, 85, 90, 95, or 100.

The description of the preferred embodiments should be taken as illustrating, rather than as limiting, the present invention as defined by the claims. As will be readily appreciated, numerous combinations of the features set forth above can be utilized without departing from the present invention as set forth in the claims. Such variations are not regarded as a departure from the spirit and scope of the invention, and all such modifications are intended to be included within the scope of the following claims.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

What is claimed is:

1. A two piece pressed primer insert engaged to an ammunition cartridge having a projectile aperture integrally connected to a cartridge body at a first end of the cartridge body, wherein the cartridge body is molded over the two piece pressed primer insert at a second end of the cartridge body that is opposite from the first end and defines a propellant chamber between the first end and the second end, the two piece pressed primer insert comprising:

a first primer insert portion comprising: a cylindrical insert coupling element having an insert tip at one end opposite a cylindrical first primer insert portion joining region, and an insert transition located between the insert tip and the cylindrical first primer insert portion joining region;

a second primer insert portion comprising: an inner surface connected to an extraction flange by a cylindrical second primer insert portion joining region, a primer recess located within the cylindrical second primer insert portion joining region, a primer flash aperture extending through the inner surface into the primer recess, and a flash aperture groove around the primer flash aperture in the primer recess;

an insert joint extending between the cylindrical second primer insert portion joining region and the cylindrical first primer insert portion joining region, wherein the insert joint is configured to frictionally fit the cylindrical first primer insert portion joining region about the cylindrical second primer insert portion joining region to form the two piece pressed primer insert; and a support structure extending vertically from the insert joint about a portion of the cylindrical insert coupling element, the support structure at least partially covered by the second end of the cartridge body and configured to provide lateral support about the first primer insert portion.

2. The two piece pressed primer insert of claim 1, wherein the insert joint is also chemical bonded, chemical welded, soldered, smelted, sintered, adhesive bonded, laser welded, ultrasonic welded, friction spot welded, friction stir welded or a combination thereof.

3. The two piece pressed primer insert of claim 1, wherein the first primer insert portion, the second primer insert portion or both are formed independently by metal injection molding, polymer injection molding, stamping, pressing, milling, molding, machining, punching, fine blanking, or smelting.

4. The two piece pressed primer insert of claim 1, wherein the first primer insert portion, the second primer insert portion or both comprise a polymer, a metal, an alloy, or a ceramic alloy.

5. The two piece pressed primer insert of claim 1, wherein the first primer insert portion and the second primer insert portion comprise the same material or different materials.

6. The two piece pressed primer insert of claim 1, wherein the support structure is positioned about the insert transition.

7. The two piece pressed primer insert of claim 1, wherein the support structure extends at least partially into the insert joint.

8. The two piece pressed primer insert of claim 1, wherein the support structure is a mesh, a sheet or a weave.

9. The two piece pressed primer insert of claim 1, wherein the support structure is a mesh with a hole density of up to 800 holes per square inch of the mesh.

10. The two piece pressed primer insert of claim 9, wherein the mesh is a polymer mesh.

11. The two piece pressed primer insert of claim 9, wherein the mesh is a wire mesh.

12. The two piece pressed primer insert of claim 1, wherein the support structure extends beyond the insert tip.

13. The two piece pressed primer insert of claim 12, wherein the support structure is positioned about an interior wall of the cylindrical insert coupling element.

14. The two piece pressed primer insert of claim 13, wherein the support structure further extends about the interior wall, over the insert tip and downward over at least a portion of an exterior wall of the cylindrical insert coupling element.

15. The two piece pressed primer insert of claim 14, wherein the support structure extends over the exterior wall to the insert joint.

16. The two piece pressed primer insert of claim 12, wherein the support structure is positioned about an exterior wall of the cylindrical insert coupling element.

17. The two piece pressed primer insert of claim 16, wherein the support structure further extends about the exterior wall, over the insert tip and downward over at least a portion of an interior wall of the cylindrical insert coupling element.

18. The two piece pressed primer insert of claim 1, wherein the support structure is adhesively secured at the insert joint.

19. The two piece pressed primer insert of claim 1, wherein the support structure extends the full length of the insert joint.

20. The two piece pressed primer insert of claim 1, wherein the support structure forms a gap between the insert transition and the support structure extending about the cylindrical insert coupling element.

* * * * *